US006633224B1

(12) United States Patent
Hishida et al.

(10) Patent No.: US 6,633,224 B1
(45) Date of Patent: Oct. 14, 2003

(54) RADIO-CALLING DEVICE CAPABLE OF SETTING FLEXIBLY OUTPUT MODE

(75) Inventors: Toshihiro Hishida, Hyogo (JP); Hidetaka Ohto, Hyogo (JP); Hitoshi Uno, Gifu (JP); Kazunori Watanabe, Kanagawa (JP); Masakazu Kawano, Osaka (JP); Hiromi Wada, Osaka (JP); Yasunori Tanaka, Osaka (JP); Yoshifumi Yonemoto, Osaka (JP)

(73) Assignee: Matsushita Eletric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 09/125,402

(22) PCT Filed: Feb. 28, 1997

(86) PCT No.: PCT/JP97/00601

§ 371 (c)(1),
(2), (4) Date: Jun. 28, 1999

(87) PCT Pub. No.: WO97/32407

PCT Pub. Date: Sep. 4, 1997

(30) Foreign Application Priority Data

| | | |
|---|---|---|
| Feb. 29, 1996 | (JP) | 8-42749 |
| Nov. 29, 1996 | (JP) | 8-320424 |
| Nov. 29, 1996 | (JP) | 8-335085 |
| Jul. 3, 1996 | (JP) | 8-173261 |
| Jun. 28, 1996 | (JP) | 8-169194 |

(51) Int. Cl.[7] ..... G08B 5/22

(52) U.S. Cl. ..... 340/7.21; 340/7.22; 340/7.2; 340/7.51

(58) Field of Search ..... 340/7.24, 7.21, 340/7.51, 7.52, 7.55, 7.2

(56) References Cited

U.S. PATENT DOCUMENTS

| | | | | |
|---|---|---|---|---|
| 4,872,005 A | | 10/1989 | DeLuca et al. | |
| 5,089,813 A | * | 2/1992 | DeLuca et al. | 340/825.44 |
| 6,032,025 A | * | 2/2000 | Sugio et al. | 455/38.4 |

FOREIGN PATENT DOCUMENTS

EP 0712100 A1 * 5/1996

* cited by examiner

*Primary Examiner*—Michael Horabik
*Assistant Examiner*—M Shimizu

(57) ABSTRACT

A radio pager system includes a radio pager that can receive messages and can specify a specific output mode, including a display, a sound output, a vibration, and a light emission appropriate to a particular type of message. The radio pager can further reduce difficulties in retransmitting and/or replying to messages and save time in the transmission period. The radio pager can receive and implement a radio message that includes control information which can be utilized for generating the specific output mode of the display.

13 Claims, 76 Drawing Sheets

FIG. 7A

2a

```
/* COLUMN DEFINITION DATA */
columnDef(1, "Identifier" ) ;
columnDef(2, "TemplateName" ) ;
columnDef(3, "Secretword" ) ;
columnDef(4, "Person" ) ;
columnDef(5, "Time" ) ;
columnDef(6, "Place" ) ;
columnDef(7, "Event" ) ;
columnDef(8, "ReplyFlag" )
```

FIG. 7B

COLUMN DEFINITION DATA

| 2a1 | 2a2 | 2a3 | 2a4 | 2a5 | 2a6 | 2a7 | 2a8 | 64 α | 64 β |
|---|---|---|---|---|---|---|---|---|---|
| IDENTIFIER | TEMPLATE NAME | SECRET WORD | PERSON | TIME | PLACE | EVENT | REPLY | TRANSMISSION INFORMATION | CONFIRMATION INFORMATION |

2a

FIG. 8A

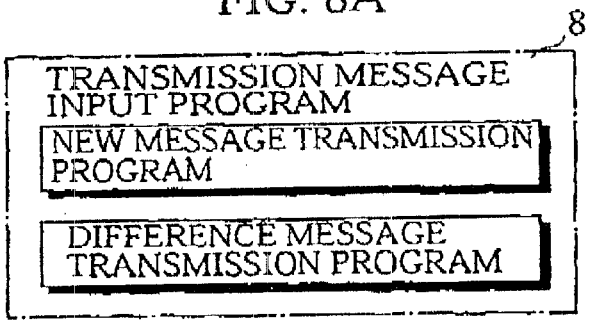

FIG. 8B

```
/*TRANSMISSION MESSAGE INPUT PROGRAM*/                                   8
/*RETURN INPUT STRING AS RETURN VALUE*/
char *Input__Message(Identifier) {
        :
        :
        /*SELECT TEMPLATE*/
        template=selectTemplate() ;
        /*IF TRANSMISSION MESSAGE IS NEW*/
        if(Identifier==SHINKI) {
                /*OBTAIN THE NUMBER OF COLUMNS IN TEMPLATE*/
                columnNum=getTemplateColumnNum(template) ;
                for(i=1 ; i <=columnNum ; i++) {
                        /*OBTAIN MEANING OF EACH COLUMN*/
                        mean=getColumMean(template,1) ;
                        /*DISPLAY MEANING AND WAIT FOR USER INPUT*/
                        DisplayColumMean(mean) ;
                        /*INPUT CODES (CONTENT) AS INPUT STRING ARE*/
                        /*COMBINED TO inputMes*/
                        InputContent(inputMes,content)
                }                                                       8 α
        }
        /*IF TRANSMISSION MESSAGE IS NOT NEW*/
        eles {
                /*SELECT PREVIOUSLY TRANSMITTED MESSAGE(INPUT RECEPTION)*/
                message=getSelectMessage() ;
                /*SELECT COLUMN NUMBER OF CONTENTS TO BE CHANGED(INPUT RECEPTION)*/
                column=getSelectColum() ;
                /*OBTAIN MEANING OF SELECTED COLUMN*/
                mean  getColumMean(template,column) ;
                /*DISPLAY MEANING AND WAIT FOR USER INPUT*/
                DisplayColumMean(mean) ;
                /*INPUT CODES (CONTENT) AS INPUT STRING ARE*/
                /*COMBINED TO inputMes*/
                InputContent(inputMes,content)
                }                                                       8 β
        }
        /*RETURN*/
        return(columMes) ;
}
```

(PLEASE SELECT TEMPLATE)
(NONE)
**テンプレートヲエランデクダサイ
1. マチアワセ
2. カフカ
3. ナシ
(MEETING)
(STOCK PRICE)

**シキベツシヲエランデクダサイ
#8 シンキソウシン
#9 サブンソウシン
(PLEASE SELECT IDENTIFIER)
(NEW)
(DIFFERENCE)

アイコトバ ハ?
(SECRET WORD?)

アイコトバ ハ?
ME
(SECRET WORD?)

ワタシ ノ ナマエ ハ?
(NAME?)

ワタシ ノ ナマエ ハ?
スズキ
(NAME?)
(SUZUKI)

ジカン ハ?
1800-
(TIME?)

イベント ハ?
ウチアゲ
(EVENT?)
(ENDING PARTY)

ヘンシン イリマスカ?
1. イル
2. イラナイ
(IS REPLY NEEDED?)
(YES)
(NO)
NEXT
SELECT

FIG. 13A

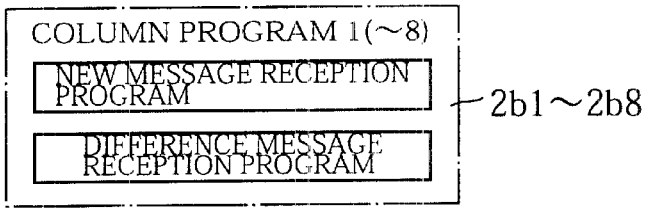

FIG. 13B

```
/*COLUMN PROGRAM*/
/*COLUMN PROGRAM1*/
/*NEW MESSAGE RECEPTION PROGRAM*/
char *Column_1_Sinki() {
        :
}

/*DIFFERENCE MESSAGE RECEPTION PROGRAM*/
char *Column_1_Sabun() {
        :
}
        :
        :
/*COLUMN PROGRAM 5*/

/*NEW MESSAGE RECEPTION PROGRAM*/
char *Column_5_Sinki() {
        :
        /*OBTAIN RECEIVED MESSAGE*/
        message=getRecieveMessage() ;
        /*OBTAIN COLUMN DATA STORED IN RADIO PAGER*/
        time=getContent(message,5) ;
        /*GENERATE DISPLAY DATA OF NEW MESSAGE(ASSIGN TO columnMes*/
        scanf(columnMes, "%d ジカラテス",time) ;
        /*RETURN*/                    (BE STARTED AT)
        return(columnMes) ;
}

/*DIFFERENCE MESSAGE RECEPTION PROGRAM*/
char *Column_5_Sabun() {
        :
        /*OBTAIN RECEIVED MESSAGE*/
        message=getRecieveMessage() ;
        /*OBTAIN SECRET WORD*/
        aikotoba=getContent(message,3) ;
        /*RETRIEVE PRECEDING MESSAGE USING SECRET WORD*/
        oldMessage=searchMessage(aikotoba) ;
        /*OBTAIN BOTH NEW AND PRECEDING COLUMN DATA STORED IN RADIO PAGER*/
        time=getContent(message,5) ;
        oldtime=getContent(oldmessage,5) ;
        /*COMPARE TIME*/
        if(time <oldtime) {
                /*GENERATE DISPLAY DATA OF DIFFERENCE MESSAGE(ASSIGN TO columnMes*/
                scanf(column, "%d  ジニハヤクナリマス",time)
        }                                   (BE ADVANCED TO)
        else {
                scanf(column, "%d  ジニオソクナリマス",time)
        }                                   (BE POSTPONED TO)
        /*RETURN*/
        return(columnMes) ;
}
        :
        :
```

①

⑤

FIG. 15A

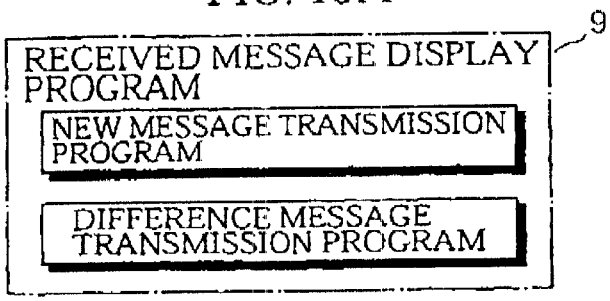

FIG. 15B

```
/*RECEIVED MESSAGE DISPLAY PROGRAM*/
void Display__RecieveMessage() {
:
:
        /*OBTAIN RECEIVED MESSAGE*/
        message=getRecieveMessage() ;
        /*IF IDENTIFIER OF RECEIVED MESSAGE IS NEW*/
        if(getContent(message,1)==SHINKI) {
                /*OBTAIN THE NUMBER OF COLUMNS IN RECEIVED MESSAGE*/
                columnNum=getColumnNum(message) ;
                for(i=1 ; i <=columnNum ; i++) {
                        /*GENERATE PROGRAM NAME OF EACH COLUMN*/
                        sprint(functionName, "Column__%d__Shinki" ,&i) ;
                        /*EXECUTE PROGRAM*/
                        /*COMBINE EXECUTION RESULT IN DISPLAY ORDER TO FORM INPUT STRING*/
                        concatenateString(dispMessage,eval(functionName) ;
                }
        }
        /*IF IDENTIFIER OF RECEIVED MESSAGE IS NOT NEW*/
        eles
                /*OBTAIN SECRET WORD*/
                aikotoba=getContent(message,3) ;
                /*RETRIEVE PRECEDING MESSAGE USING SECRET WORD*/
                oldMessage=searchMessage(aikotoba) ;
                /*OBTAIN THE NUMBER OF COLUMNS IN PRECEDING MESSAGE*/
                columnNum=getColumnNum(oldmessage) ;
                for(i=1 ; i <=columnNum ; i++) {
                        /*GENERATE PROGRAM NAME OF EACH COLUMN*/
                sprintf(functionName, "Column__%d__Sabun" ,&i) ;
                        /*EXECUTE PROGRAM*/
                        /*COMBINE EXECUTION RESULT IN DISPLAY ORDER TO FORM INPUT STRING*/
                        concatenateString(dispMessage,eval(functionName) ;
                }
        }
        /*DISPLAY*/
        displayString(dismessage) ;
```

THE ENDING PARTY AT TENGU IS STARTED AT 18:00. SENDER:SUZUKI. REPLY NEEDED.

THE ENDING PARTY AT TENGU IS POSTPONE TO 19:00. SENDER:SUZUKI. DIFFERENCE

FIG. 31A

801

| IDENTIFER | PROGRAM |
|---|---|
| ⋮ | ⋮ |
| 0003 | VALUE 1=FIRST ARGUMENT;<br>if(ARGUMENT ATTRIBUTE INFORMATION IN VALUE 1==PROGRAM CONDITION INFORMATION){<br>if(ARGUMENT VALUE IN VALUE 1==RANDOM ARGUMENT){<br>VALUE 1=NEXT ARGUMENT;<br>do {<br>if(ARGUMENT ATTRIBUTE INFORMATION IN VALUE 1==START FROM 1){<br>EXECUTE DISPLAY INSTRUCTION USING INFORMATION OF VALUE 1;<br>}<br>else if(ARGUMENT ATTRIBUTE INFORMATION IN VALUE 1==START FROM 2){<br>EXECUTE SOUND OUTPUT INSTRUCTION USING INFORMATION OF VALUE 1;<br>}<br>else if(ARGUMENT ATTRIBUTE INFORMATION IN VALUE 1==START FROM 3){<br>EXECUTE VIBRATION INSTRUCTION USING INFORMATION OF VALUE 1;<br>}<br>VALUE 1=NEXT ARGUMENT;<br>} white(UNTIL VALUE 1 BECOMES NULL);<br>}<br>else if(ARGUMENT VALUE IN VALUE 1=FIXED ARGUMENT){<br>VALUE 1=NEXT ARGUMENT;<br>if(ARGUMENT ATTRIBUTE INFORMATION IN VALUE 1==START FROM 1){<br>EXECUTE DISPLAY INSTRUCTION USING INFORMATION OF VALUE 1;<br>}<br>VALUE 1=NEXT ARGUMENT;<br>if(ARGUMENT ATTRIBUTE INFORMATION IN VALUE 1==START FROM 2){<br>EXECUTE SOUND OUTPUT INSTRUCTION USING INFORMATION OF VALUE 1;<br>}<br>}<br>} |
| ⋮ | ⋮ |

FIG. 31B

802 SPECIFIC EXAMPLE OF PROGRAM 801

```
Val 1=GetArg(First) ;

if(Val 1.ArgAttrInfo==PROGRAMCONDITIONINFO){
 if(Val 1.ArgVolue==RANDOMARG){
   Val 1=GetArg(Next) ;
   do{
    if(Val 1.ArgAttrInfo[0]==1){
      ExecDisplay(Val 1) ;
    }
    else if(Val 1.ArgAttrInfo[0]==2){
      ExecSound(Val 1) ;
    }
    else if(Val 1.ArgAttrInfo[0]==3){
      ExecVibrate(Val 1) ;
    }
   Val 1=GetArg (Next) ;
  | white (Val 1=NULL) ;
  |
  else if(Val1.ArgValue==FIXARG){
   Val 1=GetArg (Next) ;
   if (Val 1.ArgAttrInfo [0] ==1){
      ExecDisplay(Val 1) ;
    }
   Val 1=GetArg (Next) ;
   else if (Val 1.ArgAttrInfo [0] ==2){
      ExecSound(Val 1) ;
   }
  }
 }
}
```

FIG. 33A

601e SOUND OUTPUT CONTROL UNIT

| SOUND IDENTIFIER | SOUND PATTERN |
|---|---|
| 00 | "BEEP" |
| 01 | "BEEP BEEP" |
| 02 | "BEEP BEEP BEEP" |
| 03 | SONG "DRAEMON" |
| ⋮ | ⋮ |

FIG. 33B

601f VIBRATION CONTROL UNIT

| VIBRATION IDENTIFIER | VIBRATION PATTERN (VIBRATIONS) |
|---|---|
| 00 | ONCE |
| 01 | TWICE |
| 02 | THREE TIMES |
| ⋮ | ⋮ |

(12:00 UMEDA)
106h LCD
106h
106i
106i SPEAKER
601g VIBRATOR
"BEEP BEEP"
THREE VIBRATIONS
601g
THREE VIBRATIONS

FIG. 38
(ITO TARO)
| IDENTIFIER | NAME | TELEPHONE NUMBER |
|---|---|---|
| 001 | イトウタロウ | 06－111－2222 |
| 002 | ヤマダ゛ハナコ | 06－333－4444 |
| ⋮ | ⋮ | ⋮ |
(YAMADA HANAKO)
FIG. 39
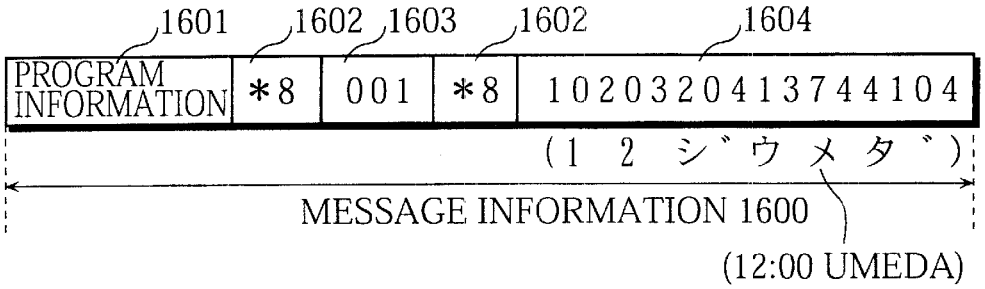
FIG. 40
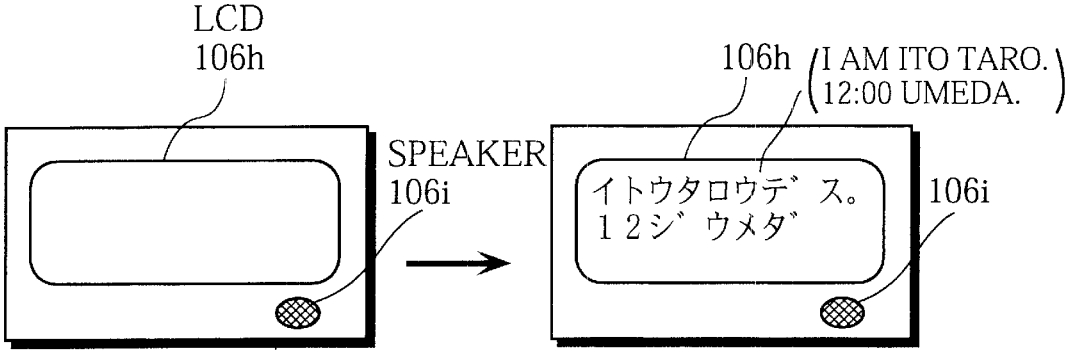

FIG. 54

| | |
|---|---|
| 906a SOUND OUTPUT CONTROL INFORMATION | (0 : OFF, 1~9 : SOUND OUTPUT CONTROL OF MELODY PATTERNS 1 – 9) |
| 906b VIBRATION CONTROL INFORMATION | (0 : OFF, 1 : ON) |
| 906c LED CONTROL INFORMATION | (0 : OFF, 1 : ON) |
| 906d DISPLAY CONTROL INFORMATION | (0 : OFF, 1 : ON) |

FIG. 55

| SOUND OUTPUT CONTROL INFORMATION | MELODY PATTERN |
|---|---|
| 1 | "BEEP" |
| 2 | "DING—DONG" |
| 3 | "KIMI GA IRU DAKE DE" |
| 4 | "HEIGH-HO" |
| 5 | "HAPPY BIRTHDAY" |
| ⋮ | ⋮ |

n=1 : TRANSMITTER INFORMATION
2 : PASSWORD INFORMATION
3 : PROGRAM IDENTIFICATION INFORMATION

N=1 : COMMAND INFORMATION
2 : EVENT NUMBER INFORMATION
3 : EVENT CONDITION INFORMATION
4 : EVENT EXECUTION CONTENTS INFORMATION

| | |
|---|---|
| SOUND OUTPUT CONTROL INFORMATION | 0 : OFF |
| VIBRATION CONTROL INFORMATION | 0 : OFF |
| LED CONTROL INFORMATION | 0 : OFF |
| DISPLAY CONTROL INFORMATION | 0 : OFF |

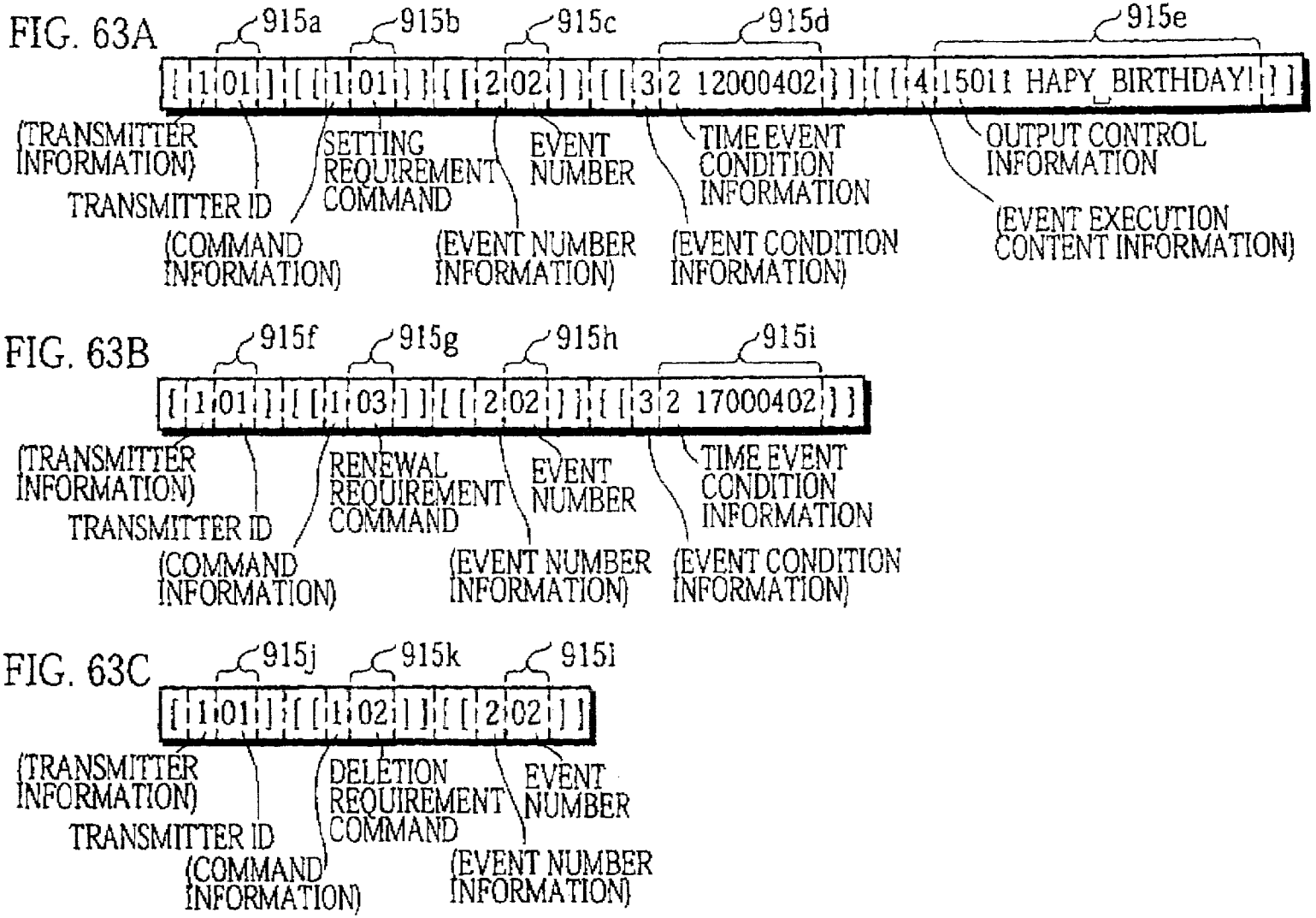
FIG. 63A
915a
915b
915c
915d
915e
01
01
02
3 2 12000402
4 15011 HAPY BIRTHDAY
(TRANSMITTER INFORMATION)
TRANSMITTER ID
SETTING REQUIREMENT COMMAND
(COMMAND INFORMATION)
EVENT NUMBER
(EVENT NUMBER INFORMATION)
TIME EVENT CONDITION INFORMATION
(EVENT CONDITION INFORMATION)
OUTPUT CONTROL INFORMATION
(EVENT EXECUTION CONTENT INFORMATION)
FIG. 63B
915f
915g
915h
915i
01
03
02
3 2 17000402
(TRANSMITTER INFORMATION)
TRANSMITTER ID
RENEWAL REQUIREMENT COMMAND
(COMMAND INFORMATION)
EVENT NUMBER
(EVENT NUMBER INFORMATION)
TIME EVENT CONDITION INFORMATION
(EVENT CONDITION INFORMATION)
FIG. 63C
915j
915k
915l
01
02
02
(TRANSMITTER INFORMATION)
TRANSMITTER ID
DELETION REQUIREMENT COMMAND
(COMMAND INFORMATION)
EVENT NUMBER
(EVENT NUMBER INFORMATION)

FIG. 64A

| EVENT IDENTIFICATION INFORMATION | EVENT CONDITION INFORMATION | EVENT EXECUTION CONTENTS INFORMATION |
|---|---|---|
| ⋮ | ⋮ | ⋮ |
| 01 02 | 21200 0402 | 15011 HAPPY_BIRTHDAY! |
| ⋮ 16a | ⋮ 16b | ⋮ 16c |

16d

FIG. 64B

| EVENT IDENTIFICATION INFORMATION | EVENT CONDITION INFORMATION | EVENT EXECUTION CONTENTS INFORMATION |
|---|---|---|
| ⋮ | ⋮ | ⋮ |
| 01 02 | 21700 0402 | 15011 HAPPY_BIRTHDAY! |
| ⋮ 16e | ⋮ 16f | ⋮ 16g |

16h

FIG. 66

| EVENT IDENTIFICATION INFORMATION | EVENT CONDITION INFORMATION | EVENT EXECUTION CONTENTS INFORMATION |
|---|---|---|
| 0 0 1 0 | 1 2 0 1 2 3 | 1 4 0 0 1 |
| 0 0 1 1 | 1 2 5 5 5 5 | 1 1 0 1 1 1 |
| 0 0 1 2 | 1 2 7 7 7 7 | 1 2 0 0 1 クラブメンバ |

(CLIB MEMBER)

EXECUTION CONTENTS

EXECUTION CONTENTS TYPE

KEY CONTENTS

KEY TYPE

EVENT CONDITION CONTENTS

EVENT CONDITION TYPE

FIG. 67A
TEL␣111−1111
FIG. 67B
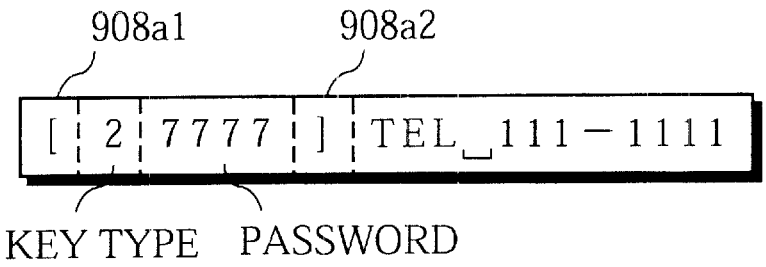
FIG. 68
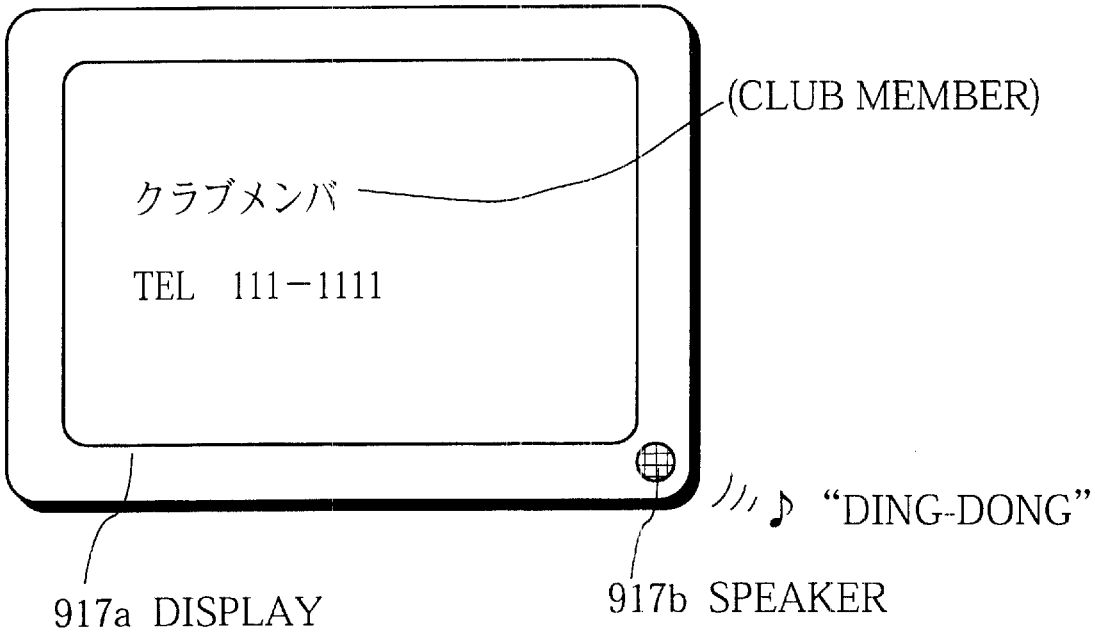

FIG. 70

| EVENT IDENTIFICATION INFORMATION | EVENT CONDITION INFORMATION | EVENT EXECUTION CONTENTS INFORMATION |
|---|---|---|
| ⋮ | ⋮ | ⋮ |
| 01 03 | 30005 | 121111 セイカイハ_2 |

(THE ANSWER IS 2)

FIG. 71

| | |
|---|---|
| SOUND OUTPUT CONTROL INFORMATION | 1 : MERODY PATTERN 1 |
| VIBRATION CONTROL INFORMATION | 0 : OFF |
| LED CONTROL INFORMATION | 0 : OFF |
| DISPLAY CONTROL INFORMATION | 1 : ON |

BLOCK 1

```
Attribute f1
Use         %1,%2
```

BLOCK 2

```
Receive_action{                                  S932
              if(%1==$f1 || $f1=="")             S933
S931             {display %1"INFORMATION¥n"%2
                  melody 1                       S934
                 }else{
                  delete Msg                     S935
                 }
              }
```

BLOCK 3

```
Set_filter{
S936          input f1      S937
              }
```

(MUSIC INFORMATION)

BLOCK 1

```
Attribute f1
Use          %1,%2,%3
```

BLOCK 2

```
Receive_action{                                  S942
            if(%3!=""){                          S943
S941           set f1 %3
            }
            if(%1==$f11&&$f1!="")                S944
               {display %1"INFORMATION¥n"%2      S945
               }else{                            S946
                delete Msg
               }
            }
```

RADIO-CALLING DEVICE CAPABLE OF SETTING FLEXIBLY OUTPUT MODE

FIELD OF THE INVENTION

The present invention relates to a radio pager that receives message information and outputs the information by output operations such as displays, sounds, and vibrations, and relates to a method of controlling the output operations.

DESCRIPTION OF THE PRIOR ART

FIG. 1 shows the general construction of a system that uses a conventional radio pager. As shown in the figure, a message inputted using a telephone 2601 is transmitted to a radio pager 2604 via a public network 2602, a radio station 2603, and an antenna 2605 by radio waves.

The radio pager 2604 includes a reception unit 2606 for receiving the message transmitted by radio via the antenna 2605, a conversion unit 2607 for converting the received message as necessary, a display unit 2608 for displaying the received message, a message storage unit 2609 for storing the received message, a setting unit 2610, and a fixed message storage unit 2611.

A message is usually inputted using 12 keys that are made up of "*", "#", and 10 numeric keys of "1" to "0". A letter of Japanese katakana or alphabet can be inputted using a two-digit number.

For example, "23239912" is inputted in order to generate a message "スズキ" (SUZUKI). Here, "ス" (SU) is expressed by "23", a voiced consonant mark "゛" is expressed by "99", and "キ" (KI) is expressed by "12". On receiving the radio message "23239912", the radio pager outputs the message "スズキ" on a display screen along with bell or melody sounds which are set in advance.

If a fixed message "TELクダサイ" (PLEASE CALL) is registered in a code "*0510" in advance, on receiving a radio message "23239912*0510", the radio pager outputs the message "スズキ TELクダサイ" (SUZUKI, PLEASE CALL) along with the bell or melody sounds set in advance.

With a radio selection call receiver disclosed in Japanese Laid-Open Patent Application No. 3-24827, a transmitter can specify a sound to be outputted at the time of message reception by including information specifying a call notification sound pattern and a sound level in a radio message.

Also, a radio pager 32 in FIG. 2, disclosed in Japanese Laid-Open Patent Application No. 3-18137, includes a clock unit 32*d*, a timer time setting unit 32*e*, and a comparison unit 32*f* which compares a set timer time of the timer time setting unit 32*e* and a clock time of the clock unit 32*d* and outputs a matching signal when they match. A control unit 32*c* drives and controls a call display unit 32*b* according to the matching signal. The timer time (time of day) is set according to a timer time setting signal which is included in a calling signal.

However, in these conventional radio pagers, the display unit can only be driven and controlled in accordance with a fixed factor such as a scheduled time. Also, the contents of the control are limited to the bell sound output. Furthermore, it is difficult to cancel or change the contents which have already been set.

The transmitter can only specify the call notification sound pattern and the sound level to be outputted at the time of the message reception but cannot specify a message display pattern and a sound, such as the call notification sound, to be outputted in association with the message display. Thus, there is a problem of restricted flexibility in making a transmission message.

To transmit messages which have the same meaning but subtly different styles for various receivers, it is necessary to create and transmit each message with a different style to a corresponding receiver. This incurs a great cost and time to the transmitter.

In the conventional radio pagers, a message is processed as an indivisible unit, so that a transmission message and a received message have the same contents. Accordingly, to partially change the contents of a message that has already been transmitted, it is necessary to create a whole message again by inputting both the changed part and the unchanged part of the original message. The partial change cannot be made just by transmitting the changed part. Thus, the conventional radio pagers have a drawback that it is troublesome to input messages and to retransmit and reply to the messages.

Also, with the conventional radio pagers, not only the changed part but the unchanged part of the original message needs to be transmitted. This causes the wastes in retransmitting the same part of the message.

The use of a self-made message setting function cannot sufficiently reduce the difficulties in retransmitting/replying messages and the wastes in retransmitting the same part of the messages.

DISCLOSURE OF THE INVENTION

The present invention aims to provide a radio pager that can specify output control including a display, a sound output, a vibration, a light emission, and the like in greater variety and flexibility, and a control method of the radio pager.

The present invention also aims to provide a radio pager whose output control can be determined and changed by the transmitter and a control method of the radio pager.

The present invention also aims to provide a radio pager that can reduce the transmitter's difficulties in making messages which have the same meaning but different styles improve the flexibility in making messages, and a control method of the radio pager.

The present invention further aims to provide a radio pager that can reduce the difficulties in retransmitting/replying messages and the wastes in transmission, and a control method of the radio pager.

The above objects can be fulfilled by a radio pager, comprising: output means for performing an output operation using at least one of a display, a sound output, a vibration, and a light emission; storage means for storing control information for controlling an output mode that includes at least one of the display, the sound output, the vibration, and the light emission; reception means for receiving a radio message that includes at least one parameter relating to the control information; generation means for generating output control data according to the received parameter and the control information; and control means for controlling the output means according to the output control data generated by the generation means.

Here, the storage means may store any of: at least one program for processing data in the radio message and determining the output mode; at least one set of event information that are each a combination of an event condition relating to the radio message and operation data which is dependent on an occurrence of an event; and at least one template showing a form for a display message where contents of at least one column in the radio message are included. With the above construction, the generated output control data differs according to the parameter in the radio message. Accordingly, the transmitter can flexibly specify the output control including the display, the bell sound output, and the like, by setting the parameter corresponding to the desired output mode.

Here, the reception means may receive the radio message that includes a program identifier as the parameter, and the generation means may process the data in the radio message and determines the output mode according to a program specified by the program identifier in order to generate the output control data which instructs to execute the output mode.

Here, the storage means may store the combination of the event condition for the occurrence of the event and the operation data to be used when the event occurs, wherein the reception means receives the radio message that includes an element relating to the event condition as the parameter, and wherein the generation means generates the output control data according to the operation data stored in the storage means when the event caused by the parameter occurs.

Here, the storage means may store, as the event condition, any of: a reception of a radio message which includes specified data; a coming of a time, and a lapse of a time period since a reception of a radio message.

Here, the storage means may store the template which includes a plurality of columns, wherein the reception means receives the radio message that includes the contents of at least one column as the parameter, and wherein the generation means generates the output control data according to the contents of the columns and the template.

With the above construction, the transmitter can specify the desired output mode by specifying, as the parameter, one of the program identifier, the event condition for the event occurrence, and the template identifier. Since a simple identifier is used as the parameter and the radio message does not need to include a whole display message but only includes data or column contents to be processed by the program, the amount of transmission data can be reduced.

Here, the radio message may include one of a new program, a new set of event information, and a new template, and the radio pager may further include setting means for setting one of the new program, the new set of event information, and the new template included in the radio message into the storage means.

With the above construction, the transmitter can flexibly set the new program, the new event information, and the new template into the radio pager.

Here, the generation means may include: analysis means for analyzing the radio message received by the reception means and detecting the program identifier; read means for reading a program specified by the detected program identifier from the storage means; and creation means for creating the output control data by executing the read program.

Here, the generation means may include: analysis means for analyzing the radio message received by the reception means and detecting the element relating to the event condition; monitor means for monitoring whether the detected element meets the event condition; and creation means for creating the output control data according to the operation data when the event condition is met.

Here, the generation means may include: analysis means for analyzing the radio message received by the reception means and detecting the template identifier and the contents of each column; read means for reading a template specified by the detected template identifier from the storage means; and creation means for creating the output control data according to the read template and the contents of each column.

Also, the above objects can be fulfilled by a control method of a radio pager that includes an output unit for performing an output operation using at least one of a display, a sound output, a vibration, and a light emission and a storage unit for storing control information, the control method comprising: a storage step of storing at least one program that each determine an output mode into the storage unit, the program being stored as the control information for controlling the output mode which includes at least one of the display, the sound output, the vibration, and the light emission; a reception step of receiving a radio message that includes a program identifier as a parameter relating to the control information; a generation step of generating output control data according to the received parameter and the control information; and an output step of controlling the output unit according to the output control data generated in the generation step.

Here, the generation step may include: an analysis substep of analyzing the radio message and detecting the program identifier; a read substep of reading a program specified by the detected program identifier from the storage unit; and a creation substep of creating the output control data by executing the read program.

Here, the generation step may include: an analysis substep of analyzing the radio message and detecting the element relating to the event condition; a monitor substep of monitoring whether the detected element meets the event condition; and a creation substep of creating the output control data according to the operation data when the event condition is met.

Here, the generation step may include: an analysis substep of analyzing the radio message and detecting the template identifier; a read substep of reading a template specified by the detected template identifier from the storage unit; and a creation substep of creating the output control data using the read template and the contents of each column.

With the above construction, the generated output control data differs according to the parameter in the radio message. Accordingly, the transmitter can flexibly specify the output control including the display, the bell sound output, and the like, by setting the parameter corresponding to the desired output mode.

BRIEF DESCRIPTION OF THE DRAWINGS

FIGS. 7A and 7B show examples of the construction of the column definition data in the meeting template.

FIGS. 8A and 8B show examples of the transmission message input program shown in FIG. 3.

FIGS. 13A and 13B show examples of the column program shown in FIG. 3.

FIGS. 15A and 15B show examples of the received message display program shown in FIG. 3.

FIGS. 31A and 31B are schematic diagrams showing information stored in the program information storage unit of the fourth embodiment.

FIGS. 33A and 33B are schematic diagrams showing information stored in the sound output control unit and the vibration control unit of the fourth embodiment.

FIG. 38 is a schematic diagram showing data stored in the address information storage unit of the fifth embodiment.

FIG. 39 shows a specific example of the message information in the fifth embodiment.

FIG. 40 shows the appearance of the radio pager when receiving the message information in the fifth embodiment.

FIG. 54 shows the construction of information in the output setting information storage unit of the eighth embodiment.

FIG. 55 shows an example of the melody patterns of the sound output control information in the eighth embodiment.

FIGS. 63A–63C each show a specific example of a received message in the second operation example.

FIGS. 64A and 64B show specific examples of the event information stored in the event information storage unit in the second operation example.

FIG. 66 shows a specific example of the event information stored in the event information storage unit in the third operation example.

FIGS. 67A and 67B each show a specific example of a received message in the third operation example.

FIG. 68 shows a specific example of the output, such as the display, in the third operation example.

FIG. 70 shows a specific example of the event information stored in the event information storage unit in the third operation example.

FIG. 71 shows a specific example of the output setting information stored in the output setting information storage unit in the fourth operation example.

DESCRIPTION OF THE PREFERRED EMBODIMENTS

The following is an explanation of the first and second embodiments where control information stored in the storage means relates to templates, the third to seventh embodiments where the control information relates to programs, and the eighth embodiment where the control information relates to event information.

First Embodiment

Figure 1:
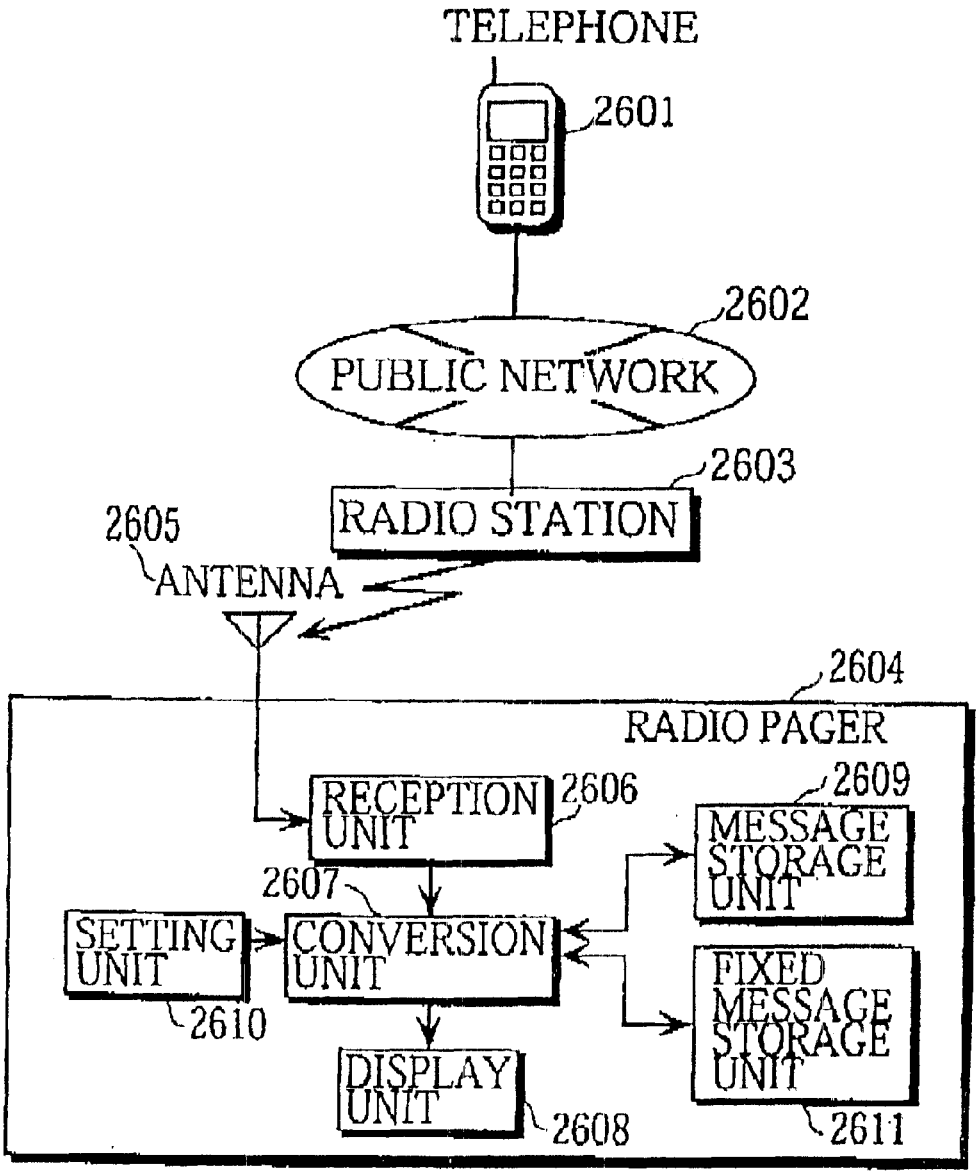
FIG. 1 is a block diagram showing the general construction of the system that uses a conventional radio pager.
Figure 2:
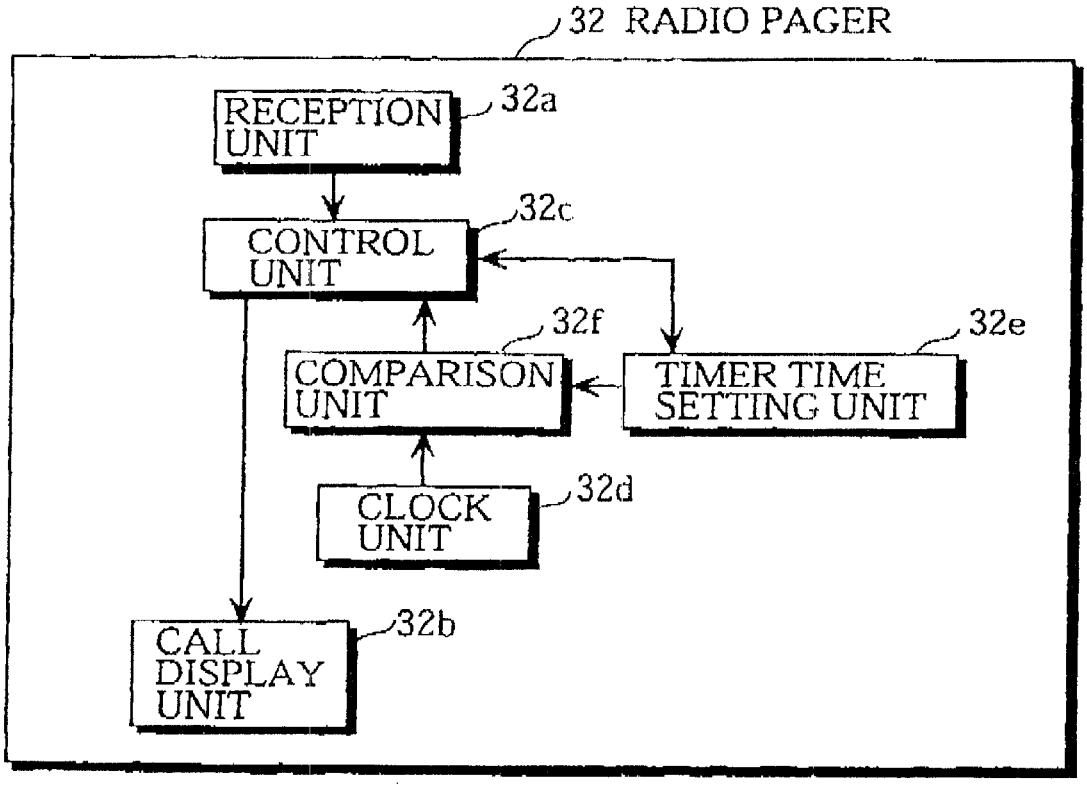
FIG. 2 is a block diagram showing another conventional radio pager.
Figure 3:
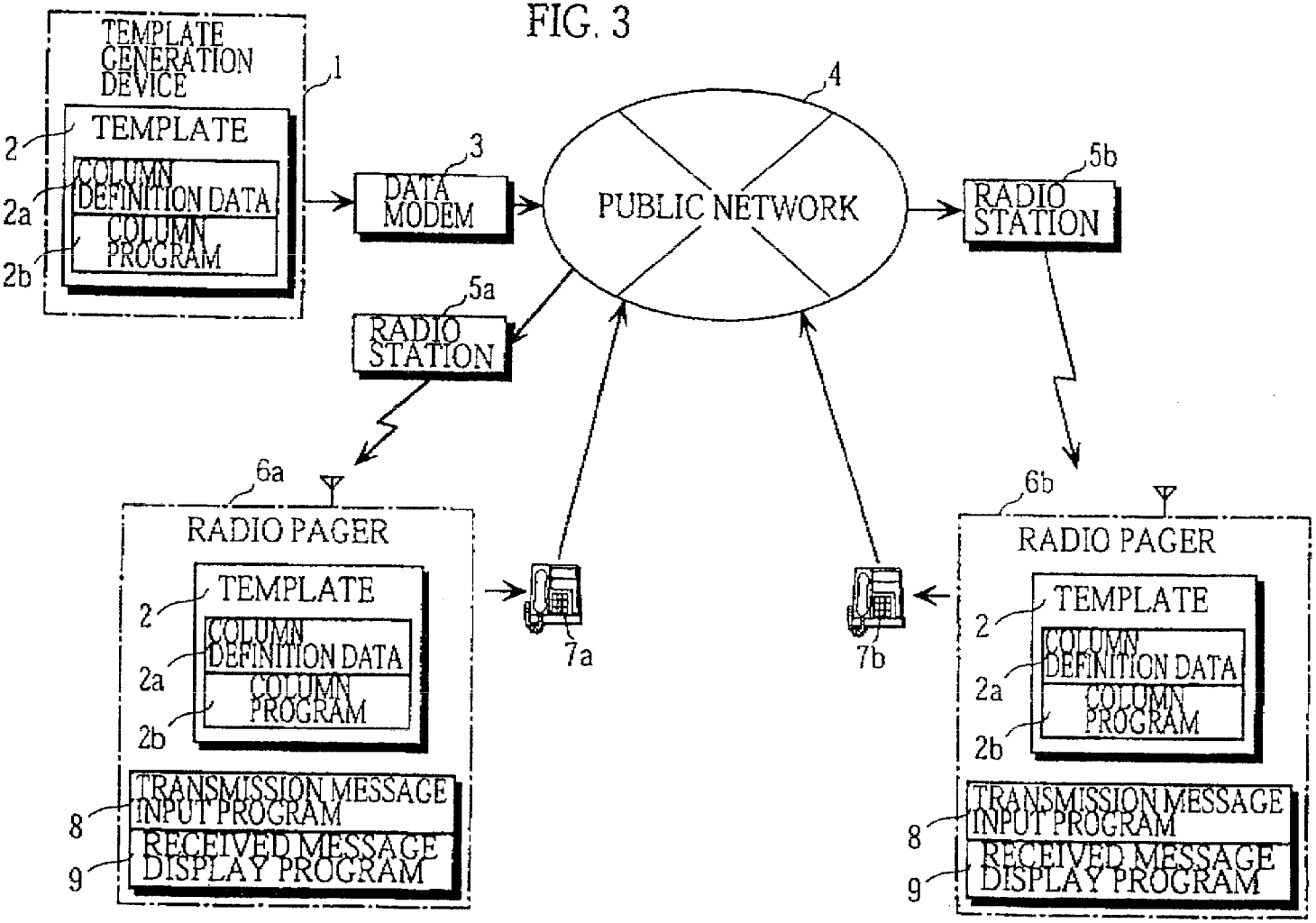
FIG. 3 is a block diagram showing an example of the general construction of the system that uses the radio pagers of the first embodiment of the present invention.

FIG. 3 is a block diagram showing an example of the general construction of a system that uses a radio pager of the first embodiment of the present invention. A template 2 generated in a template generation device 1 is transmitted to radio pagers 6*a* and 6*b* via a data modem 3, a public network 4, and radio stations 5*a* and 5*b*, respectively. Note that column definition information that includes column definition data (described later) and a column program (described later) which operates when displaying the column definition data is referred to as the template in the present embodiment.

The template generation device 1 is made up of a personal computer, a work station, and the like, and generates templates for various purposes (for example, a meeting template, a call template, and a stock price template).

The radio pagers 6*a* and 6*b* both store the template 2 which they commonly use for message transmission/reception. The template 2 includes column definition data 2*a* which defines a plurality of main elements (such as "person", "time", and "place") that compose a message, each element being a column, and a column program 2*b* which relates to the column definition data 2*a*. The column definition data 2*a* and the column program 2*b* for all columns defined by the column definition data 2*a* is included in the template 2 as a set. When a message is received, the column program 2*b* is used for adding accessory elements determined by the contents of each column to the contents of each column and detecting a preceding message which relates to the received message.

Thus, the template 2 is distributed to and commonly used by the radio pagers 6*a* and 6*b*, so that it is no longer necessary for each user to input each self-made message commonly in a predetermined number and memorize a list which associates each self-made message with the predetermined number as being conventionally done. Also, the template 2 can be obtained easily.

When transmitting the template 2 to the users by radio, a single transmission from the template generation device 1 is sufficient to send the template 2 to the plurality of radio pagers 6*a* and 6*b* by a multi-destination delivery service of the public network 4. Accordingly, transmission time and cost can be reduced, when compared with transmitting the template 2 to the radio pagers 6*a* and 6*b* separately.

The radio pagers 6*a* and 6*b* each store a transmission message input program 8 and a received message display program 9 in advance that are commonly used for various templates. The transmission message input program 8 is used for displaying a guidance with which the user inputs the contents of each column and for receiving the inputted contents of each column according to the column definition data 2*a* in the template 2. The received message display program 9 is used for combining execution results of the column program 2*b* and displaying the combination.

Here, a message is not an indivisible unit as in the prior art but can be seen as a combination of a plurality of elements. The message is a combination of a plurality of main elements (such as "person", "time", and "place") that compose the message and accessory elements (such as particles) of the main elements. The main elements tend to change according to factors such as different situations where the message is used, while the accessory elements are completely determined by the main elements. The main elements that compose the message also change according to the purpose of the message. Thus, it is necessary to determine each column of the column definition data 2*a* according to the purpose of the message and then make the column program 2*b* that is highly dependent on the column definition data 2*a*. Thus, the column definition data 2*a* and the column program 2*b* need to be handled as one unit.

On the other hand, the transmission message input program 8 and the received message display program 9 can be made as general-purpose programs that have low dependence on the column definition data 2*a*, since the input and the display of each column are possible once the contents of the column definition data 2*a* are set. Accordingly, the column definition data 2*a* and the column program 2*b* are treated as one unit in the template 2, and the template 2, the transmission message input program 8, and the received message display program 9 are treated as separate units.

Figure 4:
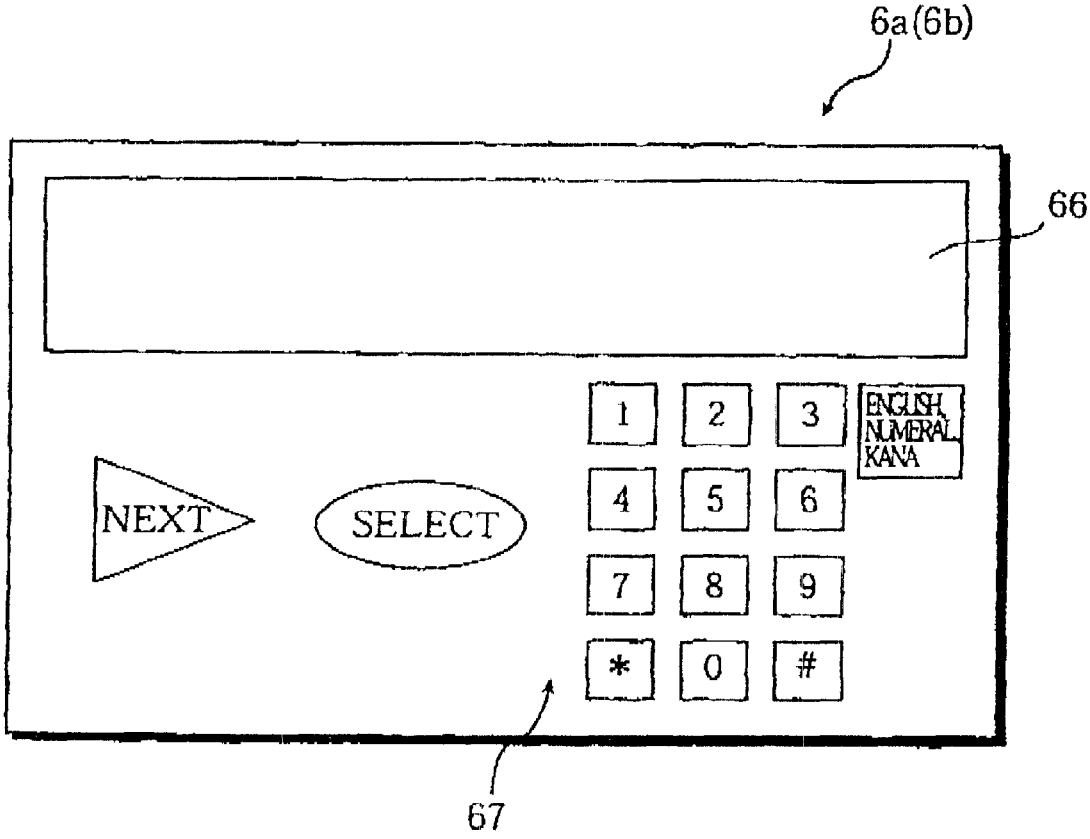
FIG. 4 shows a specific example of the appearance of the radio pagers shown in FIG. 3.
Figure 5:
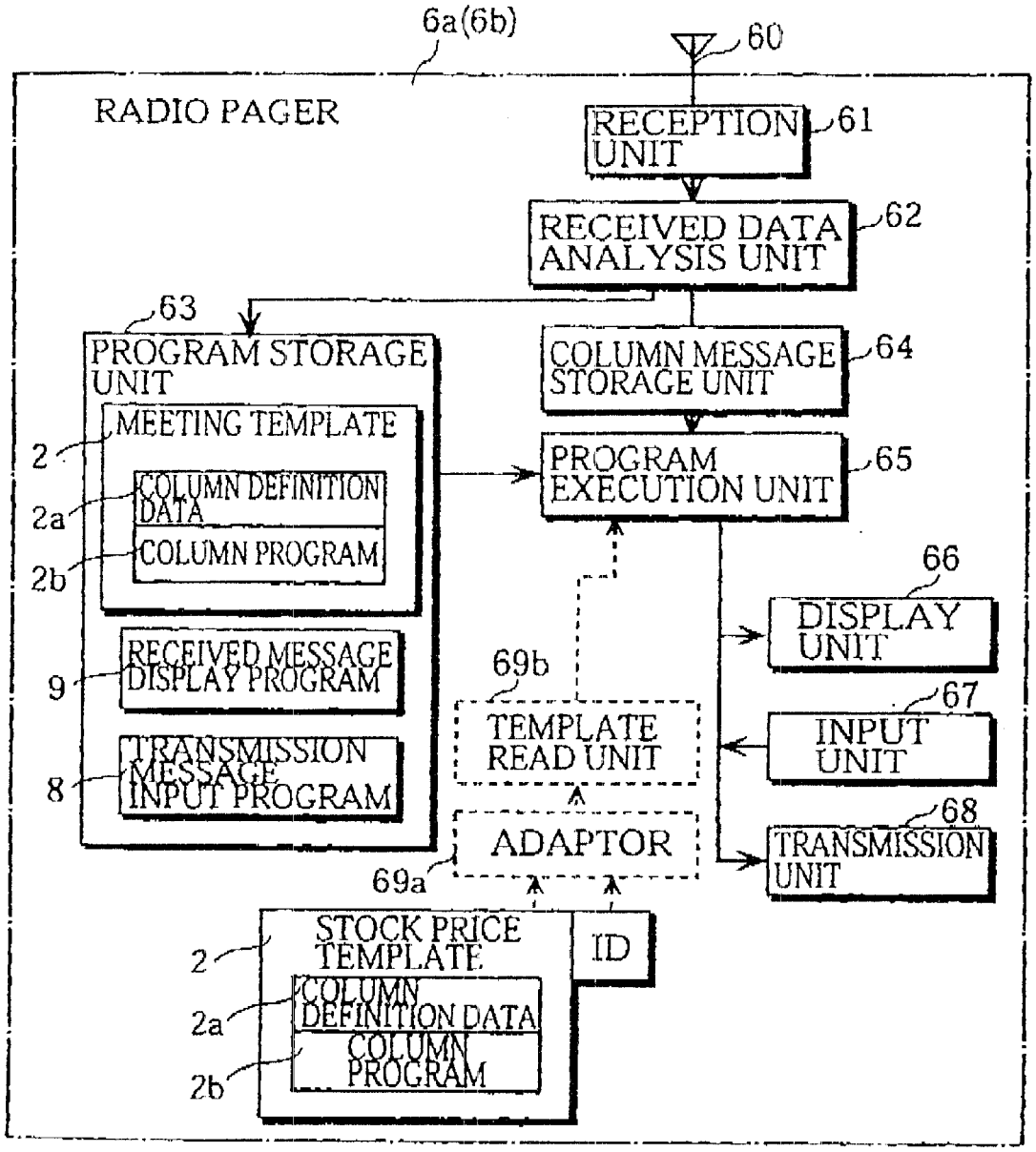
FIG. 5 is a block diagram showing a specific example of the internal construction of the radio pagers shown in FIG. 3.

FIG. 4 shows a specific example of the appearance of the radio pager 6*a* (6*b*) shown in FIG. 3. FIG. 5 shows a specific example of the internal construction of the radio pager 6*a* (6*b*) shown in FIG. 3. The following is an explanation of the construction of the radio pager 6*a* (6*b*) with reference to FIGS. 4 and 5.

As shown in FIGS. 4 and 5, the radio pagers 6*a* and 6*b* each include an antenna 60, a reception unit 61, a received data analysis unit 62, a program storage unit 63, a column message storage unit 64, a program execution unit 65, a display unit 66, an input unit 67, and a transmission unit 68.

The received data analysis unit 62 analyzes data which is received by the reception unit 61 via the antenna 60, classifies the received data either as the template 2 composed of the column definition data 2*a* and the column program 2*b*, or as other messages, and extracts them. The program storage unit 63 stores the column definition data 2*a* and the column program 2*b* of the template 2 extracted by the received data analysis unit 62. Note that the program storage unit 63 stores the transmission message input program 8 and the received message display program 9 in advance.

The column message storage unit 64 stores the other messages which are extracted by the received data analysis unit 62. The column message storage unit 64 can also store messages inputted via the input unit 67, as well as transmission information and confirmation information that are described later. When transmitting a message, the program execution unit 65 executes the transmission message input program 8 stored in the program storage unit 63. When receiving a message, the program execution unit 65 successibly executes the column program 2*b* and the received message display program 9.

As shown in FIG. 4, the input unit 67 has numeral keys "1"–"0", keys "*" and "#", an input mode switch key, a NEXT key, and a SELECT key, with which a transmission message can be inputted. It should be noted here that the radio pager 6*a* (6*b*) cannot have a large operation unit due to its portability. Accordingly, the input mode switch key is used to switch the input mode so as to accommodate the numeral keys to not only the input of numbers but also the input of the alphabet and Japanese kana.

For instance, when the Japanese kana input mode is set by the input mode switch key, "ア", "イ", "ウ", "エ", and "オ" can be inputted respectively by pressing the numeral key "1" once, twice, three, four, and five times. Equally, other kana letters "カ"–"ン" can be inputted by pressing the other numeral keys as the key "1" by appropriate times. The input of large and small letters can be switched by pressing "#" in the Japanese kana input mode.

When the alphabet input mode is set by the input mode switch key, "A", "B", and "C" can be inputted respectively by pressing the numeral key "1" once, twice, and three times. Equally, other alphabet letters "D"–"Z" can be inputted by pressing the other numeral keys as the key "1" by appropriate times. The input of the capital and small letters can be switched by pressing "#" in the alphabet input mode.

The display unit 66 displays a guidance for each column, an input message, a received message, and the like. The transmission unit 68 transmits the input message and other data by tone signals.

Figure 6:
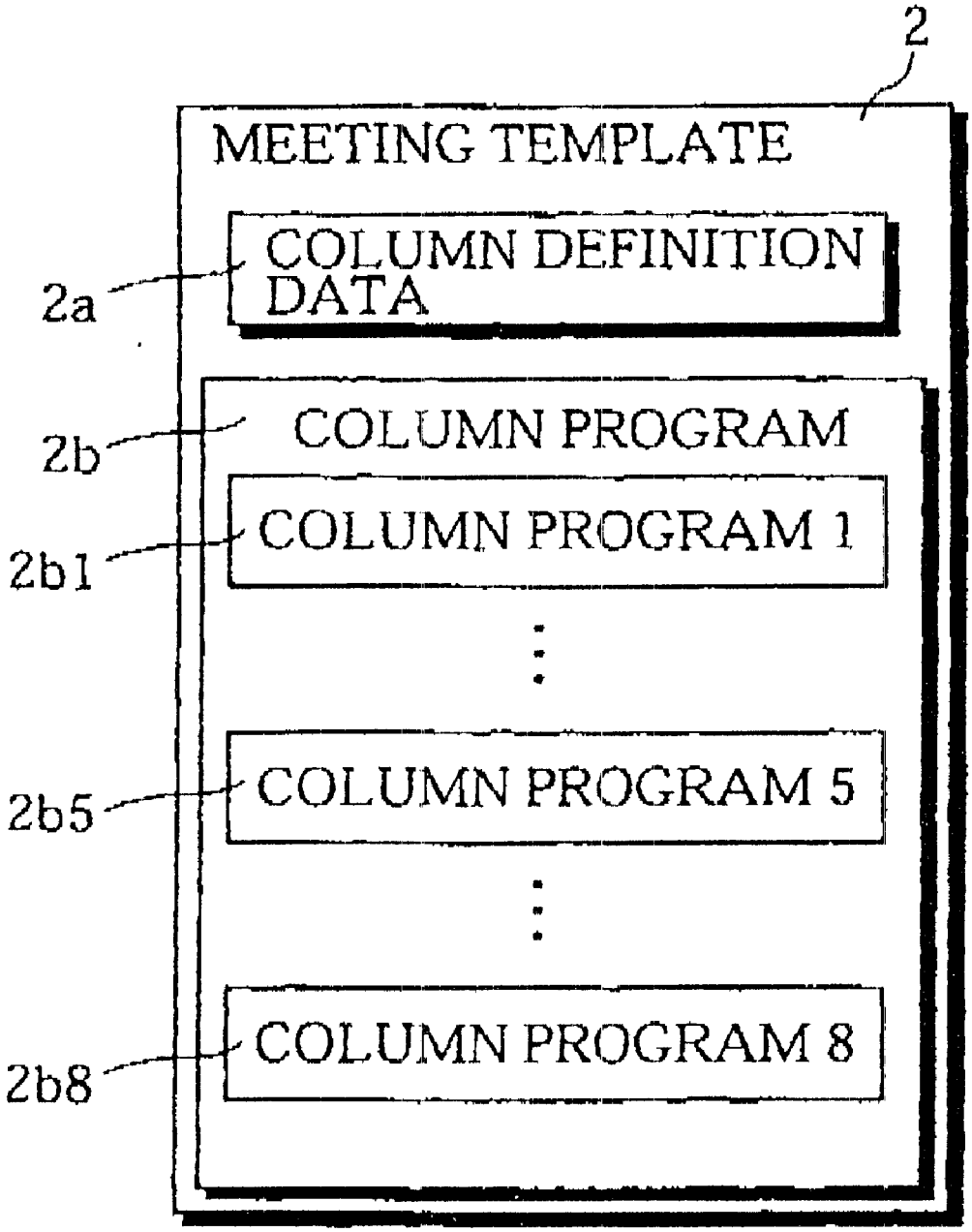
FIG. 6 shows the construction of the meeting template.

The following is an explanation of the template 2 using a meeting arrangement example. FIG. 6 shows the construction of a meeting template 2. The meeting template 2 includes the column definition data 2*a* (see FIG. 7) determined by the purpose, the purpose here being the meeting arrangement, and the column program 2*b*. The column program 2*b* includes a plurality of column programs 2*b*1–2*b*8 (see FIG. 13) that each correspond to a column defined in the column definition data 2*a*.

FIG. 7 shows an example of the construction of the column definition data 2*a* in the meeting template 2. FIG. 7A shows the definition of the column definition data 2*a* in the C program, while FIG. 7B shows the format construction of the column definition data 2*a*. A message generally concerns "when", "who", "where", "why", "what", and "how" (that is, 5W1H). Accordingly, main elements of a meeting arrangement message are "person", "time", "place", "event", and "need of reply".

Hence the column definition data 2*a* in the meeting template 2 includes a person column 2*a*4, a time column 2*a*5, a place column 2*a*6, an event column 2*a*7, and a reply column 2*a*8, as shown in FIG. 7.

The contents of the person column 2*a*4 show a subject or a person, such as a transmitter of a message. The contents of the time column 2*a*5 show time, such as a meeting time. The contents of the place column 2*a*6 show a place, such as a meeting place. The contents of the event column 2*a*7 show an event, such as a new year party, a year-end party, and an ending party. The contents of the reply column 2*a*8 show the need or no need of replying to the message.

In meeting arrangement, a transmitter of the first message needs to determine all elements that are "person", "time", "place", "event", and "need of reply". However, transmission can be made more easily when retransmitting the message that has been partially changed or when replying to the first message, since the part other than the changed part of the first message can be reused if it is clear how the message to be sent relates to the first message. Accordingly, the column definition data 2*a* includes an identifier column 2*a*1, a template name column 2*a*2, and a secret word column 2*a*3 in order to clearly show the relation to preceding messages.

The contents of the identifier column 2*a*1 show whether the message is a new or difference message. The contents of the template name column 2*a*2 show a type of the template 2 that is used for transmission/reception of the message. The contents of the secret word column 2*a*3 show a name of a group or the like that transmits/receives the message using the template 2. When there are a plurality of messages that are made using the same template, the secret word column 2a3 shows an identifier for distinguishing each message.

Figure 9:
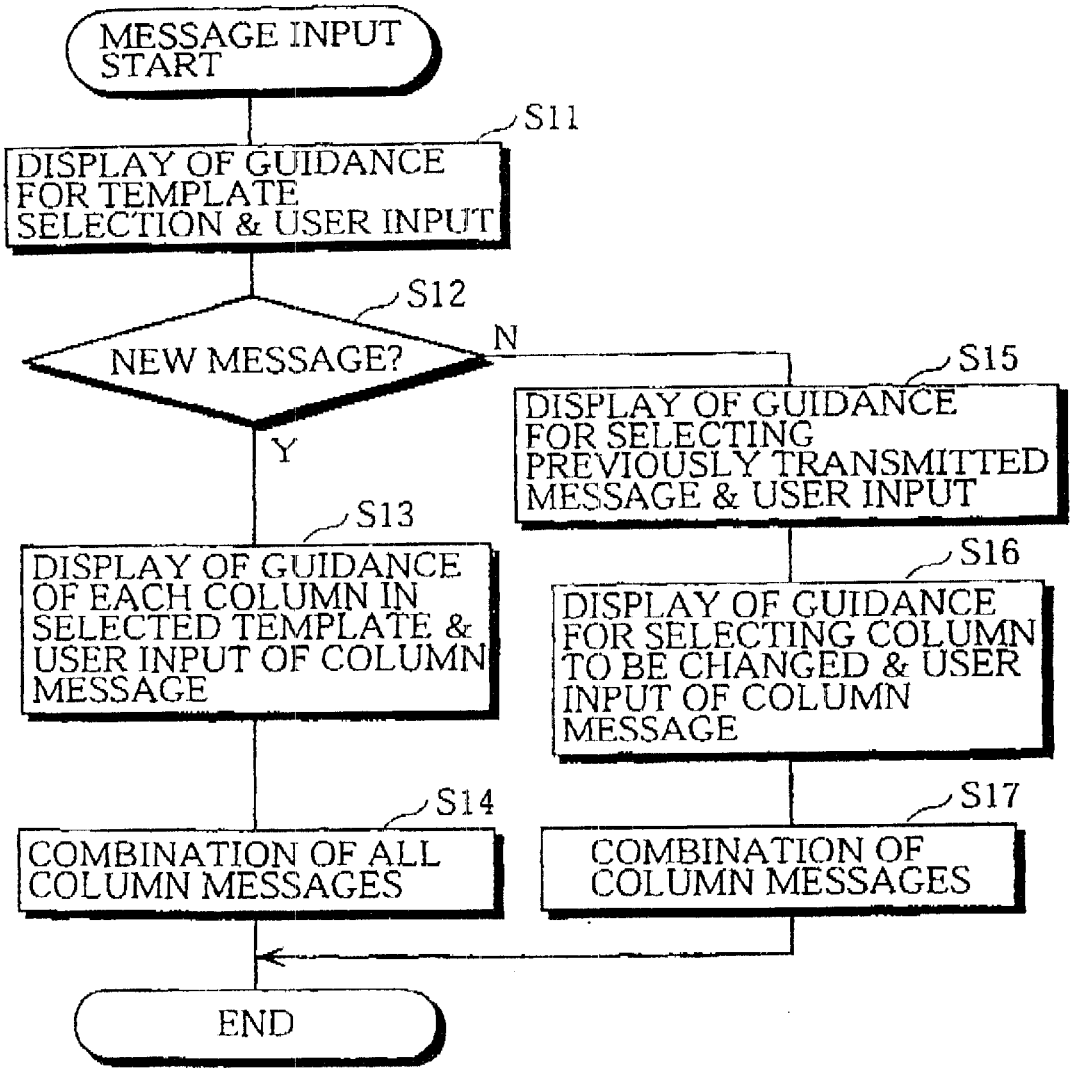
FIG. 9 is a flowchart showing the execution of the transmission message input program by the program execution unit.
Figures 10A, 10B, 10C, 10D, 10E, 10F, 10G, 10H, 10I:
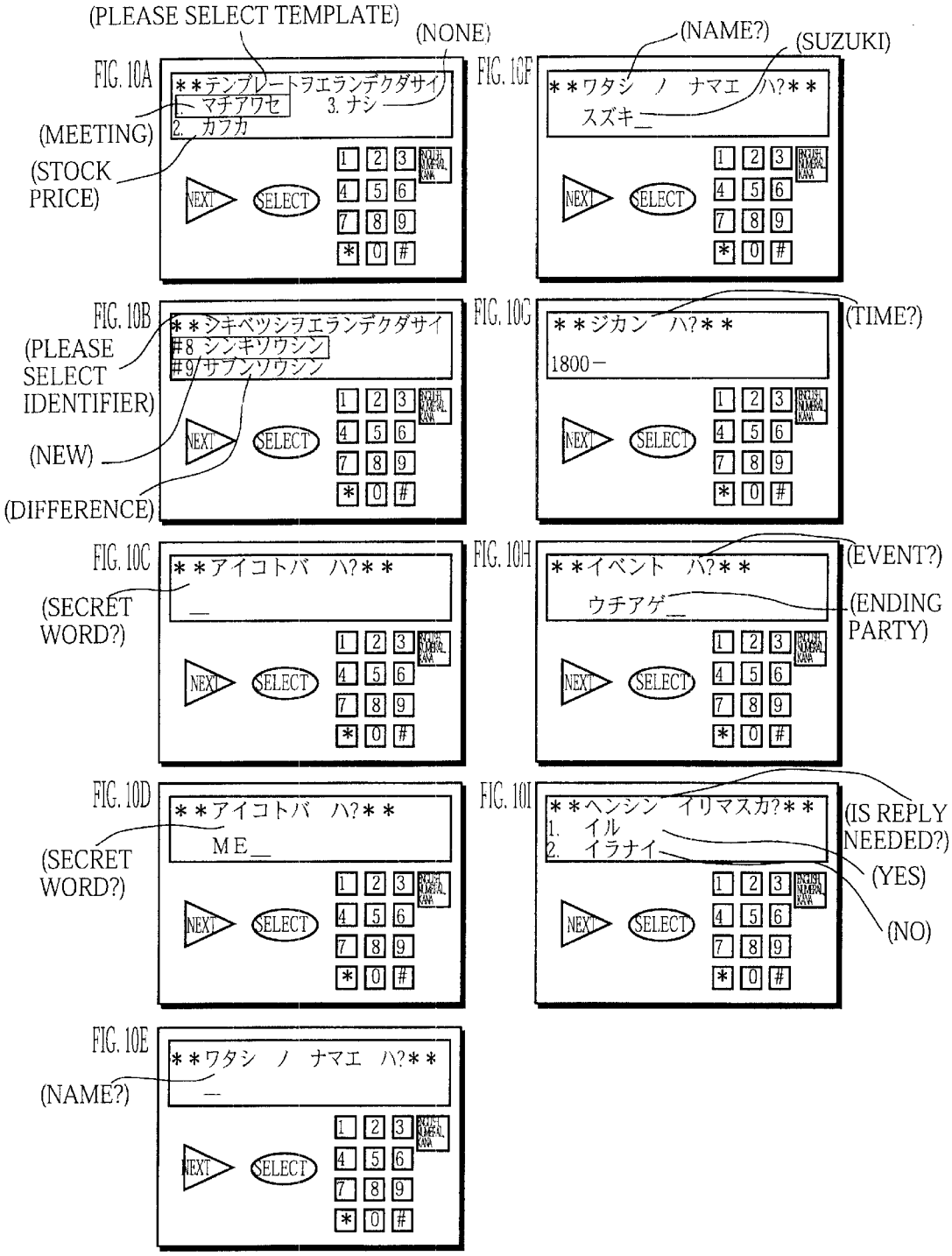
FIGS. 10A–10I show display examples of the display unit.

The transmission message input processing is explained next. FIGS. 8A and 8B show examples of the transmission message input program 8 shown in FIG. 3. FIG. 8A shows the general construction of the program, while FIG. 8B shows the specific program. FIG. 9 is a flowchart when the program execution unit 65 executes the transmission message input program 8. FIG. 10 shows display examples of the display unit 66.

The transmission message input program 8 generally includes a new message transmission program 8α and a difference message transmission program 8β. When an input trigger is made by the user, the transmission message input program 8 is activated by the program execution unit 65 and returns an input string as return values.

On activating the transmission message input program 8, the program execution unit 65 has the display unit 66 display a guidance for selecting a template to be used (see FIG. 10A), selects the template to be used according to the number inputted in the input unit 67 by the user (Step S11), and returns the selected template name. The program execution unit 65 then has the display unit 66 display a guidance for selecting whether a message to be transmitted is new or not (see FIG. 10B), judges whether it is the new message transmission according to the number inputted in the input unit 67 by the user (Step S12), and returns the selected identifier.

Figure 11:
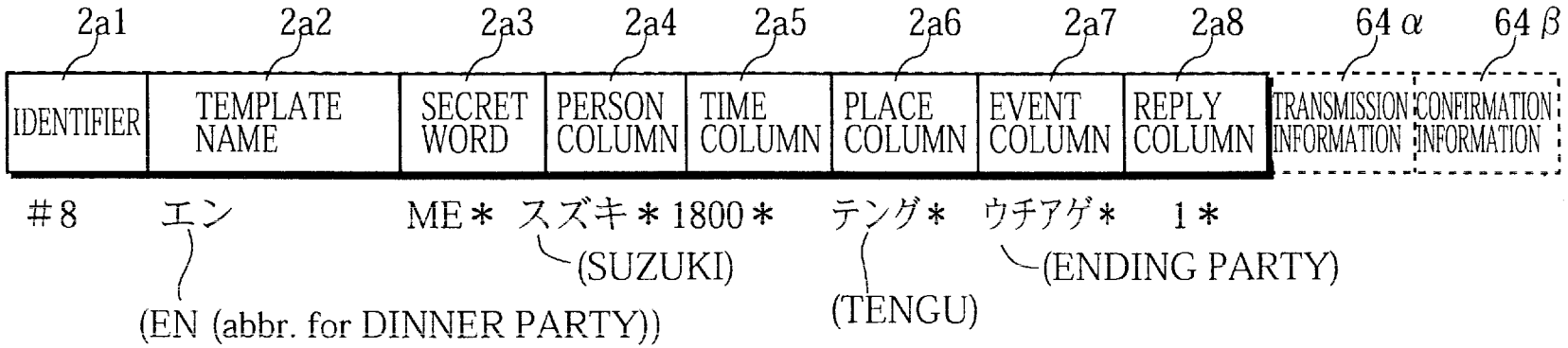
FIG. 11 shows an example of a message when a new column message is inputted in each column.

When the user selects to transmit a new message, the program execution unit 65 activates the new message transmission program 8α to execute Steps S13 and S14 and completes the program. More specifically, the program execution unit 65 obtains the number of columns of the column definition data 2a in the template 2 according to the new message transmission program 8α, obtains the meaning of each column, displays the meaning (see FIGS. 10C–10I), and waits for the user input. Here, the program execution unit 65 has the display unit 66 display a guidance of each column and waits until the user inputs the contents of each column. When the contents of all columns are inputted by the user, the contents that are input codes are combined to form an input string according to the new message transmission program 8α. By repeating this operation, a new message to be transmitted "#8エンME*スズキ*1800*テング*ウチアゲ*1*" is generated as shown in FIG. 11. Thus, the user can input/make the new message to be transmitted while understanding what to input without difficulty.

FIG. 11 shows an example when a new column message is inputted in the columns of the meeting template. The contents "#8" of the identifier column 2a1 indicate that the message is new. The contents "エン" of the template name column 2a2 indicate a meeting at a dinner party. The contents "ME*" of the secret word column 2a3 indicate a company name or the like. The contents "スズキ*" of the person column 2a4 indicate that the transmitter's name is Suzuki. The contents "1800*" of the time column 2a5 indicate that the dinner party starts at 18:00. The contents "テング*" of the place column 2a6 indicate that the dinner party is held at Tengu. The contents "ウチアゲ*" of the event column 2a7 indicate that the dinner party is for an ending party. The contents "1*" of the reply column 2a8 indicate the need of reply.

Note that the numeral keys are used to input the above numbers, Japanese katakanas, and alphabets, the NEXT key is used to move the pointer on the template selection display in the display unit 66, and the SELECT key is used to determine the selected template and other items.

Since the person column 2a4 to the reply column 2a8 and the secret word column 2a3 have a variable data length, the terminal symbol "*" is added to data of each column, while the terminal symbol is not added to data of the identifier column 2a1 and the template name column 2a2 that have a fixed data length.

When a column message is transmitted, the column message storage unit 64 stores the column message and transmission information 64α which is added to the column message for indicating that the column message has been transmitted. In the radio pager 6a (6b), a transmission message may be created and stored in advance in the column message storage unit 64 for later transmission. Hence the transmission information 64α is used as a flag for specifying whether the message has been transmitted. When the transmission information flag shows "1", for instance, the column message has been transmitted to a receiver. When the transmission information flag shows "0", on the other hand, the column message has not been transmitted yet. That is to say, the receiver has already received the column message when the flag shows "1", so that it is possible to transmit/receive a difference message that includes only the changed part of the transmitted original column message while reusing the unchanged part of the original message.

Concerning a storage form of column messages, each column of a column message may be stored separately or successively as long as the column message can be extracted as a unit.

Figure 12:
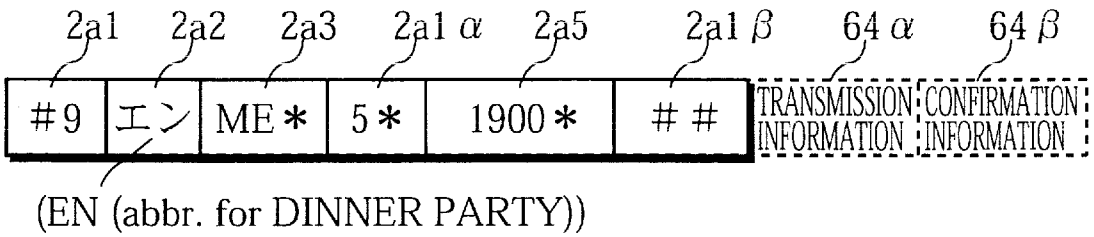
FIG. 12 shows a difference message for changing the time set in the message shown in FIG. 11.

When the user selects to transmit a difference message in Step S12 in FIG. 9, the program execution unit 65 activates the difference message transmission program 8β to execute Steps S15–S17 and then completes the program. More specifically, on activating the difference message transmission program 8β, the program execution unit 65 waits until the user selects one of messages which have been transmitted between the user and the receiver of the difference message (Step S15). When the user selects one message (such as the message shown in FIG. 11), the program execution unit 65 waits until the user inputs a column number of the contents to be changed according to the difference message transmission program 8β. When the user selects the column number, the program execution unit 65 obtains the meaning of the column of the selected number, displays the meaning, and waits for the user input. Here, the program execution unit 65 has the display unit 66 display a guidance of the column whose contents are to be changed and waits until the user inputs the new contents of the column (Step S16). When the user inputs the contents, the program execution unit 65 combines the contents that are input codes to form an input string according to the difference message transmission program 8β (Step S17). As a result, the difference message is made that includes the contents of the columns 2a1–2a3 as parameters for selecting the preceding message that is the basis of the difference message, the contents of a column 2a1α that show the changed part, and the changed contents of the column 2a5 as shown in FIG. 12. Thus, the user can input/make the difference message to be transmitted while understanding what to input without difficulty.

FIG. 12 shows the difference message for changing the time in the message shown in FIG. 11. The contents "#9" of the identifier column 2a1 indicate that the message is a difference message. The contents "エン" of the template name column 2a2 indicate that the template for meeting at a dinner party is used. The contents "ME*" of the secret word column 2a3 indicate the company name. The contents "*5" of the column 2a1α indicate that the column to be changed by the key input is the fifth column that is the time column 2a5. The contents "1900" of the time column 2a5 indicate that the time is changed to 19:00. The contents "##" of a column 2a1β is a terminal signal 93 that shows the end of the difference message. Note that the columns 2a1α and 2a1β are generated when the contents "#9" which indicates the difference message are inputted in the column 2a1.

The radio pagers described above can also be used in the same way as the prior art, since messages can be inputted using free words as in the conventional way if the template 2 is not specified.

With the present embodiment, a change message is created by specifying a part and its contents to be changed in a preceding message stored in the column message storage unit 64 according to the user operation. Accordingly, it is sufficient to input the changed contents, that is, the difference, so that the message input and transmission can be performed easily. It is unnecessary to transmit data other than the difference with the preceding message, so that a needless repetition of message transmission can be avoided.

Also, by storing the column definition data that defines the columns which compose the main part of a message and storing the contents of each column of preceding messages, the part to be changed can easily be specified.

Also, when the user specifies the part and its contents to be changed, a guidance for the user operation is displayed for each column. Accordingly, the difference with the preceding message can easily be inputted.

Also, the transmission information 64α is added to each preceding message stored in the column message storage unit 64 so as to indicate whether the receiver of a difference message has a corresponding preceding message. Accordingly, it is possible to create messages beforehand and to confirm that the receiver certainly has the preceding message from which the difference message is originated.

Figure 14:
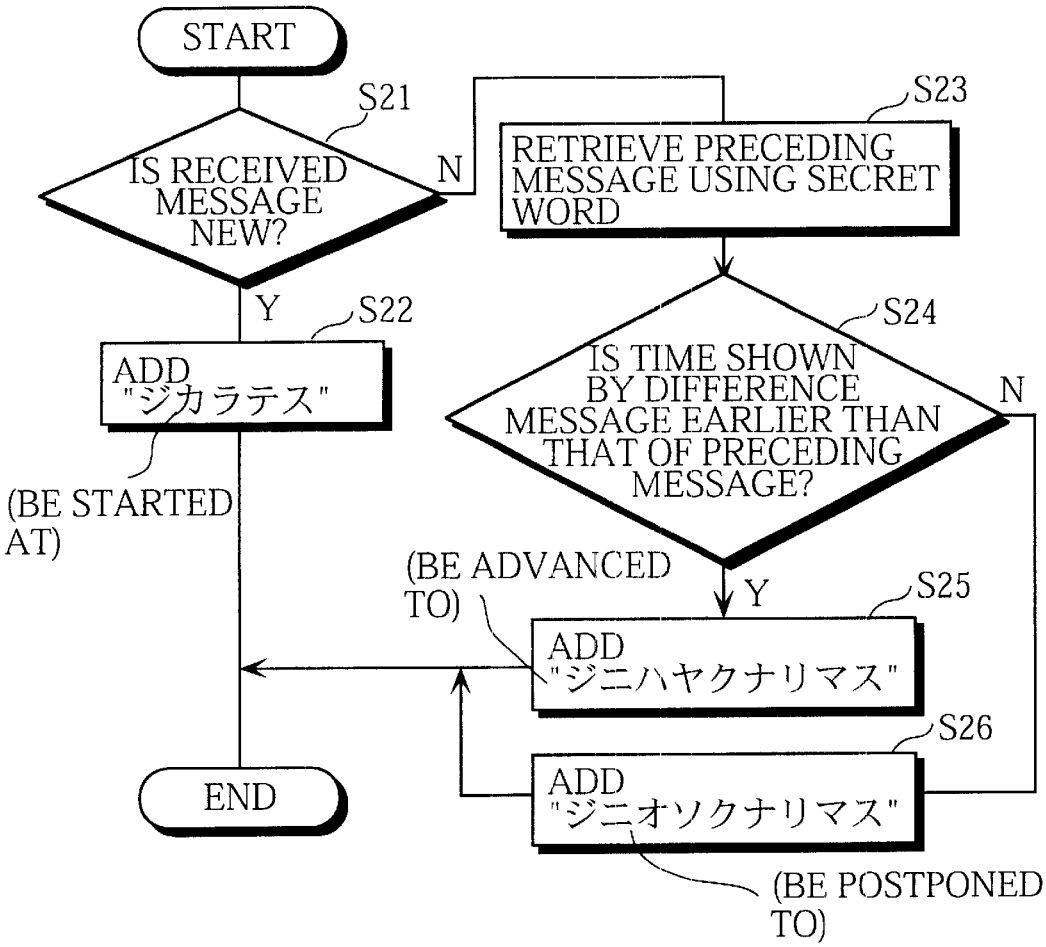
FIG. 14 is a flowchart when the program execution unit executes the column program shown in FIG. 13.

The following is an explanation of the message reception. FIG. 13 shows an example of the column program 2b shown in FIG. 3. FIG. 13A shows the general construction of the program, while FIG. 13B partially shows the definition in the C program. The code ① in FIG. 13B partially shows a column program 2b1 that corresponds to the identifier column 2a1 of a received message, while the code ⑤ partially shows a column program 2b5 that corresponds to the time column 2a5 of the received message. FIG. 14 is a flowchart when the program execution unit 65 executes the column program 2b shown in FIG. 13.

The column program 2b includes a plurality of column programs 2b1–2b8 that respectively correspond to the identifier column 2a1 to the reply column 2a8 in the column definition data 2a. The column programs 2b1–2b8 each has new and difference message versions. When a message is received, the column program 2b is activated by the program execution unit 65.

First, the program execution unit 65 executes the column program 2b1 in the column program 2b to check the contents of the identifier column 2a1 of the received message and to judge whether the message is a new or difference message according to whether the identifier is "#8" or "#9" (Step S21; see FIGS. 11 and 12). When the message is new, the program execution unit 65 proceeds to Step S22 and successively executes the column programs 2b4–2b8. For example, when executing the column program 2b5, "ジカラデス" (BE STARTED AT) is added to the contents "1900" of the time column of the received message to make a display message. The program execution unit 65 then completes the program. As a result, the display message "テング デノ ウチアゲ ハ 1800 ジカラデス スズキヨリ ヨウヘンシン" (THE ENDING PARTY AT TENGU IS STARTED AT 18:00. SENDER: SUZUKI. REPLY NEEDED) is generated from the received message "#8エンME*スズキ*1800*テング*ウチアゲ*1*". Note that the particles "デノ", "ハ", "ジカラデス", and "ヨリ" in the display message are accessory message elements which are added according to the column program 2b.

When the received message is a difference message, the program execution unit 65 proceeds to Step S23 and retrieves a corresponding preceding message by referring to the contents of the template name column 2a2 and the secret word column 2a3 of the received difference message as parameters. The program execution unit 65 then successively executes the column programs 2b4–2b8. For example, when executing the column program 2b5, the contents of the time columns 2a5 of the preceding message and the difference message are compared to judge whether the time in the time column 2a5 of the difference message is earlier than the time in the time column 2a5 of the preceding message (Step S24).

When the time of the difference message is earlier than that of the preceding message as a result of the comparison in Step S24, the program execution unit 65 adds "ジニ ハヤクナリマス" (BE ADVANCED TO) to the contents of the time column of the difference message to make a display message and completes the program (Step S25). On the other hand, when the time of the difference message is later than that of the preceding message, the program execution unit 65 adds "ジニ ハヤクナリマス" (BE POSTPONED TO) to the contents of the time column of the difference message to make a display message and completes the program (Step S26).

Accordingly, when receiving the difference message "#9エンME*5*1900*##" after the message "#8エンME*スズキ1800*テング*ウチアゲ*1*" was received, the display message "テング デノ ウチアゲ ハ1900テング デノ ウチアゲ ハ" (THE ENDING PARTY AT TENGU IS POSTPONED TO 19:00. SENDER: SUZUKI. DIFFERENCE) is generated from the above difference message. Note that the particles "デノ", "ハ", "ジカラデス", "ヨリ" in the display message are accessory message elements which are added according to the column program 2b.

When storing a new or difference column message received from a transmitter into the column message storage unit 64, a flag "1" is set in the transmission information 64α in the received column message. By doing so, it shows that the transmitter has the column message, so that the user can reuse an unchanged part of the column message.

The column program 2b5 which corresponds to the time column 2a5 may often be used in other templates. Such a column program that is likely to be used in the other templates can be shared by each column program 2b by adding information such as a template name to that column program and storing it in the received message display program 9, rather than each template separately having the column program.

Figure 16:
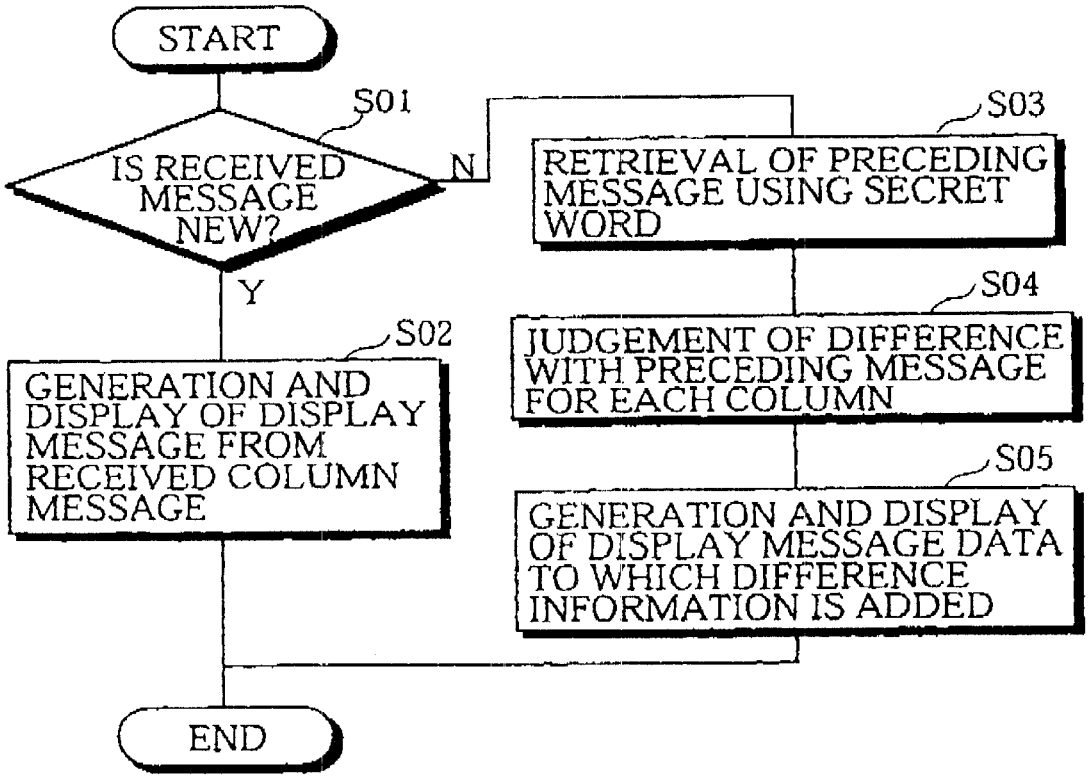
FIG. 16 is a flowchart when the program execution unit executes the received message display program shown in FIG. 15.

The message display is explained next. FIG. 15 shows an example of the received message display program 9 shown in FIG. 3. FIG. 15A shows the general construction of the program, while FIG. 15B partially shows the definition in the C program. FIG. 16 is a flowchart showing the execution of the received message display program 9 in FIG. 15 by the program execution unit 65.

The received message display program 9 has new and difference message versions. When a message is received, the received message display program 9 is activated by the program execution unit 65. On receiving the message, the program execution unit 65 first activates the received message display program 9 and refers to the contents of the identifier column 2*a* in the received message to judge whether the received message is new (Step S01).

When the received message is judged to be new in Step S01, the program execution unit 65 generates a display message using the received new message, displays the display message, and completes the program (Step S02). Here, the program execution unit 65 obtains the number of columns included in the received new message, arranges each display message element obtained as a result of the execution of the column program 2*b* in a display order, and combines each display message element to display the display message.

Figure 17:
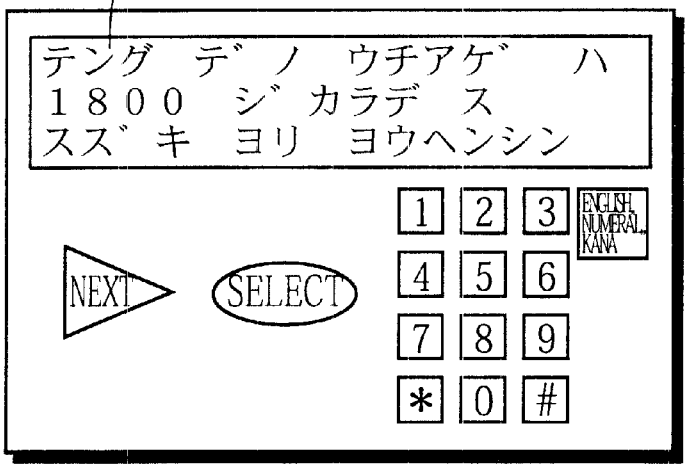
FIG. 17 shows an example of a message displayed by the display unit when the message shown in FIG. 11 is received.

Consequently, when receiving the message shown in FIG. 11, the display unit 66 displays the display message "テング デノ ウチアゲ ハ1800ジカラデス スズキヨリ ヨウヘンシン" that is easier to understand than the received message "#8エンME*スズキ*1800*テング*ウチアゲ*1*", as shown in FIG. 17. "テング デノ ウチアゲ ハ" is displayed in order to clearly show that the transmitter of the message requires the user's reply.

When the received message is judged to be a difference message in Step S01, the program execution unit 65 retrieves a corresponding preceding message using a secret word included in the received difference message (Step S03). The program execution unit 65 then performs comparisons, substitutions, and computations on each column of the preceding message and the difference message to judge what is different from the preceding message (Step S04), creates a display message that includes difference information, and completes the received message display program 9 (Step S05). Thus, when receiving a difference message, the program execution unit 65 obtains a secret word of the difference message and retrieves a corresponding preceding message using the secret word. The program execution unit 65 then obtains the number of columns in the preceding message, arranges display message elements obtained by executing the column program 2*b* in a display order, and combines the display message elements to display a display message.

Figure 18:
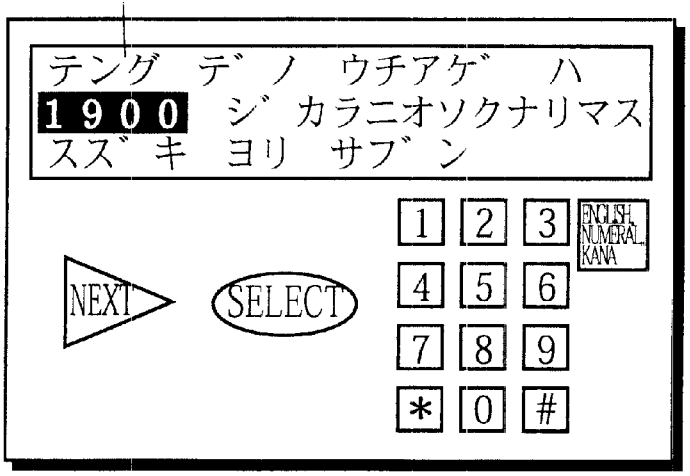
FIG. 18 shows an example of a message displayed by the display unit when the difference message shown in FIG. 12 is received.

Consequently, when receiving the message shown in FIG. 12, the display unit 66 displays "オソクナリマス" so that the user can easily understand that the meeting time shown in the preceding message has been postponed by the difference message, as shown in FIG. 18. "サブン" is displayed to show that the message is the difference message, while the changed time "1900" is highlighted to make it easy to understand that the meeting time has been changed.

When the radio pager does not have a template that corresponds to a received message, the received message is directly displayed in the display unit 66 with the display informing that the pager does not have the corresponding template.

With the present embodiment, when receiving a change message which shows a changed part and its contents in respect to a preceding message stored in the column message storage unit 64, a display message is created from the preceding message and the changed part of the received message. Accordingly, a whole message in which the unchanged part of the preceding message is combined with the changed part of the received message is displayed, so that the user can easily understand the message.

Also, by storing the column definition data 2*a* that defines the columns which compose the main part of a message and storing the contents of each column of preceding messages, a display message can be created according to the definition of each column, thus making the message easier to understand. Also, by displaying the message as sentences by combining the contents of the columns and respective accessory message elements in the display unit 66, the message can be easily understood.

Also, when the program execution unit 65 executes the column program 2*b* and makes a display message, the difference from the preceding message to the difference message in the column to be changed are taken into consideration. Accordingly, the display message is created in accordance with the difference so as to be easily understood.

The following is an explanation of the case when transmitting a reply message in response to the display message in FIG. 17 which is displayed on receiving the message shown in FIG. 11. A radio pager of the transmitter of the reply message has a preceding message that is the basis of the reply message. Thus, it is easier to make a difference message by partially changing the preceding message rather than making a whole message again. Hence the case when the reply message is inputted as the difference message is explained below.

Figure 19:
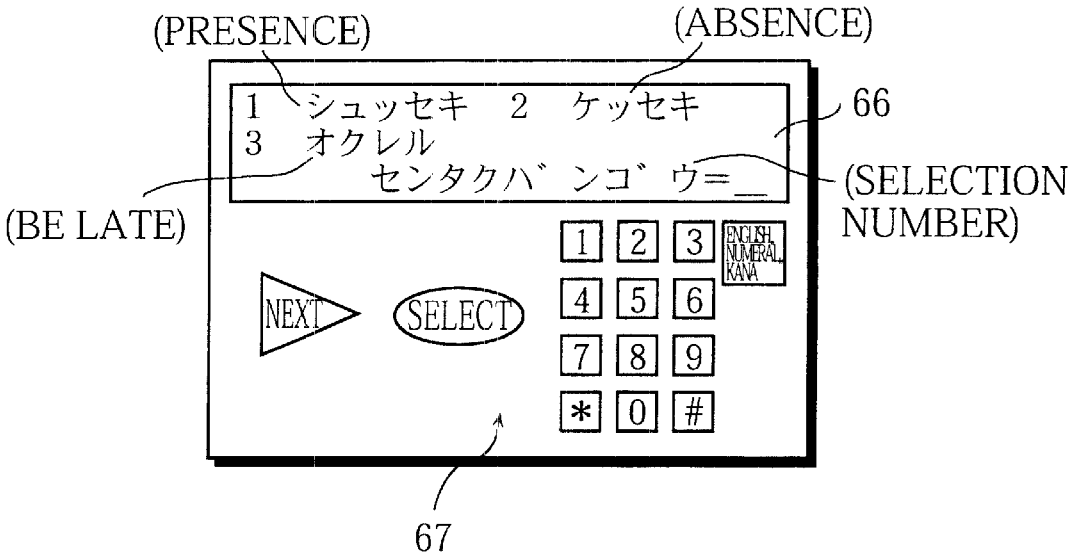
FIG. 19 shows an example of a guidance display when inputting a difference reply message.
Figure 20:
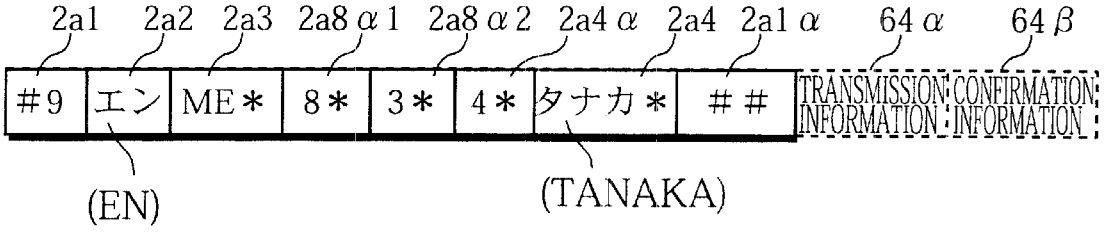
FIG. 20 shows the difference reply message to be transmitted and received.
Figure 21:
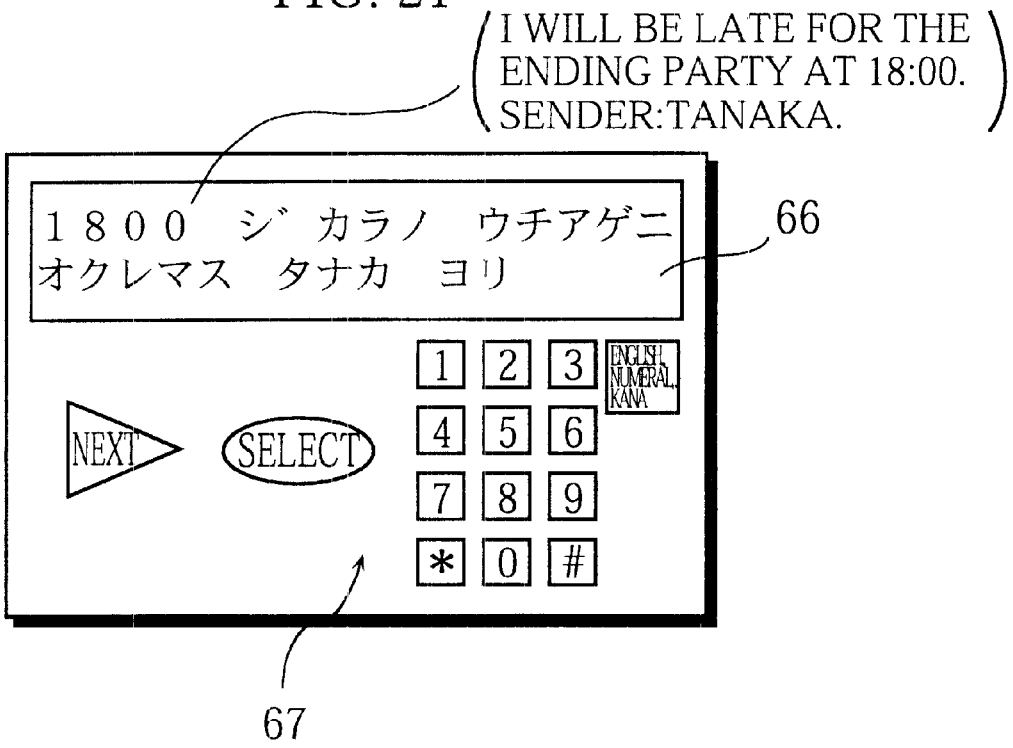
FIG. 21 shows a message displayed when receiving the reply message.

FIG. 19 shows an example of a guidance display for inputting the reply message as the difference. FIG. 20 shows the difference reply message to be transmitted/received. FIG. 21 shows a message displayed when receiving the reply message.

On receiving the message shown in FIG. 11, the program execution unit 65 activates the transmission message input program 8 and obtains the contents of the columns 2*a*1–2*a*8 of the received message. Since the reply column 2*a*8 of the received message has the contents "1*" indicating the need of reply, a guidance such as "サブンヘンシン" is displayed in the display unit 66. The transmitter of the reply message selects "サブンヘンシン" by operating the input unit 67. As a result, the program execution unit 65 obtains the contents of the columns 2*a*1–2*a*3 and 2*a*8α1 "#9", "エン", "ME*", and "8*" as return values and has the to display unit 66 display guidances for inputting information such as attendance at or absence from the dinner party. When the transmitter selects the selection number "3" indicating "オクレル" (BE LATE), the program execution unit 65 obtains "3*" as return values. Also, since the transmitter of the reply message is different from the transmitter "スズキ" of the message shown in FIG. 11, the program execution unit 65 displays the guidance shown in FIG. 10E. The transmitter of the reply message inputs his or her name "タナカ" (TANAKA) in the input unit 67. The program execution unit thus obtains "3*", "4*", "タナカ", and "##" as return values of the columns 2*a*8α2, 2*a*4α, 2*a*4, and 2*a*1α. As a result, the reply message shown in FIG. 20 is generated.

In FIG. 20, the contents "#9" of the identifier column 2*a*1 indicate that the reply message is a difference message. The contents "エン" of the template name column 2*a*2 indicate a meeting at a dinner party. The contents "ME*" of the secret word column 2*a*3 indicate a company name. The contents "8*" of the column 2*a*8α1 indicate that the reply is in response to the contents "1*" of the reply column 2a8 that require the reply. The contents "3*" of the column 2a8α2 indicate the selection number "3" for "オクレル" shown in FIG. 19. The contents "4*" of the column 2a4α indicate that the part to be changed is the fourth column, that is, the person column 2a4. The contents "タナカ*" of the person column 2a4 indicate the changed contents. The contents "##" of the column 2a1α is a terminal signal of the difference message.

Note that the column 2a8α1 is automatically set when replying to a reply requirement. The column 2a8α2 is automatically set when the part to be changed is specified. The column 2a1α is automatically set when creating a difference message.

When another radio pager receives the reply message shown in FIG. 20, the program execution unit 65 in the radio pager executes the column program 2b to obtain the contents of the column 2a1–2a4, 2a8α1, 2a8α2, and 2a1α of the message shown in FIG. 20. Since the contents "#9" of the column 2a1 indicates the difference and the contents "1*" of the reply column 2a8 indicates the need of reply, the program execution unit 65 retrieves the preceding message shown in FIG. 11 by referring to the contents of the columns 2a2 and 2a3. The program execution unit 65 uses the preceding message and the reply message to make a display message that contains the contents of columns, such as the time and event columns, which are not included in the reply message. The program execution unit 65 then activates the received message display program 9 and has the display unit 66 display the display message "1800ジカラノウチアゲニオクレマスタナカヨリ" (I WILL BE LATE FOR THE ENDING PARTY AT 18:00. SENDER: TANAKA) as shown in FIG. 21.

With the present embodiment, in response to a reply requirement, the user specifies a part and its contents to be changed in the preceding message stored in the column message storage unit 64 in order to make a change message. Accordingly, it is sufficient to input the changed contents, that is, the difference with the preceding message, so that the message input and transmission can be performed easily. Also, since it is unnecessary to transmit data other than the difference with the preceding message, a needless repetition of message transmission can be avoided.

Also, by storing the column definition data that defines the columns which compose the main part of a message and storing the contents of each column of preceding messages, the part to be changed can easily be specified.

Also, when the user specifies the part and its contents to be changed, a guidance for the user operation is displayed for each column. Accordingly, the difference with the preceding message can easily be inputted.

Also, the transmission information 64α is added to each preceding message stored in the column message storage unit 64 so as to indicate whether the receiver of a difference message has a corresponding preceding message. Accordingly, it is possible to create messages beforehand and to confirm that the receiver certainly has the preceding message from which the difference message is originated.

Also, when receiving a reply message as a difference message, a display message is created from the preceding message and the changed part and its contents shown in the received reply message. Accordingly, a whole message in which the unchanged part of the preceding message is combined with the changed part of the received message is displayed, so that the user can easily understand the message.

Also, by storing the column definition data 2a that defines the columns which compose the main part of a message and storing the contents of each column of preceding messages, a display message can be created according to the definition of each column, thus making it further easier to understand the message. Also, by displaying the message as sentences by combining the contents of the columns and respective addition message elements in the display unit 66, the message can easily be understood.

Figure 22:
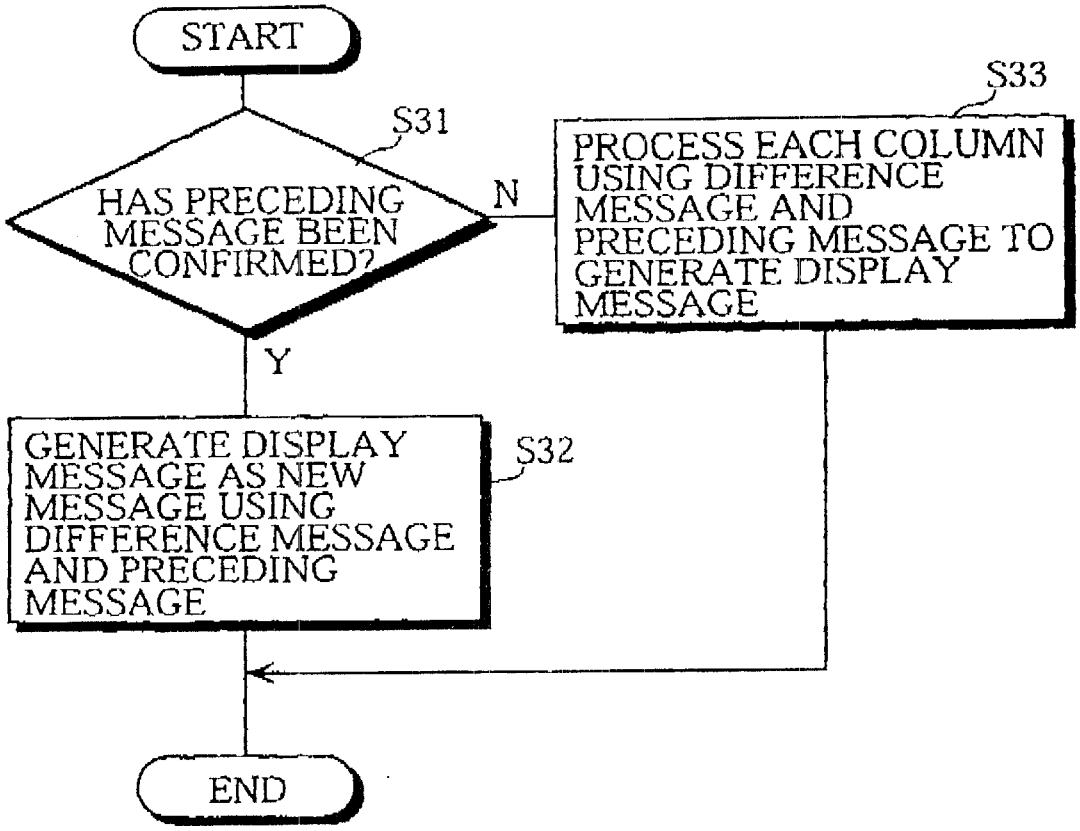
FIG. 22 is a flowchart showing the operation of creating another display message in the first embodiment.

FIG. 22 is a flowchart showing the operation of creating other display messages in the first embodiment. When receiving a plurality of messages, the receiver may not be able to confirm each message immediately after the receipt. For instance, if meeting time is changed from 3:00 to 5:00 and then further changed from 5:00 to 4:00 and if the receiver confirms each received message, he or she can understand these changes. However, for the receiver who has confirmed a message specifying the meeting time at 3:00 but not a message indicating the change of the meeting time from 3:00 to 5:00, a display that informs of the change from 5:00 to 4:00 with the accessory message element "ジニ ハヤクナリマス" would be confusing, since the receiver assumes that the meeting time has changed from 3:00 to 4:00.

In order to solve this problem, when a received message is confirmed by the receiver, confirmation information 64β showing that the message has been confirmed is added to the received message which is stored in the column message storage unit 64. For example, a flag "1" in the confirmation information 64β shows that the message has been confirmed, while a flag "0" in the confirmation information 64β shows that the message has not yet been confirmed.

On receiving and displaying a difference message, the program execution unit 65 activates the received message display program 9 and retrieves a flag of the confirmation information 64β of an immediately preceding message to judge whether the immediately preceding message has been confirmed (Step S31). When the immediately preceding message has been confirmed, the program execution unit 65 proceeds to Step S32 to create a display message using the changed contents of the column in the difference message in respect to the immediately preceding message as a new message and completes the program. Which is to say, when the receiver has confirmed both the message specifying 3:00 and the message indicating the change from 3:00 to 5:00 or when the receiver has confirmed only the message indicating the change from 3:00 to 5:00, the change to 4:00 is displayed with the display message element "ジニ ハヤクナリマス".

When, on the other hand, the immediately preceding message has not been confirmed in Step S31, the program execution unit 65 proceeds to Step S33 to create a display message by processing the difference message and received preceding messages for each column and completes the program. Which is to say, when the receiver has confirmed neither the message specifying 3:00 nor the message indicating the change from 3:00 to 5:00, the change to 4:00 is displayed with the display message element "ジニ ハヤクナリマス".

With the present embodiment, the confirmation information 64β showing whether a message has been confirmed by the receiver is added to each preceding message stored in the column message storage unit 64. Accordingly, when the program execution unit 65 executes the column program 2b and the received message display program 9 to create a display message, the program execution unit 65 checks whether a corresponding preceding message has been confirmed. Thus, the display message is created in accordance with a confirmation/non-confirmation of the corresponding preceding message, so that the user can understand the display message more easily.

Note that while the programs are written in the C language in the above embodiment, the programs may be written in any programming languages, such as the assembler, C++, Tcl, PostScript, and Java.

Also, while each radio pager is described as an independent device in the above embodiment, the radio pager may be installed in a radio device, such as a PHS (Personal Handyphone System), a portable phone, or a PDA (Personal Digital Assistant).

The programs in the radio pager may also be written in other programming languages, such as the assembler and PASCAL.

Second Embodiment

Figure 23:
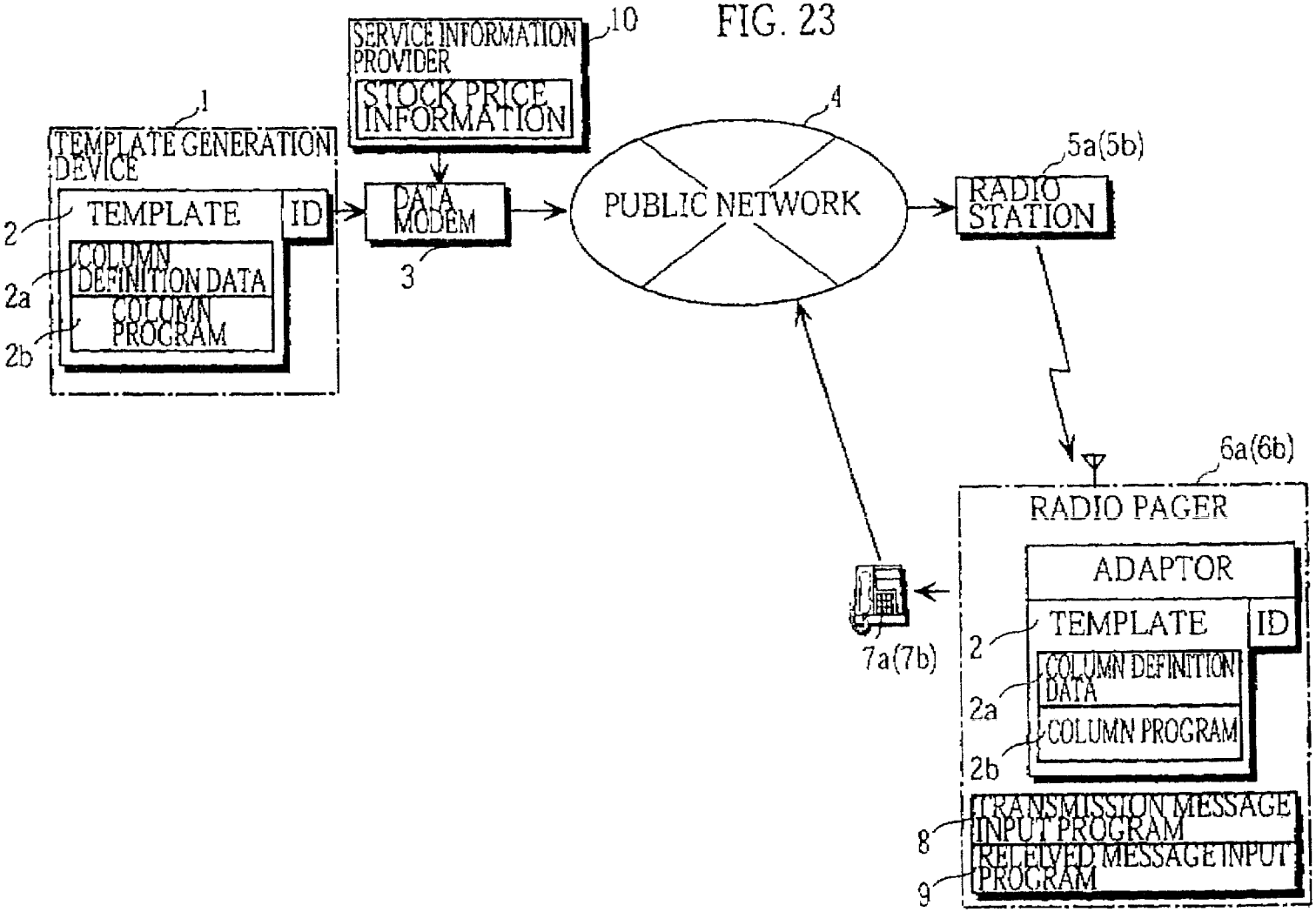
FIG. 23 is a block diagram showing the general construction of the system that uses the radio pager of the second embodiment of the present invention.

FIG. 23 is a block diagram showing the general construction of the system that uses the radio pager of the second embodiment of the present invention. In this system, the template generation device 1 issues a card that stores the template 2 and an ID unique to a user and sends the card to each user by mail or other means. The radio pagers 6*a* and 6*b* each place the card in an adaptor 69*a* and as a result the template 2 is stored into the program storage unit 63 by a template read unit 69*b* (see FIG. 5). Alternatively, the card itself may be used as the program storage unit 63. Also, the template 2 may be sent by radio, while a card which stores the ID is sent by mail and placed in the adaptor 69*a*.

The program execution unit 65 of the radio pager 6*a* (6*b*) in this system can use the column definition data 2*a* and execute the column program 2*b* in the template 2 if the radio pager possesses the ID. The column program 2*b* included in a stock price template 2 is designed so that a price of each stock periodically sent from a service information provider 10 as a difference message is compared with a previous price shown in a preceding message and accordingly the difference message is displayed with comments such as "ジカラノウチアゲニオクレマスタナカヨリ" (INCREASE) and "ヒククナリマシタ" (DECREASE). The column program 2*b* may also be designed so that the message is displayed only when a price exceeds a threshold value which has been set for each specified stock. Also, the transmission message input program 8 may be designed so that the user can trade stocks according to a rise and fall in the prices.

As described above, the template 2 is used by placing the card which includes the template 2 into the adaptor 69*a* in the present embodiment. The column definition data is sent to and commonly used by users, so that it is unnecessary for each user to commonly input each self-made message in a predetermined number and memorize a list which associates each self-made message with the corresponding predetermined number as being conventionally done. Also, the column definition data can be obtained easily.

The third to seventh embodiments are explained next where the control information stored in the storage means relates to programs.

Third Embodiment

Figure 24:
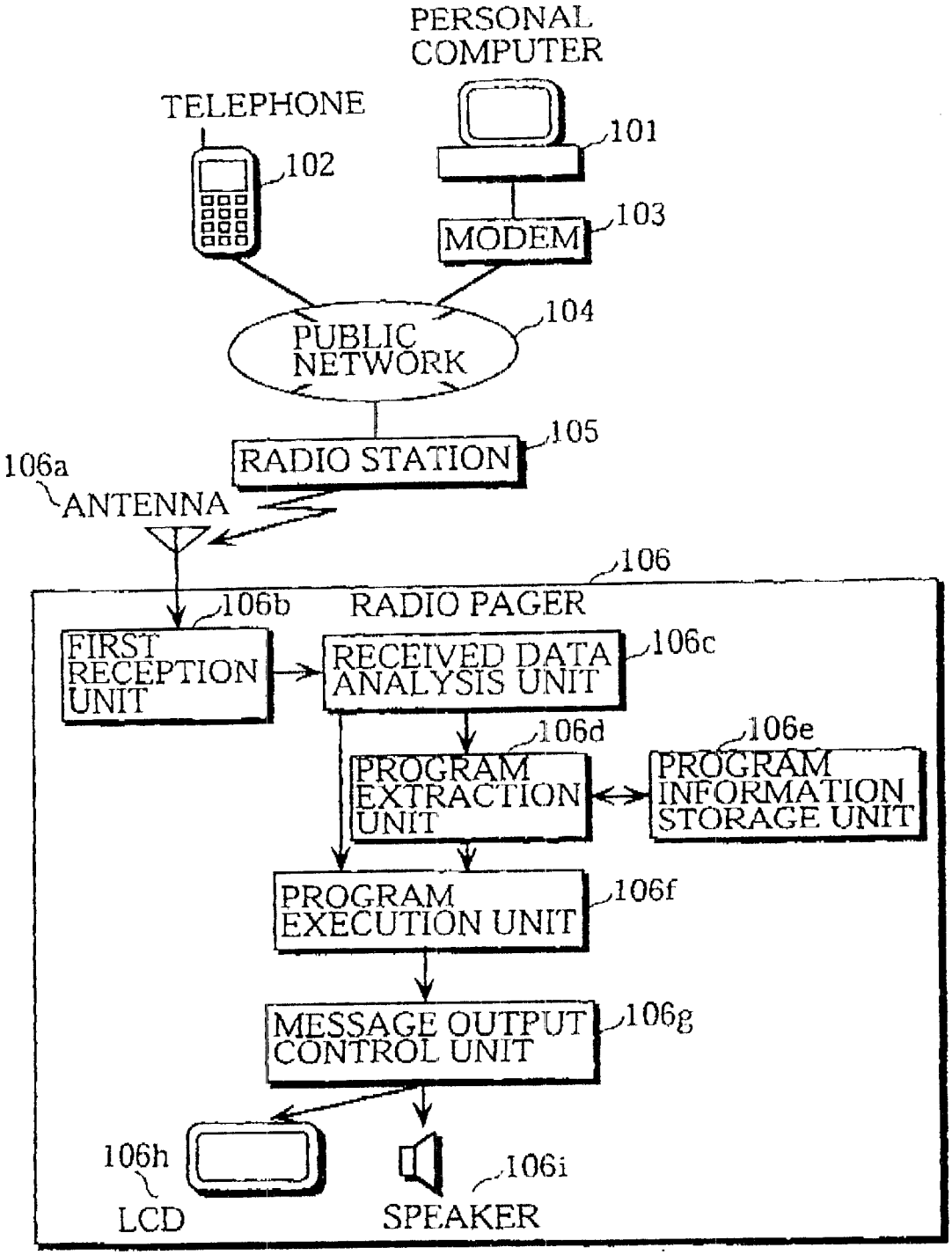
FIG. 24 is a block diagram showing an example of the general construction of the system that uses the radio pager of the third embodiment of the present invention.

FIG. 24 is a block diagram showing an example of the general construction of the system that uses the radio pager of the third embodiment of the present invention.

In the figure, a message inputted using a personal computer 101 is transmitted to a radio pager 106 as a radio message via a modem 103, a public network 104, and a radio station 105. A message inputted using a telephone 102 is transmitted to the radio pager 106 as a radio message via the public network 104 and the radio station 105.

The public network 104 provides a number/kana service, an alphanumeric service, a free sentence service, and a transparent data service. The number/kana service is to transmit the numbers 0–9 and the Japanese kana, as well as symbols such as a hyphen. The alphanumeric service is to transmit the numbers 0–9 and the alphabet. The free sentence service is to transmit free sentences by using a combination of two-digit numbers to express letters. The transparent data service is to transmit radio messages sent from a transmitter in the binary form.

The radio pager 106 includes an antenna 106*a*, a first reception unit 106*b*, a received data analysis unit 106*c*, a program extraction unit 106*d*, a program information storage unit 106*e*, a program execution unit 106*f*, a message output control unit 106*g*, an LCD (liquid crystal display) 106*h*, and a speaker 106*i*.

The first reception unit 106*b* judges whether a radio message received via the antenna 106*a* is for the radio pager 106. When the message is for the radio pager 106, the first reception unit 106*b* sends the message to the received data analysis unit 106*c*.

The received data analysis unit 106*c* analyzes the radio message sent from the first reception unit 106*b* and extracts message header information and message contents information (described later) from the analyzed message information. The received data analysis unit 106*c* then extracts program information (described later) and each message contents group respectively from the message header information and the message contents information.

The construction of the message information is explained below with reference to FIG. 25.

In the figure, message information 201 is composed of message header information 201*a* and message contents information 201*b*. The message header information 201*a* is composed of program information 201*c* for identifying a program stored in the radio pager 106. The message contents information 201*b* is composed of message contents 1 information 201*b*1, message contents 2 information 201*b*2, and separators 201*f*. The message contents 1 information 201*b*1 is composed of display text 1 information 201*d*, while the message contents 2 information 201*b*2 is composed of display text 2 information 201*e*.

Figure 26A:
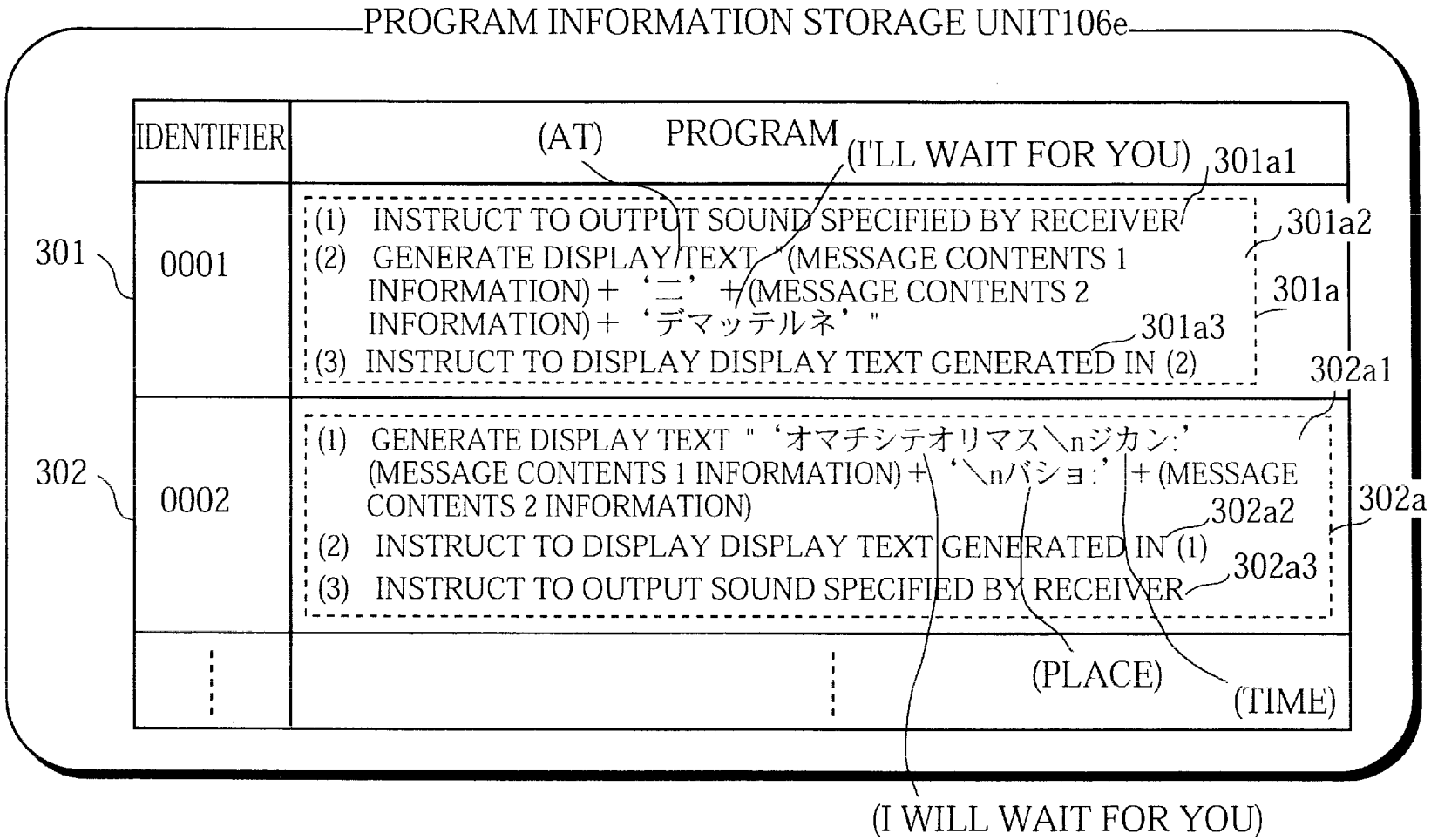
FIGS. 26A–26C are schematic diagrams showing information stored in the program information storage unit of the third embodiment.
Figure 26B:
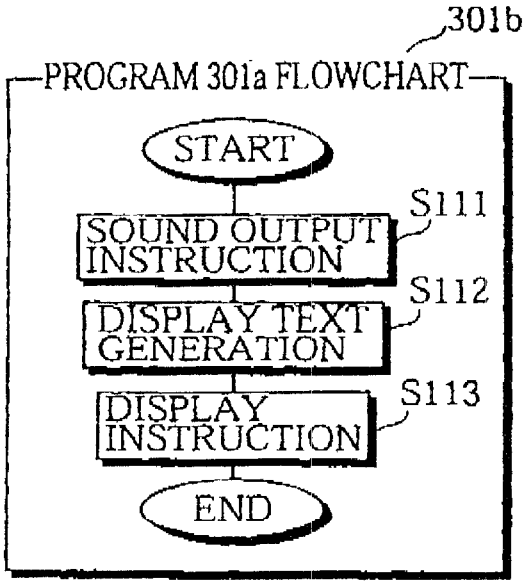
Figure 26C:
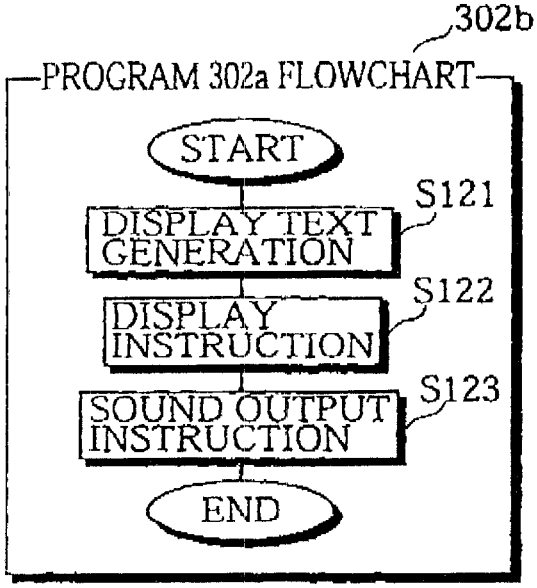

The program information storage unit 106*e* stores each combination of an identifier and a program in a conceptual form as shown in FIG. 26.

In the figure, a combination 301 shows that program 301*a* has an identifier 0001. Program 301*a* includes sub programs 301*a*1, 301*a*2, and 301*a*3. Sub program 301*a*1 is a program for instructing to output a sound that is specified by a receiver in advance in the radio pager 106. Sub program 301*a*2 is a program for generating a display text "(the message contents 1 information 201*b*1)+'ニ'+(the message contents 2 information 201*b*2)+'デマッテルネ'" using the display text information included in the message contents 1 information 201*b*1 and the message contents 2 information 201*b*2 in the message information 201. For instance, when the display text information of the message contents 1 information 201*b*1 is "12ジ" (12:00) and the display text information of the message contents 2 information 201*b*2 is "ウメダ" (UMEDA), sub program 301*a*2 generates a display text "12ジニウメダデマッテルネ" (I'LL WAIT FOR YOU AT 12:00 IN UMEDA). Sub program 301*a*3 is a program for instructing to display the display text generated by sub program 301*a*2. The processing of program 301*a* is shown below with reference to the flowchart 301*b*. The processing proceeds in numerical order.

(1) Instruct to output the sound specified by the receiver (Step S111).

(2) Generate the display text "(message contents 1 information 201*b*1)+'ニ'+(message contents 2 information 201*b*2)+'デマッテルネ'" (Step S112).

(3) Instruct to display the display text generated in Step S112 (Step S113).

An example program written in the programming language Tcl is shown below as a specific example of program 301*a*. Each comment is given the code #.

```
# Instruct to output the sound specified by the receiver.
# Note that sound specification information of the receiver
  is stored in a variable userdefsound.
execsound $userdefsound
# Generate a display text.
# Note that the generated display text is stored in a
  variable disptxt.
# Note that display texts of the message contents 1
  information and the message contents 2 information are
  respectively stored in variables msg1info and
  msg2info.
set disptxt [join[list $msg1info"ニ"$msg2info
  "デマッテルネ"]""]
# Instruct to display.
execdisp $disptxt (End)
```

In FIG. 26, a combination 302 shows that program 302*a* has an identifier 0002. Program 302*a* includes sub programs 302*a*1, 302*a*2, and 302*a*3. Sub program 302*a*1 generates a display text "'オマチシテオリマス\nジカン:'+(message contents 1 information 201*b*1)+'バショ'+(message contents 2 information 201*b*2)" using the display text information included in the message contents 1 information 201*b*1 and the message contents 2 information 201*b*2 in the message information 201. For instance, when the display text information of the message contents 1 information 201*b*1 is "12ジ" and the display text information of the message contents 2 information 201*b*2 is "ジカン", sub program 302*a*1 generates a display message "オマチシテオリマス\nジカン: 12ジ\nバショ: ウメダ" (I WILL WAIT FOR YOU\TIME: 12:00\PLACE: UMEDA). The code "\n" indicates a line break. Sub program 302*a*2 instructs to display the display text generated by sub program 302*a*1. Sub program 302*a*3 instructs to output the sound specified by the receiver in advance in the radio pager 106. The processing of program 302*a* is shown below with reference to the flowchart 302*b*. The processing proceeds in numerical order.

(1) Generate the display text "オマチシテオリマス\nジカン:'+(message contents 1 information 201*b*1)+'\nバショ:'+(message contents 2 information 201*b*2)" (Step S121).

(2) Instruct to display the display text generated in Step S121 (Step S122).

(3) Instruct to output the sound specified by the receiver (Step S123).

An example program written in the programming language Tcl is shown below as a specific example of program 302*a*.

```
# Generate a display text.
# Note that the generated display text is stored in a
  variable disptxt.
# Note that display texts of the message contents 1
  information and the message contents 2 information are
  respectively stored in variables msg1info and
  msg2info.
set disptxt[join[list"オマチシテオリマス"544
  nジカン:"$msg1info\"\nバショ"$msg2info]""]
# Instruct to display.
execdisp $disptxt
# Instruct to output the sound specified by the receiver.
# Note that sound specification information of the receiver
  is stored in a variable userdefsound.
execsound $userdefsound (End)
```

The program extraction unit 106*d* extracts a program stored in the program information storage unit 106*e* in accordance with the program information extracted as a result of the analysis by the received data analysis unit 106*c*.

The program execution unit 106*f* executes the program extracted by the program extraction unit 106*d* using the information included in the message contents information 201*b* analyzed by the received data analysis unit 106*c*.

The message output control unit 106*g* controls the message output of the LCD 106*h* and/or the speaker 106*i* when an output instruction is generated towards the LCD 106*h* and/or the speaker 106*i* during the execution of the program by the program execution unit 106*f*.

The following is an explanation of the specific operation of the radio pager of the first embodiment of the present invention with the above construction. Here, the case is explained when the radio pager receives a radio message sent from the radio station 105, the radio message including the message information shown in FIGS. 27(*a*) and 27(*b*) which is sent from the telephone 102.

Figure 27:
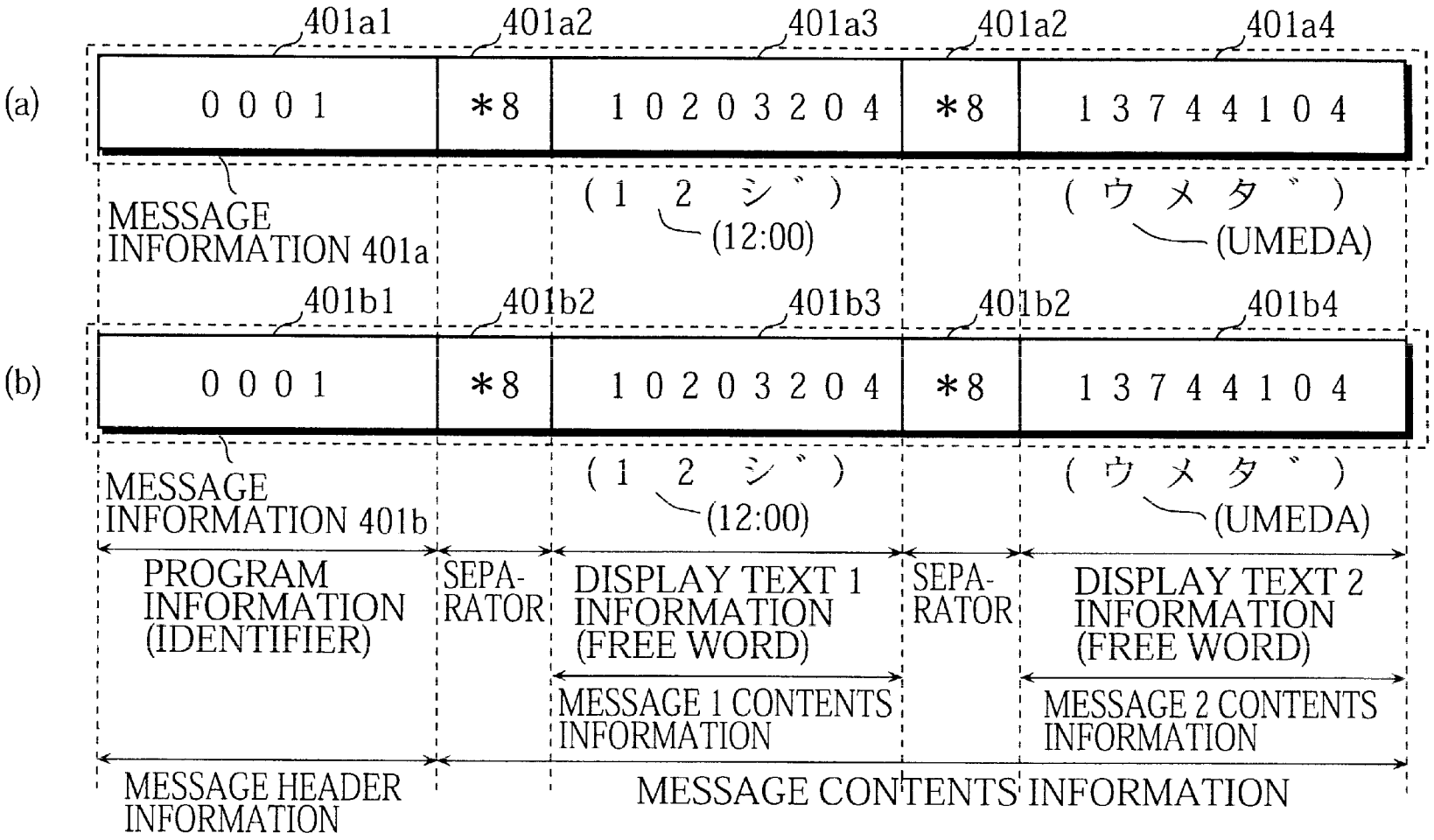
FIG. 27 shows a specific example of the message information in the third embodiment.

First, the message information shown in FIGS. 27(*a*) and 27(*b*) is briefly explained.

In FIG. 27(*a*), a four-digit identifier 401*a*1 "0001" shows program information. A separator 401*a*2 has the value "*8". Display text 1 information 401*a*3 has the value "10203204" as free words. In the free words, "10" indicates "1", "20" indicates "2", "32" indicates "ジ", and "04" indicates "ﾞ". Accordingly, "10203204" indicates "12ジ" (12:00). Display text 2 information 401*a*4 has the value "13744104" as free words. In the free words, "13" indicates "ウ", "74" indicates "メ", "41" indicates "ダ", and "04" indicates "ﾞ". Accordingly, "13744104" indicates "ウメダ" (UMEDA).

In FIG. 27(*b*), a four-digit identifier 401*b*1 "0002" shows program information. A separator 401*a*2, display text 1 information 401*a*3, and display text 2 information 401*a*4 are the same as described above.

The following is an explanation of the operation when a radio message that includes the message information 401*a* shown in FIG. 27(*a*) is received. The operation proceeds in numerical order. The information shown in FIG. 26 explained above is stored in the program information storage unit 106*e* in advance.

(1) The radio pager 106 maintains a reception waiting state.

(2) The first reception unit 106*b* receives the radio message via the antenna 106*a*.

(3) The first reception unit 106*b* judges whether the received radio message is for the radio pager 106. If the message is not for the radio pager 106, the operation returns to (1). If the message is for the radio pager 106, the operation proceeds to (4).

(4) The received data analysis unit 106*c* analyzes the received radio message and extracts the message information 401*a*. The received data analysis unit 106*c* then extracts the message header information and the message contents information from the message information 401*a*. Next, the program information is extracted from the message header information, while the message contents 1 information and the message contents 2 information are extracted from the message contents information. As a result, the program information "0001", the message contents 1 information "10203204 (12ジ)", and the message contents 2 information "13744104 (ウメダ)" are extracted.

(5) The program extraction unit 106*d* extracts a program stored in the program information storage unit 106*e* with reference to the program information "0001" extracted in (4). As a result, sub programs 301*a*1–301*a*3 are extracted.

(6) The program execution unit 106*f* obtains the message contents 1 information and the message contents 2 information extracted in (4) and starts the execution of the program extracted in (5).

(7) The program execution unit 106*f* executes sub program 301*a*1 and instructs the message output control unit 106*g* to output the sound specified by the receiver.

(8) The message output control unit 106*g* has the speaker 106*i* output the sound specified by the receiver.

(9) The program execution unit 106*f* executes sub program 301*a*2 and generates a display text "12デマッテルネ" using the message contents 1 information "10203204 (12ジ)" and the message contents 2 information "13744104 (ウメダ)".

(10) The program execution unit 106*f* executes sub program 301*a*3 and instructs the message output control unit 106*g* to display the display text generated in (9).

(11) The message output control unit 106*g* has the LCD 106*h* display the display text received in (10).

(12) The operation returns to (1).

Next, the operation is explained when a radio message that includes the message information 401*b* shown in FIG. 27(*b*) is received. The operation proceeds in numerical order. The information shown in FIG. 26 explained above is stored in the program information storage unit 106*e* in advance.

(1) The radio pager 106 maintains a reception waiting state.

(2) The first reception unit 106*b* receives the radio message via the antenna 106*a*.

(3) The first reception unit 106*b* judges whether the radio message received in (2) is for the radio pager 106. If the message is not for the radio pager 106, the operation returns to (1). If the message is for the radio pager 106, the operation proceeds to (4).

(4) The received data analysis unit 106*c* analyzes the radio message and extracts the message information 401*b*. The received data analysis unit 106*c* then extracts the message header information and the message contents information from the message information 401*b*. Next, the program information is extracted from the message header information, while the message contents 1 information and the message contents 2 information are extracted from the message contents information. As a result, the program information "0002", the message contents 1 information "10203204 (12ジ)", and the message contents 2 information "13744104 (ウメダ)" are extracted.

(5) The program extraction unit 106*d* extracts a program stored in the program information storage unit 106*e* with reference to the program information "0002" extracted in (4). As a result, sub programs 302*a*1–302*a*3 are extracted.

(6) The program execution unit 106*f* obtains the message contents 1 information and the message contents 2 information extracted in (4) and starts the execution of the program extracted in (5).

(7) The program execution unit 106*f* executes sub program 302*a*1 and generates a display text "オマチシテオリマス\nジカン:12ジ\nバショ:ウメダ" using the message contents 1 information "10203204 (12ジ)" and the message contents 2 information "13744104 (ウメダ)".

(8) The program execution unit 106*f* executes sub program 302*a*2 and instructs the message output control unit 106*g* to display the display text generated in (7).

(9) The message output control unit 106*g* has the LCD 106*h* display the display text received in (8).

(10) The program execution unit 106*f* executes sub program 302*a*3 and instructs the message output control unit 106*g* to output the sound specified by the receiver.

(11) The message output control unit 106*g* has the speaker 106*i* output the sound specified by the receiver.

(12) The operation returns to (1).

Figure 28A:
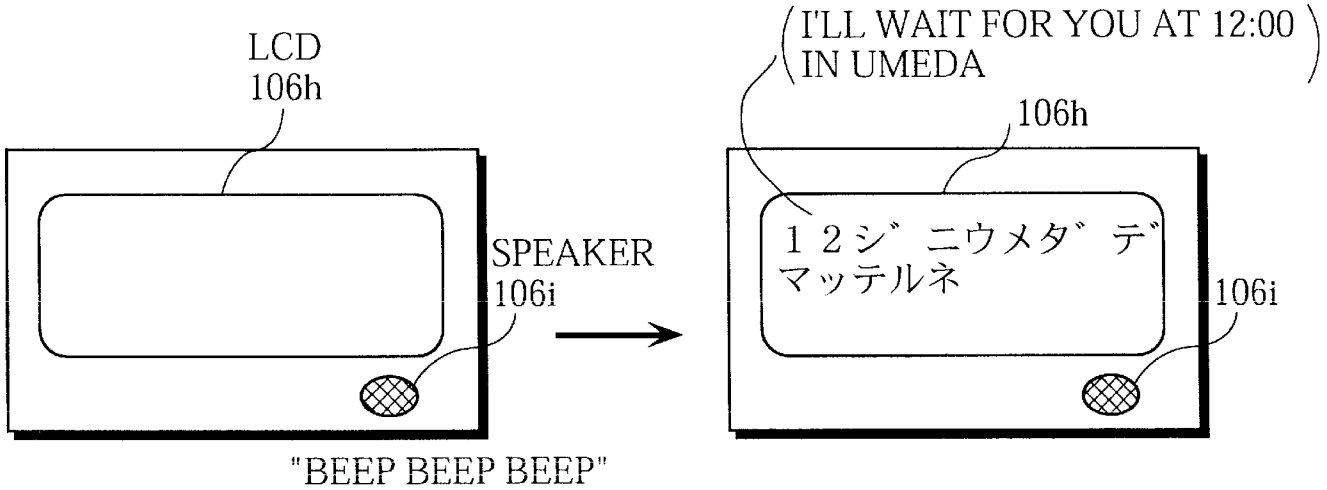
FIGS. 28A and 28B show the appearance of the radio pager of the third embodiment when receiving the message information.
Figure 28B:
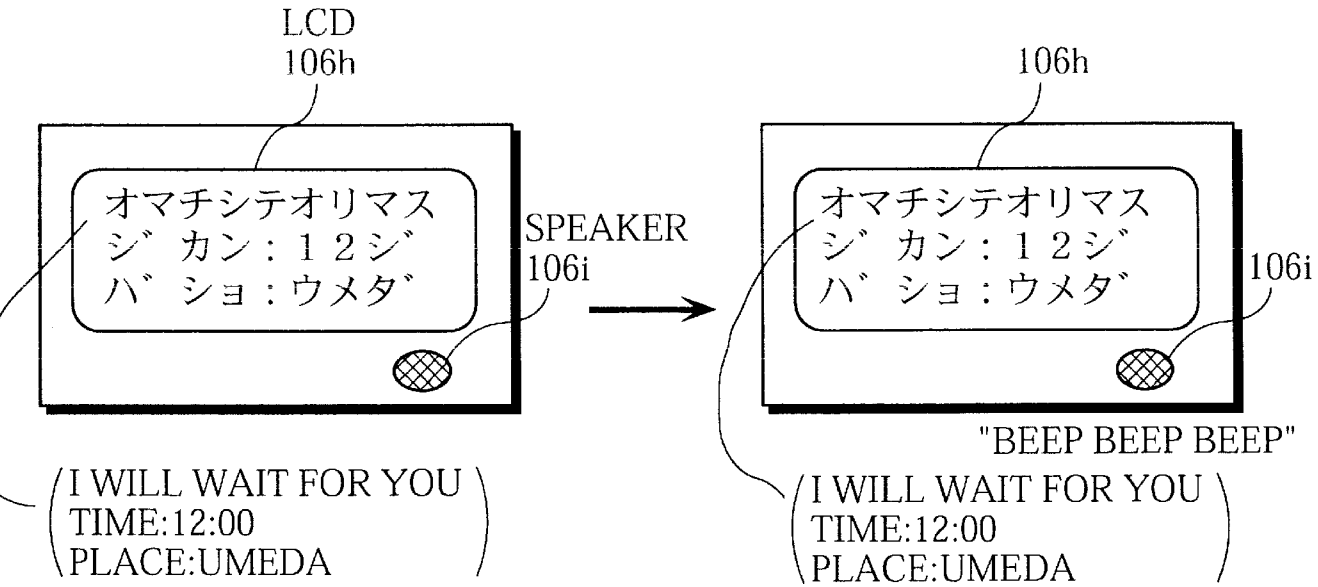

The appearance of the radio pager 106 when receiving the message information 401*a* and the message information 401*b* are shown in FIG. 28.

In the present embodiment, when the transmitter intends to inform the receiver of the meeting at 12:00 in Umeda, the transmitter does not have to make a whole message such as "12デマッテルネ". The transmitter can instead send the contents of the message ("12ジ" and "ウメダ") and the program information that is used to process the message contents, the program information thus making up for the parts other than the message contents. Accordingly, the transmitter can make a message easily.

Also, when the transmitter intends to send messages which subtly differ, such as "○○ニ△△デマッテルネ" and "バショ:○○", to different receivers, the transmitter can do so just by sending different types of program information that realize different displays, such as ""○○ニ△△デマッテルネ". Accordingly, the transmitter does not have to make subtly different messages one by one.

Note that while the program information included in the message header information is a four-digit identifier of a fixed length in the present embodiment, the program information may be an identifier of a variable length. Also, the identifier may be expressed as a string or a code. The program information may instead be a list of a plurality of identifiers. Alternatively, the program information may include a program itself, so that the program execution unit can execute the program analyzed by the received data analysis unit.

While "*8" is used as the separator in the message information in the present embodiment, any other separators may be used or, if possible, the separator may be omitted.

While the free word form is used to express the display text 1 information and the display text 2 information in the message contents information in the present embodiment, any other data forms for expressing text information may be used.

While the message header information is placed at the head of the message information in the present embodiment, the message header information may instead be placed at the end of the message information.

While the programs stored in the program information storage unit are written in the programming language Tcl in the present embodiment, the programs may be written in any other programming languages such as the assembler, C, C++, PostScript, and Java. Alternatively, model templates of output messages may be used as the programs.

While the message header information is composed of the program information in the present embodiment, the message header information may also include transmitter information, transmission device type information, and other information.

While the radio pager is described as an independent device in the present embodiment, the radio pager may be installed in a radio device, such as a PHS (Personal Handyphone System), a portable phone, or a PDA (Personal Digital Assistant).

When a radio message includes the transmitter information, only radio messages from specified transmitters may be permitted (or prohibited) to be displayed. In such a case, transmitter information of each specified transmitter who is permitted by the receiver is stored in the program information storage unit 106*e* in advance. The program execution unit 106*f* judges whether transmitter information of a received radio message is stored in the program information storage unit 106*e* and permits (or prohibits) the message output control unit 106*g* to display/output the received radio message in accordance with the judgement.

Fourth Embodiment

Figure 29:
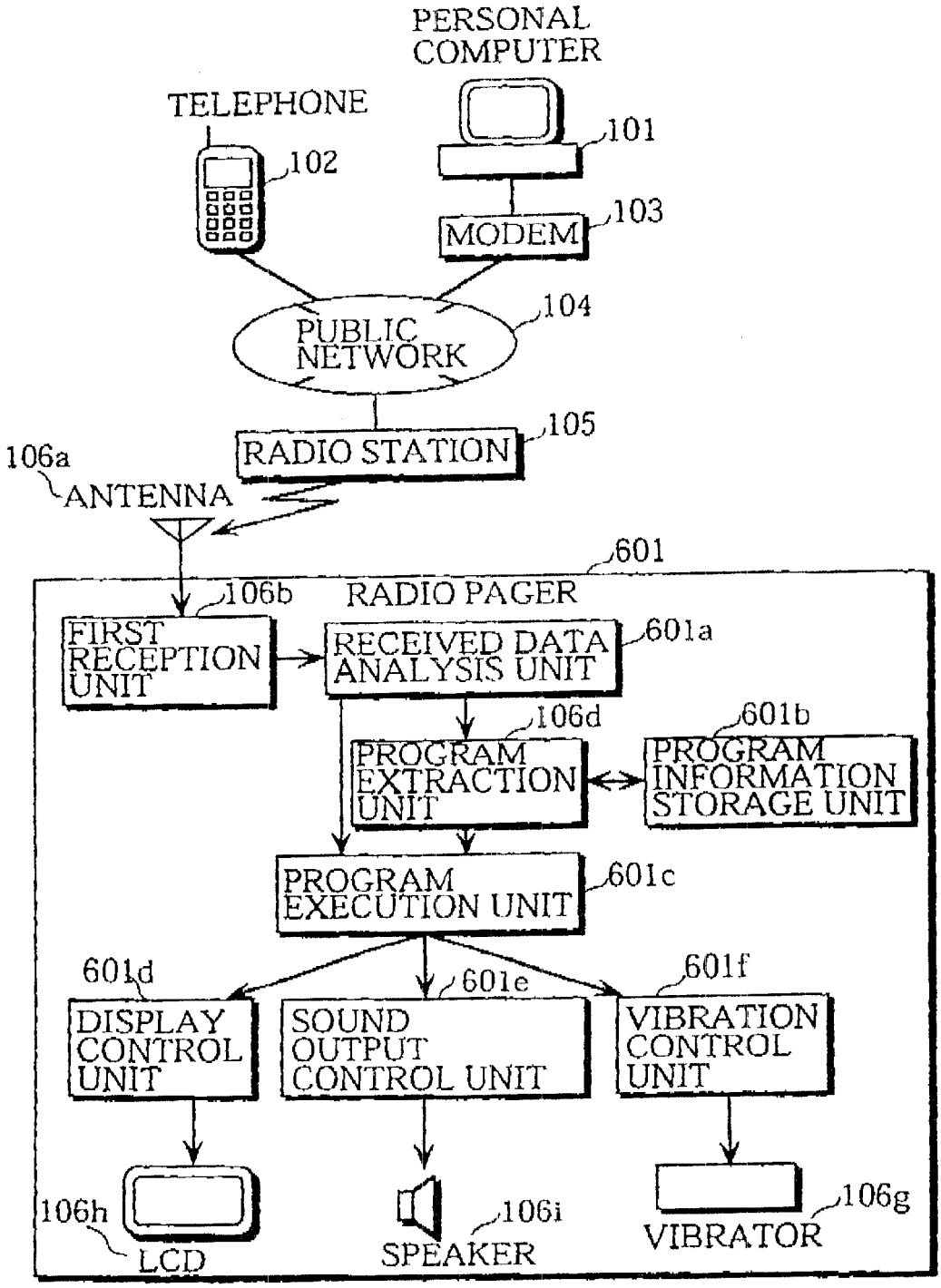
FIG. 29 is a block diagram showing an example of the general construction of the system that uses the radio pager of the fourth embodiment of the present invention.

FIG. 29 is a block diagram showing an example of the general construction of the system that uses the radio pager of the fourth embodiment of the present invention.

In the figure, a message inputted using the personal computer 101 is transmitted to a radio pager 601 as a radio message via the modem 103, the public network 104, and the radio station 105. A message inputted using the telephone 102 is transmitted to the radio pager 601 as a radio message via the public network 104 and the radio station 105. The personal computer 101, the telephone 102, the modem 103, the public network 104, and the radio station 105 are as described above and thus are not explained here.

The radio pager 601 includes the antenna 106*a*, the first reception unit 106*b*, a received data analysis unit 601*a*, the program extraction unit 106*d*, a program information storage unit 601*b*, a program execution unit 601*c*, a display control unit 601*d*, a sound output control unit 601*e*, a vibration control unit 601*f*, the LCD 106*h*, the speaker 106*i*, and a vibrator 601*g*. The antenna 106*a*, the first reception unit 106*b*, the program extraction unit 106*d*, the LCD 106*h*, and the speaker 106*i* are as described above and thus are not explained here.

The received data analysis unit 601 analyzes a radio message sent from the first reception unit 106*b* and extracts message header information and message contents information (described later) from the analyzed message information. The received data analysis unit 601*a* then extracts program information (described later) and a group of arguments respectively from the message header information and the message contents information.

Figure 30:
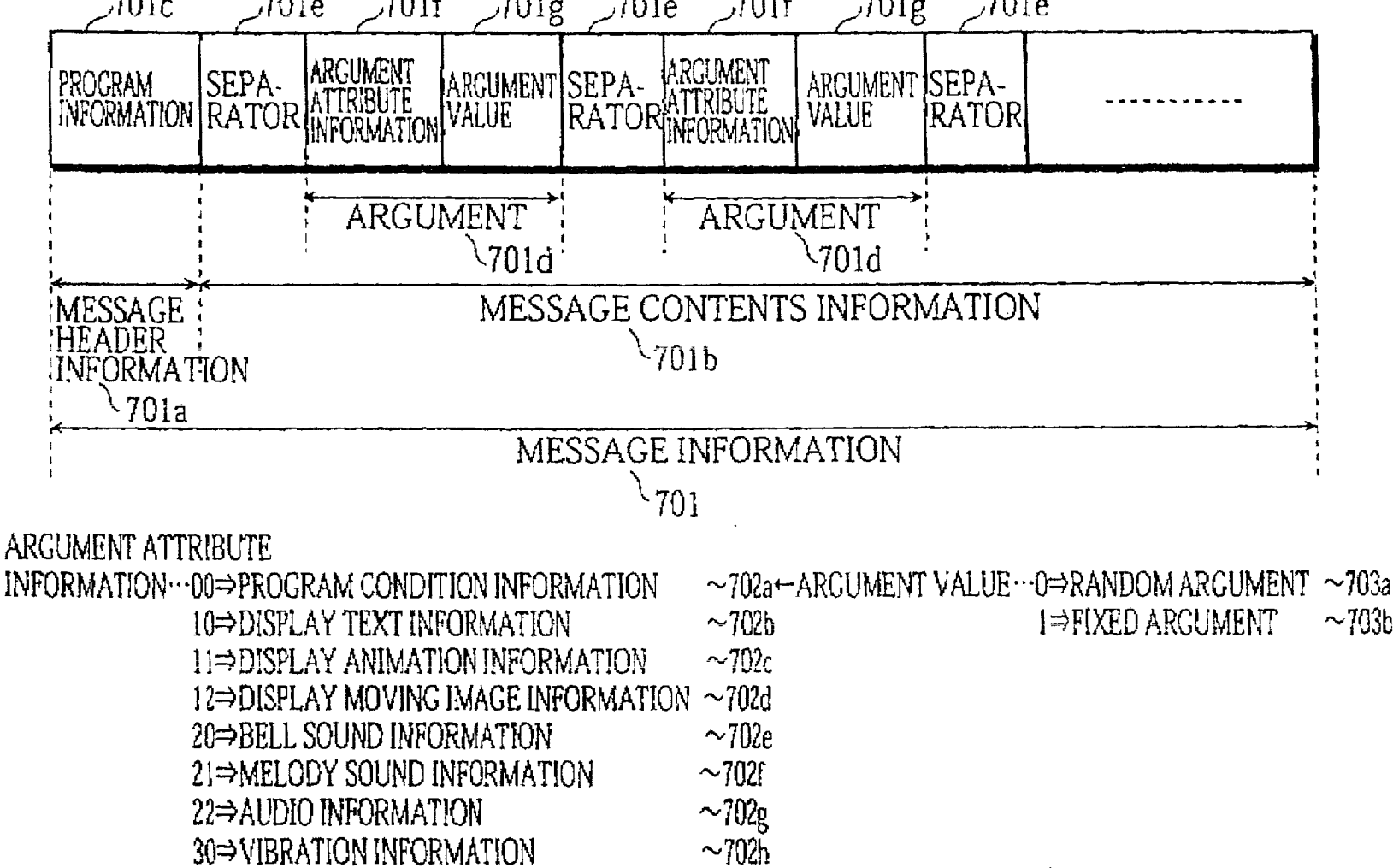
FIG. 30 shows the construction of the message information included in a received radio message in the fourth embodiment.

The construction of the message information is explained below with reference to FIG. 30.

In the figure, message information 701 is composed of message header information 701*a* and message contents information 701*b*. The message header information 701*a* is composed of program information 701*c* for identifying a program stored in the radio pager. The message contents information 701*b* includes a group of arguments 701*d*, wherein a separator 701*e* is placed between each two arguments. Arguments 701*d* are each composed of argument attribute information 701*f* and an argument value 701*g*. Specific examples of the argument attribute information 701*f* are shown in Lines 702*a*–702*h*. In Line 702*a*, when the argument attribute information 701*f* is "00", the argument value shows program condition information. The same can be applied to Lines 702*b*–702*h*. Specific examples of the argument value 701*g* are shown in Lines 703*a* and 703*b*. In Line 703*a*, when the argument value 701*g* is "0", the argument is a "random argument". In Line 703*b*, when the argument value 701*g* is "1", the argument is a "fixed argument". Here, the random argument means that each combination of argument attribute information and an argument value is included at random in a message, so that the radio pager performs the output operation on all combinations included in the message. The fixed argument means that each combination of argument attribute information and an argument value is included in a message in a predetermined order, so that the radio pager performs the output operation only on combinations which conform to the predetermined order among all combinations included in the message.

The program information storage unit 601*b* stores each combination of an identifier and a program in a conceptual form as shown in FIG. 31.

Figure 32A:
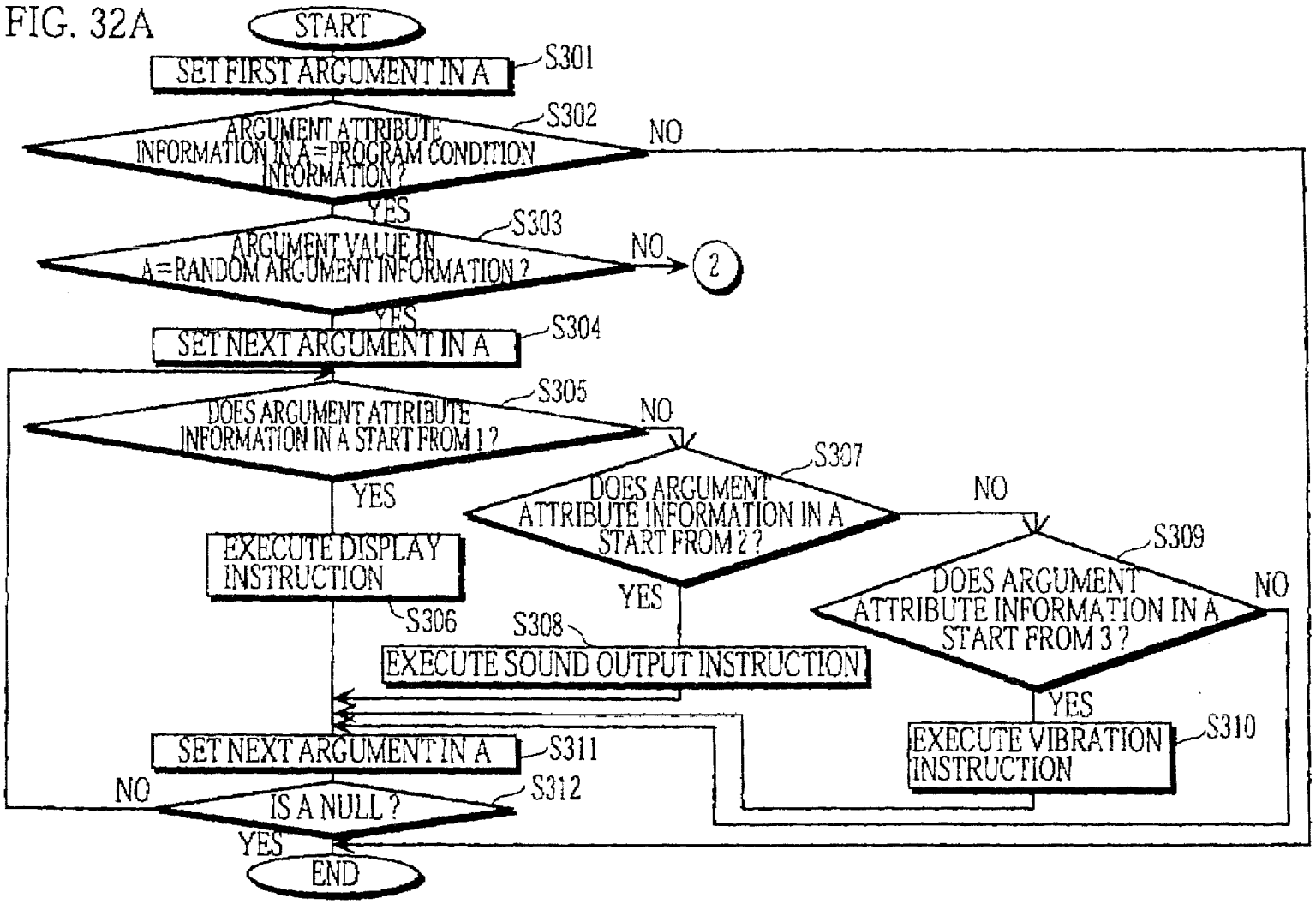
FIGS. 32A and 32B are flowcharts of the program in the fourth embodiment.
Figure 32B:
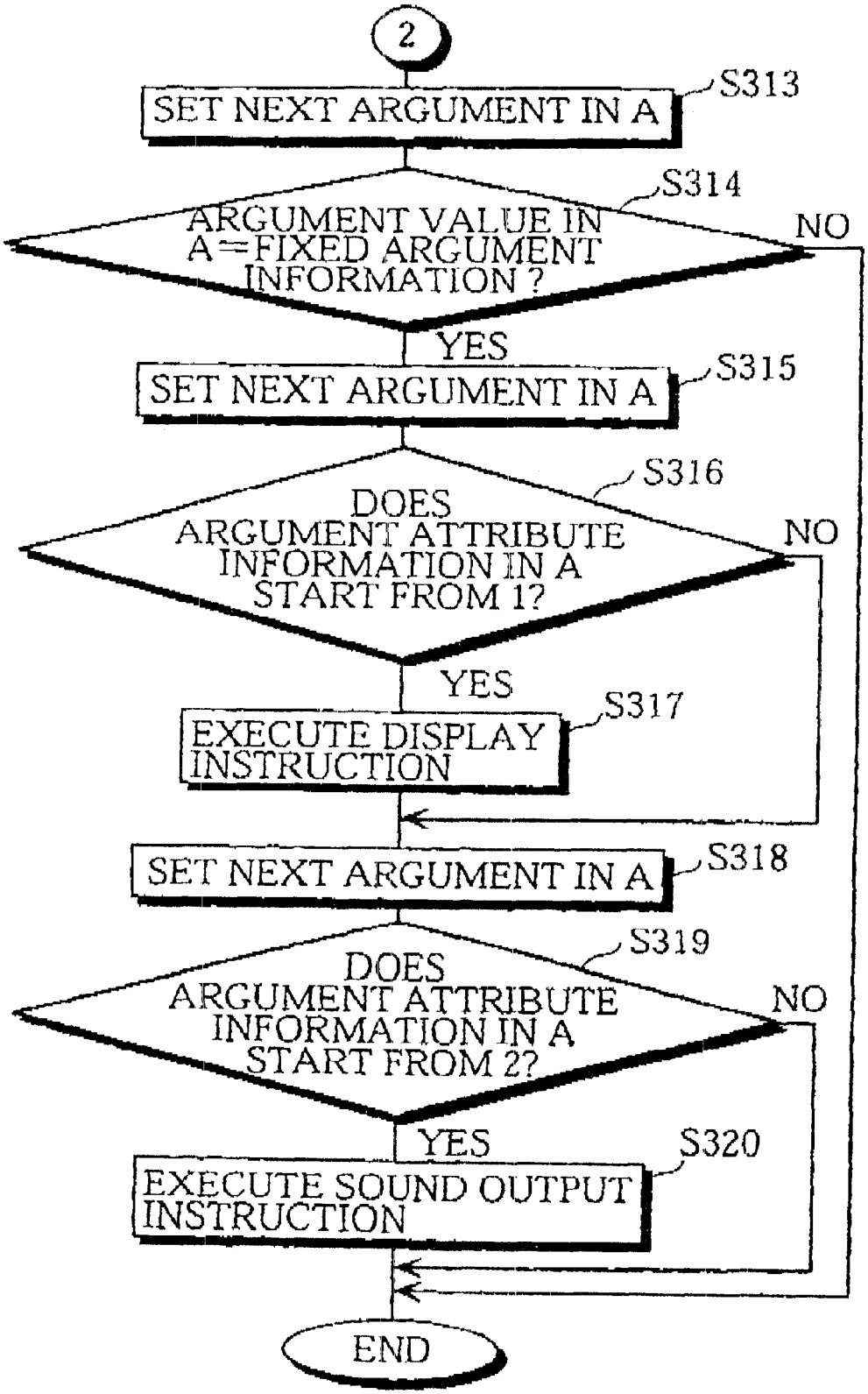

FIG. 31 shows an example of program 801 whose identifier is "0003". In the figure, program 801 is written in a form similar to the C language. Program 802 is shown as a specific example of program 801 written in C. The following is an explanation of the operation of program 801 with reference to FIG. 32. The operation proceeds in numerical order.

(1) A first argument including an argument attribute value and an argument value is set in a variable A (Step S301).

(2) If the argument attribute information in the variable A shows program condition information, the operation proceeds to (3). Otherwise, the operation proceeds to (21) (Step S302).

(3) If the argument value in the variable A shows the "random argument", the operation proceeds to (4). Otherwise, the operation proceeds to (13) (Step S303).

(4) A next argument is set in the variable A (Step S304).

(5) If argument attribute information in the variable A has a value starting from "1", the operation proceeds to (6). Otherwise, the operation proceeds to (7) (Step S305).

(6) A display instruction is executed for the information in the variable A, and the operation proceeds to (11) (Step S306).

(7) If the argument attribute information in the variable A has a value starting from "2", the operation proceeds to (8). Otherwise, the operation proceeds to (9) (Step S307).

(8) A sound output instruction is executed for the information in the variable A, and the operation proceeds to (11) (Step S308).

(9) If the argument attribute information in the variable A has a value starting from "3", the operation proceeds to (10). Otherwise, the operation proceeds to (11) (Step S309).

(10) A vibration instruction is executed for the information in the variable A, and the operation proceeds to (11) (Step S310).

(11) A next argument is set in the variable A (Step S311).

(12) If the variable A is null, the operation proceeds to (21). Otherwise, the operation proceeds to (5) (Step S312).

(13) A next argument is set in the variable A (Step S313).

(14) If an attribute value in the variable A shows the "fixed argument", the operation proceeds to (15). Otherwise, the operation proceeds to (21) (Step S314).

(15) A next argument is set in the variable A (Step S315).

(16) If argument attribute information in the variable A has a value starting from "1", the operation proceeds to (17). Otherwise, the operation proceeds to (18) (Step S316).

(17) A display instruction is executed for the information in the variable A (Step S317).

(18) A next argument is set in the variable A (Step S318).

(19) If argument attribute information in the variable A has a value starting from "2", the operation proceeds to (20). Otherwise, the operation proceeds to (21) (Step S319).

(20) A sound output instruction is executed for the information in the variable A (Step S320).

(21) The program ends.

The program execution unit 601*c* executes a program, which was extracted by the program extraction unit 106*d*, using the information included in the message contents information analyzed by the received data analysis unit 601*a*.

On receiving display information from the program execution unit 601*c*, the display control unit 601*d* controls the LCD 106*h* to display letters, animation, moving images, and the like. The animation and moving images can be easily displayed by flashing each dot of the LCD 106*h* on and off or by combining sideways scrolling and up-and-down scrolling in units of dots.

On receiving sound output information from the program execution unit 601*c*, the sound output control unit 601*e* controls the speaker 106*i* to output bells, melodies, and other sounds. In the present embodiment, the sound output control unit 601*e* stores in advance each combination of a sound identifier and a sound pattern in a conceptual form as shown in FIG. 33A, and controls the speaker 106*i* to output sounds in accordance with a sound identifier included in the sound output information.

On receiving vibration information from the program execution unit 601*c*, the vibration control unit 601*f* controls the vibrator 601*g* to generate vibrations. In the present embodiment, the vibration control unit 601*f* stores in advance each combination of a vibration identifier and a vibration pattern in a conceptual form as shown in FIG. 33B, and controls the vibrator 601*g* to generate vibrations in accordance with a vibration identifier included in the vibration information.

The following is an explanation of the specific operation of the radio pager of the fourth embodiment with the above construction.

Figures 34A, 34B, 34C:
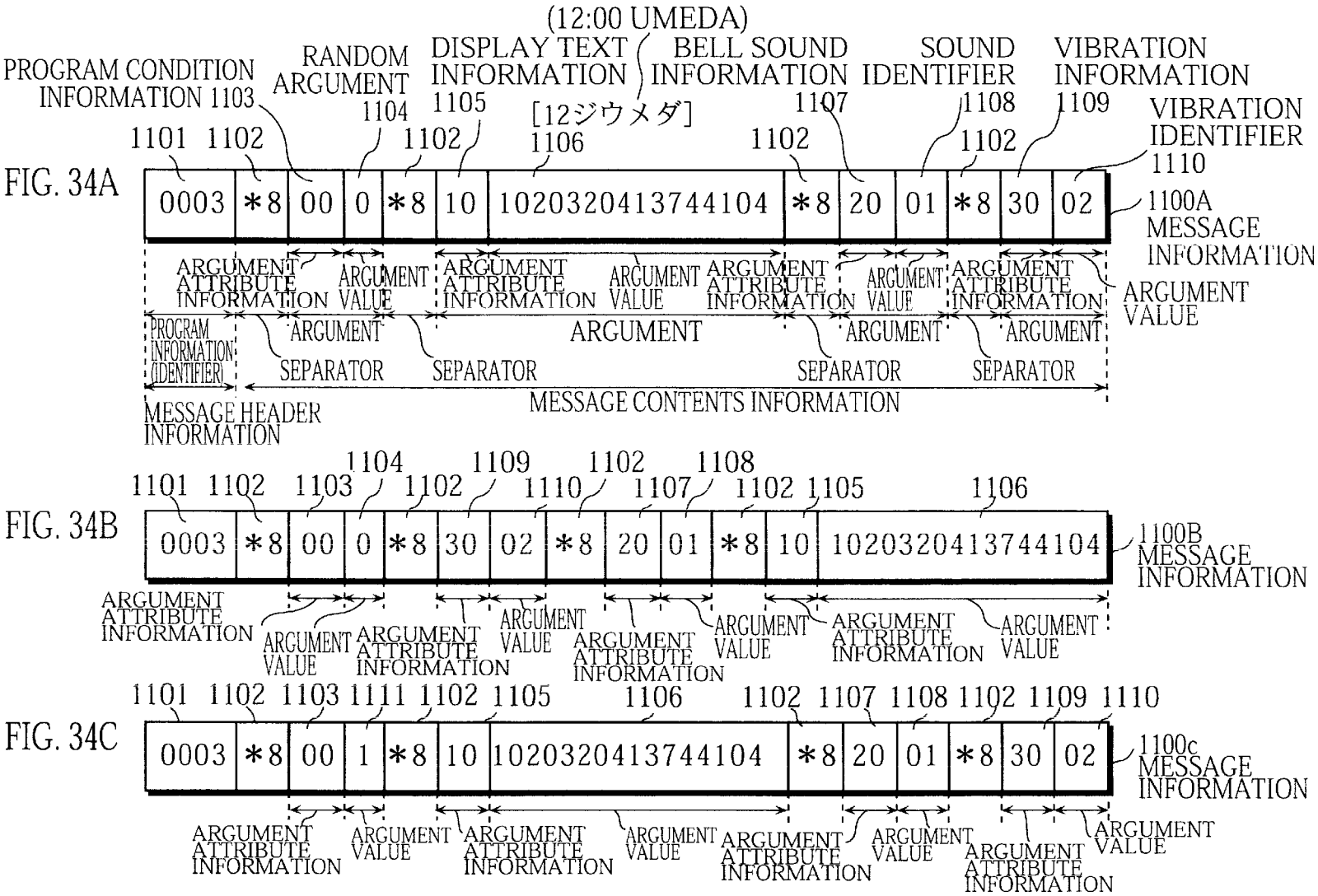
FIGS. 34A–34C show specific examples of the message information in the fourth embodiment.

Here, the case is explained when the radio pager receives a radio message from the radio station 105, the radio message including message information shown in FIG. 34 sent from the telephone 102.

Here, FIG. 34 is briefly explained.

The figure shows the contents of message information 1100*a*, 1100*b*, and 1100*c*.

In the figure, field 1101 shows a four-digit identifier with the value "0003" as program information. Field 1102 shows a separator with the value "*8". Field 1103 shows argument attribute information with the value "00" that indicates program condition information. Field 1104 shows an argument value of "0" that indicates the random argument. Field 1105 shows argument attribute information with the value "10" that indicates display text information. Field 1106 shows an argument value of "1020320413744104" in the free word form. In the free words, "10" indicates "1", "20" indicates "2", "32" indicates "ジ", "04" indicates "゛", "13 indicates "ウ", "74" indicates "メ", "41" indicates "○○ニ△△デマッテルネ", so that "1020320413744104" indicates "12ジウメダ". Field 1107 shows argument attribute information with the value "20" that indicates sound output information. Field 1108 shows an argument value with a sound identifier "01". Field 1109 shows argument attribute information with the value "30" that indicates vibration information. Field 1110 shows an argument value with a vibration identifier "02".

The following is an explanation of the operation when receiving a radio message which includes the message information 1100*a* shown in FIG. 34. The operation proceeds in numerical order. The information shown in FIG. 31 is stored in the program information storage unit 601*b* in advance. Also, the data shown in FIGS. 33A and 33B is stored respectively in the sound output control unit 601*e* and the vibration control unit 601*f* in advance. FIGS. 31 and 33 have already been explained.

(1) The radio pager maintains a reception waiting state.

(2) The first reception unit 106*b* receives the radio message via the antenna 106*a*.

(3) The first reception unit 106*b* judges whether the radio message received in (2) is for the radio pager 601. If the message is not for the radio pager 601, the operation returns to (1). Otherwise, the operation proceeds to (4).

(4) The received data analysis unit 601*a* analyzes the radio message and extracts the message information 1100*a*, from which message header information and message contents information are extracted. The received data analysis unit 601*a* further extracts program information and an argument group respectively from the message header information and the message contents information. As a result, the program information "0003" and four arguments that are "argument attribute information=00, argument value=0", "argument attribute information=10, argument value=1020320413744104", "argument attribute information=20, argument value=01", and "argument attribute information=30, argument value=02" are extracted in this order.

(5) The program extraction unit 106*d* extracts a program stored in the program information storage unit 601*b* in accordance with the program information "0003" extracted in (4). As a result, program 801 is extracted.

(6) The program execution unit 601*c* obtains the argument group extracted in (4) and starts the execution of the program extracted in (5).

(7) The first argument is set in a variable A.

(8) Since the argument attribute information "00" in the variable A indicates the program condition information and the argument value "0" in the variable A indicates the random argument, the second argument is set in the variable A.

(9) Since the argument attribute information in the variable A has the value "10" that starts from 1 and that indicates display text information, the program execution unit 601*c* instructs the display control unit 601*d* to display using the second argument.

(10) Since the argument attribute information of the second argument indicates the display text information, the display control unit 601*d* displays a text expressed by the argument value "1020320413744104". As a result, "12ジウメダ" is displayed on the LCD 106*h*.

(11) The third argument is set in the variable A.

(12) Since the variable A is valid, the program execution unit 601*c* checks the argument attribute information in the variable A. Since the argument attribute information in the variable A has the value "20" that starts from 2 and that indicates sound output information, the program execution unit 601*c* instructs the sound output control unit 601*e* to output sounds using the third argument.

(13) Since the argument attribute information of the third argument indicates bell sound information, the sound output control unit 601*e* retrieves a sound pattern corresponding to the argument value "01" and outputs the sound pattern to the speaker 106*i*. As a result, the sound "beep beep" is outputted from the speaker 106*i*.

(14) The fourth argument is set in the variable A.

(15) Since the variable A is valid, the program execution unit 601*c* examines the argument attribute information in the variable A. Since the argument attribute information in the variable A has the value "30" that starts from 3 and that indicates vibration information, the program execution unit 601*c* instructs the vibration control unit 601*f* to generate vibrations using the fourth argument.

(16) Since the argument attribute information of the fourth argument indicates the vibration information, the vibration control unit 601*f* retrieves a vibration pattern corresponding to the argument value "02" and outputs the vibration pattern to the vibrator 601*g*. As a result, the vibrator 601*g* generates vibrations three times.

(17) A next argument is set in the variable A.

(18) Since the variable A is null, the program ends.

Figures 35A, 35B, 35C:
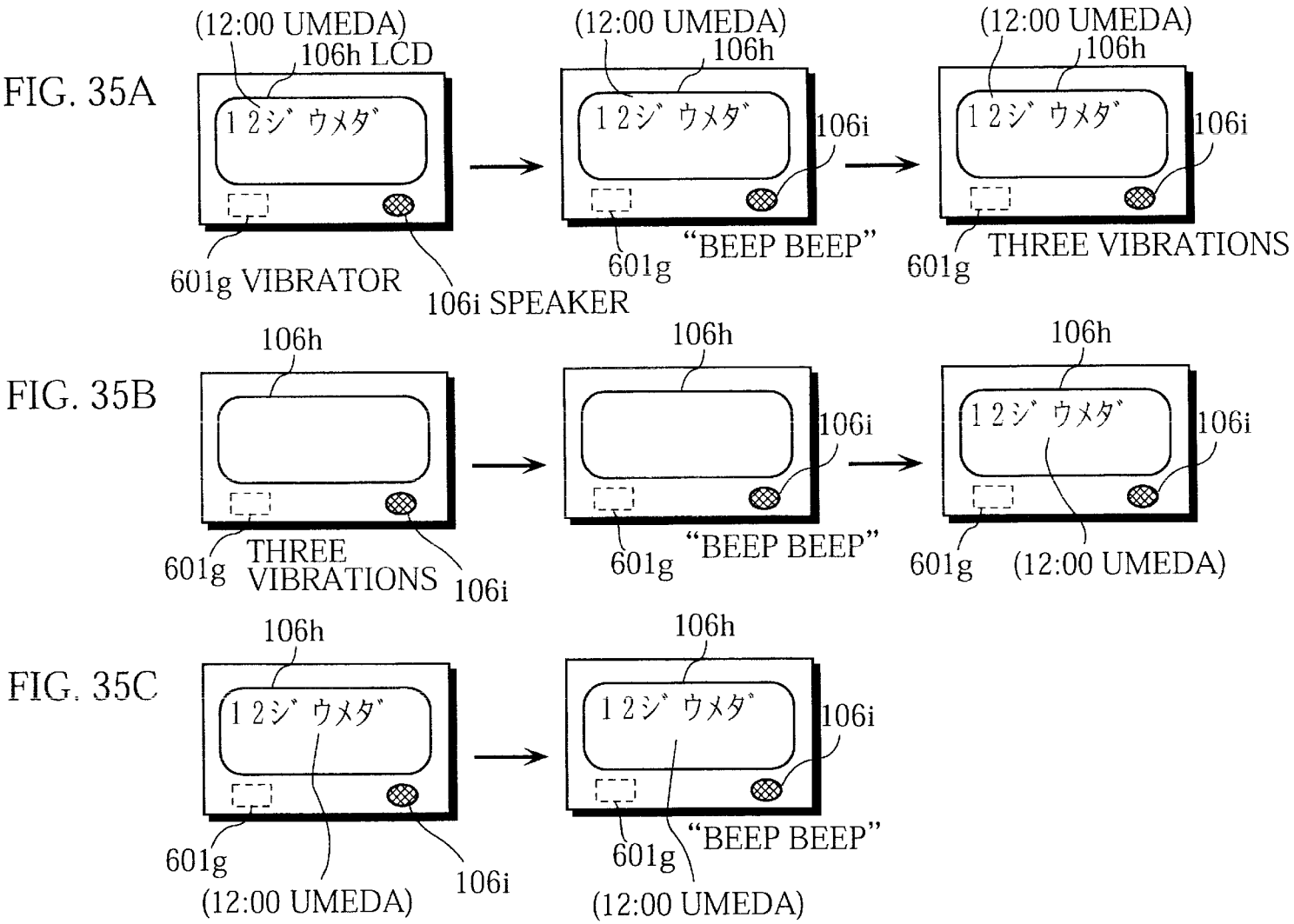
FIGS. 35A–35C show the appearance of the radio pager when receiving the message information in the fourth embodiment.

The appearance of the radio pager when receiving the message information 1100*a* is shown in FIG. 35A.

Next, the operation when receiving a radio message which includes the message information 1100*b* shown in FIG. 34 is explained. The operation proceeds in numerical order. The information shown in FIG. 31 is stored in the program information storage unit 601*b* in advance. Also, the data shown in FIGS. 33A and 33B is stored respectively in the sound output control unit 601*e* and the vibration control unit 601*f* in advance. FIGS. 31 and 33 have already been explained.

(1) The radio pager maintains a reception waiting state.

(2) The first reception unit 106*b* receives the radio message via the antenna 106*a*.

(3) The first reception unit 106*b* judges whether the radio message received in (2) is for the radio pager 601. If the message is not for the radio pager 601, the operation returns to (1). Otherwise, the operation proceeds to (4).

(4) The received data analysis unit 601*a* analyzes the radio message and extracts the message information 1100*b*, from which message header information and message contents information are extracted. The received data analysis unit 601*a* further extracts program information and an argument group respectively from the message header information and the message contents information. As a result, the program information "0003" and four arguments that are "argument attribute information=00, argument value=0", "argument attribute information=30, argument value=02", "argument attribute information=20, argument value=01", and "argument attribute information=10, argument value=1020320413744104" are extracted in this order.

(5) The program extraction unit 106*d* extracts a program stored in the program information storage unit 601*b* in accordance with the program information "0003" extracted in (4). As a result, program 801 is extracted.

(6) The program execution unit 601*c* obtains the argument group extracted in (4) and starts the execution of the program extracted in (5).

(7) The first argument is set in a variable A.

(8) Since the argument attribute information "00" in the variable A indicates the program condition information and the argument value "0" in the variable A indicates the random argument, the second argument is set in the variable A.

(9) Since the argument attribute information in the variable A has the value "30" that starts from 3 and that indicates vibration information, the program execution unit 601*c* instructs the vibration control unit 601*f* to generate vibrations using the second argument.

(10) Since the argument attribute information of the second argument indicates the vibration information, the vibration control unit 601*f* retrieves a vibration pattern corresponding to the argument value "02" and outputs the vibration pattern to the vibrator 601*g*. As a result, the vibrator 601*g* generates vibrations three times.

(11) The third argument is set in the variable A.

(12) Since the variable A is valid, the program execution unit 601*c* checks the argument attribute information in the variable A. Since the argument attribute information in the variable A has the value "20" that starts from 2 and that indicates sound output information, the program execution unit 601*c* instructs the sound output control unit 601*e* to output sounds using the third argument.

(13) Since the argument attribute information of the third argument indicates bell sound information, the sound output control unit 601*e* retrieves a sound pattern corresponding to the argument value "01" and outputs the sound pattern to the speaker 106*i*. As a result, the sound "beep beep" is outputted from the speaker 106*i*.

(14) The fourth argument is set in the variable A.

(15) Since the variable A is valid, the program execution unit 601*c* checks the argument attribute information in the variable A. Since the argument attribute information in the variable A has the value "10" that starts from 1 and that indicates display text information, the program execution unit 601*c* instructs the display control unit 601*d* to display using the fourth argument.

(16) Since the argument attribute information of the fourth argument indicates the display text information, the display control unit 601*d* displays a text expressed by the argument value "1020320413744104". As a result, "12ジウメダ" is displayed on the LCD 106*h*.

(17) A next argument is set in the variable A.

(18) Since the variable A is null, the program ends.

The appearance of the radio pager when receiving the message information 1100*b* is shown in FIG. 35B.

Next, the operation when receiving a radio message which includes the message information 1100*c* shown in FIG. 34 is explained. The operation proceeds in numerical order. The information shown in FIG. 31 is stored in the program information storage unit 601*b* in advance. Also, the data shown in FIGS. 33A and 33B is stored respectively in the sound output control unit 601*e* and the vibration control unit 601*f* in advance. FIGS. 31 and 33 have already been explained.

(1) The radio pager maintains a reception waiting state.

(2) The first reception unit 106*b* receives the radio message via the antenna 106*a*.

(3) The first reception unit 106*b* judges whether the radio message received in (2) is for the radio pager 601. If the message is not for the radio pager 601, the operation returns to (1). Otherwise, the operation proceeds to (4).

(4) The received data analysis unit 601*a* analyzes the radio message and extracts the message information 1100*c*, from which message header information and message contents information are extracted. The received data analysis unit 601*a* further extracts program information and an argument group respectively from the message header information and the message contents information. As a result, the program information "0003" and four arguments that are "argument attribute information=00, argument value=1", "argument attribute information=10, argument value=1020320413744104", "argument attribute information=20, argument value=01", and "argument attribute information=30, argument value=02" are extracted in this order.

(5) The program extraction unit 106*d* extracts a program stored in the program information storage unit 601*b* in accordance with the program information "0003" extracted in (4). As a result, program 801 is extracted.

(6) The program execution unit 601*c* obtains the argument group extracted in (4) and starts the execution of the program extracted in (5).

(7) The first argument is set in a variable A.

(8) Since the argument attribute information "00" in the variable A indicates the program condition information and the argument value "1" in the variable A indicates the fixed argument, the second argument is set in the variable A.

(9) Since the argument attribute information in the variable A has the value "10" that starts from 1 and that indicates display text information, the program execution unit 601*c* instructs the display control unit 601*d* to display using the second argument.

(10) Since the argument attribute information of the second argument indicates the display text information, the display control unit 601*d* displays a text expressed by the argument value "1020320413744104". As a result, "12ジウメダ" is displayed on the LCD 106*h*.

(11) The third argument is set in the variable A.

(12) Since the argument attribute information in the variable A has the value "20" that starts from 2 and that indicates sound output information, the program execution unit 601*c* instructs the sound output control unit 601*e* to output sounds using the third argument.

(13) Since the argument attribute information of the third argument indicates bell sound information, the sound output control unit 601*e* retrieves a sound pattern corresponding to the argument value "01" and outputs the sound pattern to the speaker 106*i*. As a result, the sound "beep beep" is outputted from the speaker 106*i*.

(14) The program ends.

The appearance of the radio pager when receiving the message information 1100*c* is shown in FIG. 35C.

With the present embodiment, the transmitter can specify how the radio pager of the receiver operates after receiving a message by including the program information into the message, and further specify how the program operates by including information for specifying the program operation into the message contents information in the message. Accordingly, the transmitter can specify sounds and vibrations to be outputted and change the operation in the radio pager easily by changing the information for specifying the program operation. Thus, the transmitter can make messages in greater flexibility.

Note that while the program information included in the message header information is a four-digit identifier of a fixed length in the present embodiment, the program information may be an identifier of a variable length. Also, the identifier may be expressed as a string or a code. The program information may instead be a list of a plurality of identifiers. Alternatively, the program information may include a program itself, so that the program execution unit can execute the program analyzed by the received data analysis unit.

While "*8" is used as the separator in the message information in the present embodiment, any other separators may be used or, if possible, the separator may be omitted.

While the argument attribute information in the message contents information has a two-digit value of a fixed length in the present embodiment, the value may be of a variable length. Also, the argument attribute information may be expressed as a string or a code. When the argument attribute information indicates information such as display animation information, display moving image information, melody sound information, or audio information, any data forms may be used for an argument value corresponding to each type of the argument attribute information.

While the message header information is placed at the head of the message information in the present embodiment, the message header information may instead be placed at the end of the message information.

While the programs stored in the program information storage unit are written in the programming language C in the present embodiment, the programs may be written in any other programming languages such as the assembler, Tcl, C++, PostScript, and Java. Alternatively, model templates of output messages may be used as the programs.

While the radio pager is described as an independent device in the present embodiment, the radio pager may be installed in a radio device, such as a PHS (Personal Handyphone System), a portable phone, or a PDA (Personal Digital Assistant).

While the sound output control unit and the vibration control unit each store combinations of identifiers and patterns and retrieve a pattern corresponding to an identifier included in an argument sent from the program execution unit in the present embodiment, the sound output control unit and the vibration control unit may instead receive the pattern itself from the program execution unit as argument information and output the pattern.

While the message header information is composed of the program information in the present embodiment, the message header information may also include transmitter information and transmission device type information.

Fifth Embodiment

Figure 36:
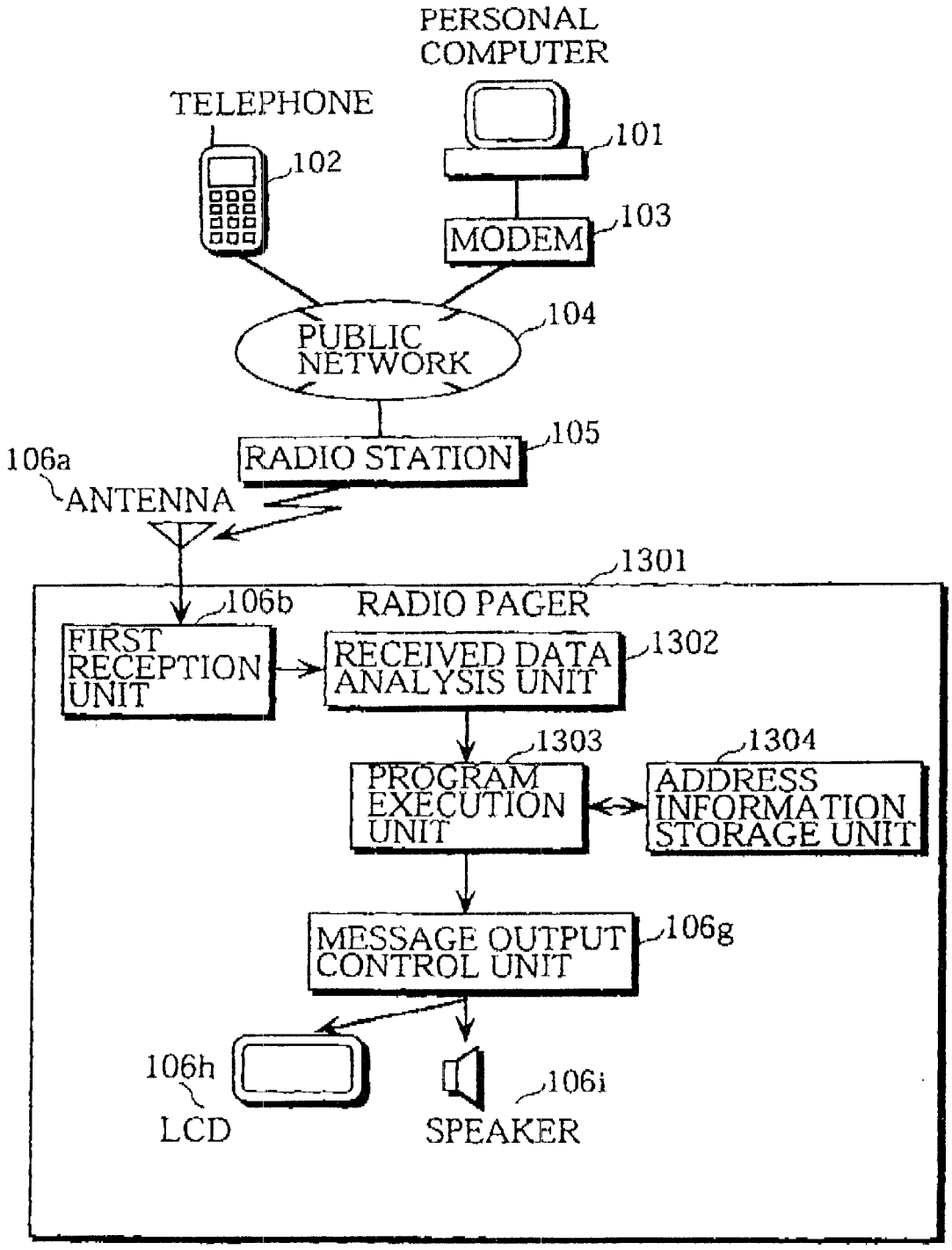
FIG. 36 is a block diagram showing an example of the general construction of the system that uses the radio pager of the fifth embodiment of the present invention.

FIG. 36 is a block diagram showing an example of the general construction of the system that uses the radio pager of the fifth embodiment of the present invention.

In the figure, a message inputted using the personal computer 101 is transmitted to a radio pager 1301 as a radio message via the modem 103, the public network 104, and the radio station 105. A message inputted using the telephone 102 is transmitted to the radio pager 1301 as a radio message via the public network 104 and the radio station 105. The personal computer 101, the telephone 102, the modem 103, the public network 104, and the radio station 105 are as described above and thus are not explained here.

The radio pager 1301 includes the antenna 106*a*, the first reception unit 106*b*, a received data analysis unit 1302, a program extraction unit 1303, an address information storage unit 1304, the message output control unit 106*g*, the LCD 106*h*, and the speaker 106*i*. The antenna 106*a*, the first reception unit 106*b*, the message output control unit 106*g*, the LCD 106*h*, and the speaker 106*i* are as described above and thus are not explained here.

The received data analysis unit 1302 analyzes a radio message sent from the first reception unit 106*b* and extracts message header information and message contents information (described later) from the analyzed message information. The received data analysis unit 1302 then extracts program information (described later) and an argument group respectively from the message header information and the message contents information.

Figure 37A:
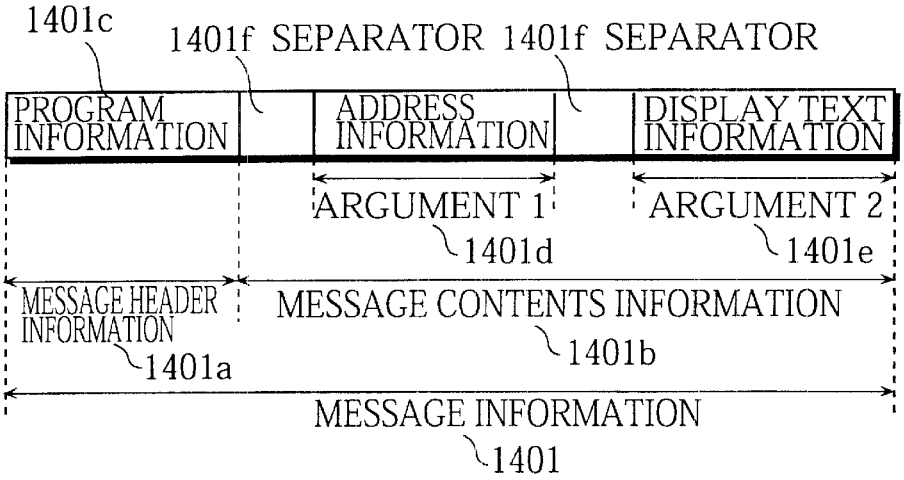
FIGS. 37A–37C show the construction of the message information included in a received radio message in the fifth embodiment.
Figure 37B:
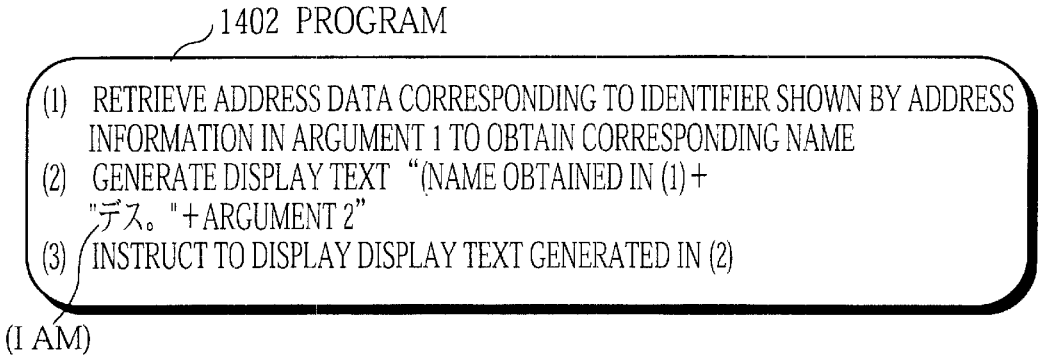
Figure 37C:
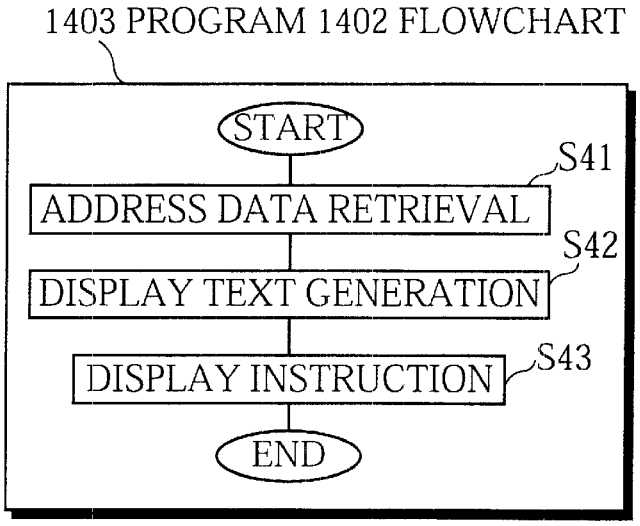

The construction of the message information is explained below with reference to FIG. 37.

In the figure, message information 1401 is composed of message header information 1401*a* and message contents information 1401*b*. The message header information 1401*a* is composed of program information 1401*c*. The message contents information 1401*b* is composed of argument 1 (1401*d*), argument 2 (1401*e*), and separators 1401*f*. Argument 1 (1401*d*) stores address information, while argument 2 (1401*e*) stores display text information. The program information 1401*c* stores a program, such as program 1402. The operation of program 1402 is explained here with reference to flowchart 1403. The operation proceeds in numerical order.

(1) Retrieve address data stored in the radio pager that corresponds to an identifier shown by the address information in argument 1 in order to obtain a name.

(2) Generate a display text "(name obtained in (1))+ 'ﾃﾞｽ｡'+(display text of argument 2)" using the name obtained in (1).

(3) Instruct to display the display text generated in (2).

(4) Program ends.

An example program written in the programming language Tcl is shown below as a specific example of program 1402. Each comment is given the code #.

Retrieve address data and store it in a variable name.

Note that argument 1 is stored in a variable arg1info.

set name[getaddrname$arg1info]

Generate a display text.

Note that the generated display text is stored in a variable disptxt.

Note that argument 2 is stored in a variable arg2info.

Note that a display text of message contents 2 information is stored.

set disptxt[join[list $name"ﾃﾞｽ｡"$arg2info]""]

Instruct to display.

execdisp $disptxt (End)

The program execution unit 1303 executes the program included in the program information 1401*c* using the program information 1401*c* and the information in the message contents information 1401 which were analyzed in the received data analysis unit 1302.

The address information storage unit 1304 stores each set of an identifier, a name, and a telephone number in a conceptual form as shown in FIG. 38.

The following is an explanation of the specific operation of the radio pager of the fifth embodiment with the above construction. Here, the case is explained when the radio pager receives a radio message from the radio station 105, the radio message including message information shown in FIG. 39 which is sent from the personal computer 101.

First, FIG. 39 is briefly explained.

In the figure, field 1601 shows program information which stores program 1402. Field 1602 shows a separator with the value "*8". Field 1603 shows address information which stores an identifier "001". Field 1604 shows display text information with the value "1020320413744104" in the free word form. In the free words, "10" indicates "1", "20" indicates "2", "32" indicates "ｼﾞ", "04" indicates "ｳﾞ", "13" indicates "ｳ", "74" indicates "ﾒ", and "41" indicates "ﾀ", so that "1020320413744104" indicates "ｼﾞｳﾒﾀﾞ".

The following is an explanation of the operation when receiving the radio message which includes the message information 1600 shown in FIG. 39. The operation proceeds in numerical order. The information shown in FIG. 38 is stored in the address information storage unit 1304 in advance.

(1) The radio pager maintains a reception waiting state.

(2) The first reception unit 106*b* receives the radio message via the antenna 106*a*.

(3) The first reception unit 106*b* judges whether the radio message received in (2) is for the radio pager 1301. If the message is not for the radio pager 1301, the operation returns to (1). Otherwise, the operation proceeds to (4).

(4) The received data analysis unit 1302 analyzes the radio message and extracts the message information 1600. The received data analysis unit 1302 then extracts message header information and message contents information from the message information 1600. The received data analysis unit 1302 further extracts program information and an argument group respectively from the message header information and the message contents information. As a result, program 1402 as the program information, argument 1 with the value "001", and argument 2 with the value "1020320413744104" are extracted.

(5) The program execution unit 1303 obtains arguments 1 and 2 extracted in (4) and starts the execution of program 1402 extracted in (4).

(6) The program execution unit 1303 searches the address information storage unit 1304 with reference to the value "001" of argument 1 and retrieves a corresponding name "ｽ｡" (ITO TARO).

(7) The program execution unit 1303 generates a display text "ﾃﾞｽ｡12ｼﾞｳﾒﾀﾞ" (ITO TARO. 12:00, UMEDA) using "ｽ｡" retrieved in (6) and the value of argument 2 "1020320413744104 (12ｼﾞｳﾒﾀﾞ)", and instructs the message output control unit 106*g* to display the display text.

(8) The message output control unit 106*g* has the LCD 106*h* display "ﾃﾞｽ｡12ｼﾞｳﾒﾀﾞ".

The appearance of the radio pager when receiving the message information 1600 is shown in FIG. 40.

With the present embodiment, the transmitter can specify program information that instructs the receiver to retrieve address data stored in the radio pager and display a message using the retrieved address data. In other words, the transmitter can send the program information that relates to the data stored in the radio pager by including the program information in the message information. Accordingly, the display message is generated by combining a message transmitted by the transmitter and the data stored in the radio pager, so that the transmitter does not need to make the whole display message. Thus, the transmitter can make and transmit messages more easily.

While the program stored in the program information in the message header information is written in the programming language Tcl in the present embodiment, the program may be written in any other programming languages such as the assembler, C, C++, PostScript, and Java. Alternatively, a model template of output messages may be used as the program.

While "*8" is used as the separator in the message information in the present embodiment, any other separators may be used or, if possible, the separator may be omitted.

While the address information of the argument in the message contents information has a three-digit identifier of a fixed length in the present embodiment, the identifier may be of a variable length. Also, the identifier may be expressed as a string or a code. While the free word form is used to express the display text information in the present embodiment, any other data forms for expressing text information may be used.

While the message header information is placed at the head of the message information in the present embodiment, the message header information may instead be placed at the end of the message information.

While the message header information is composed of the program information in the present embodiment, the message header information may also include transmitter information and transmission device type information.

Address data which the radio pager possesses in advance may be used as the address data in the address information storage unit.

While the radio pager is described as an independent device in the present embodiment, the radio pager may be installed in a radio device, such as a PHS (Personal Handyphone System), a portable phone, or a PDA (Personal Digital Assistant).

Sixth Embodiment

Figure 41:
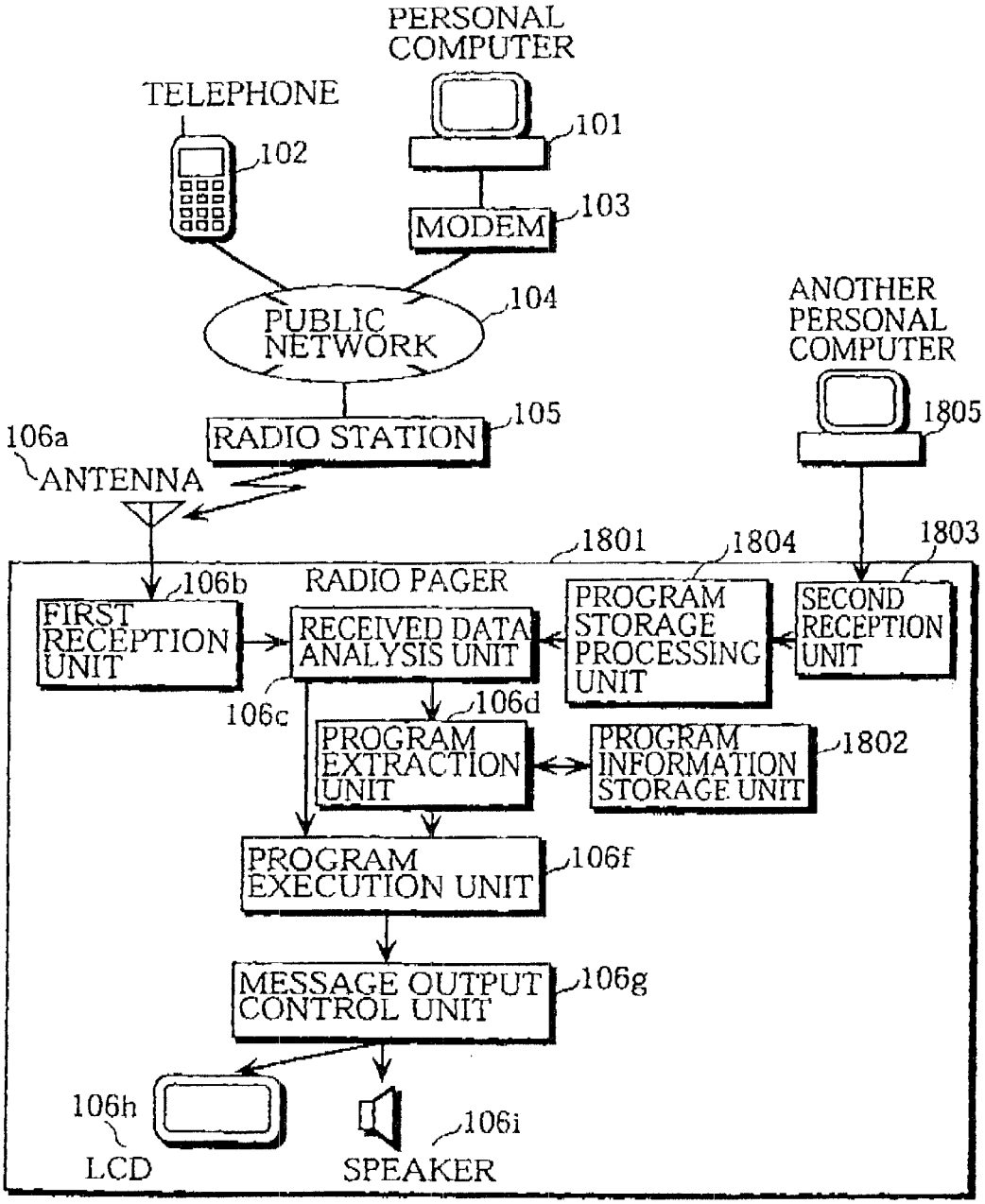
FIG. 41 is a block diagram showing an example of the general construction of the system that uses the radio pager of the sixth embodiment of the present invention.

FIG. 41 is a block diagram showing an example of the general construction of the system that uses the radio pager of the sixth embodiment of the present invention.

In the figure, a message inputted using the personal computer 101 is transmitted to a radio pager 1801 as a radio message via the modem 103, the public network 104, and the radio station 105. A message inputted using the telephone 102 is transmitted to the radio pager 1801 as a radio message via the public network 104 and the radio station 105. The personal computer 101, the telephone 102, the modem 103, the public network 104, and the radio station 105 are as described above and thus are not explained here.

The radio pager 1801 includes the antenna 106*a*, the first reception unit 106*b*, the received data analysis unit 106*c*, the program extraction unit 106*d*, a program information storage unit 1802, a second reception unit 1803, a program storage processing unit 1804, the program execution unit 106*f*, the message output control unit 106*g*, the LCD 106*h*, and the speaker 106*i*. The radio pager 1801 is connected to another personal computer 1805 by wire. The antenna 106*a*, the first reception unit 106*b*, the program extraction unit 106*d*, the program execution unit 106*f*, the message output control unit 106*g*, the LCD 106*h*, and the speaker 106*i* are as described above and thus are not explained here.

Figure 42:
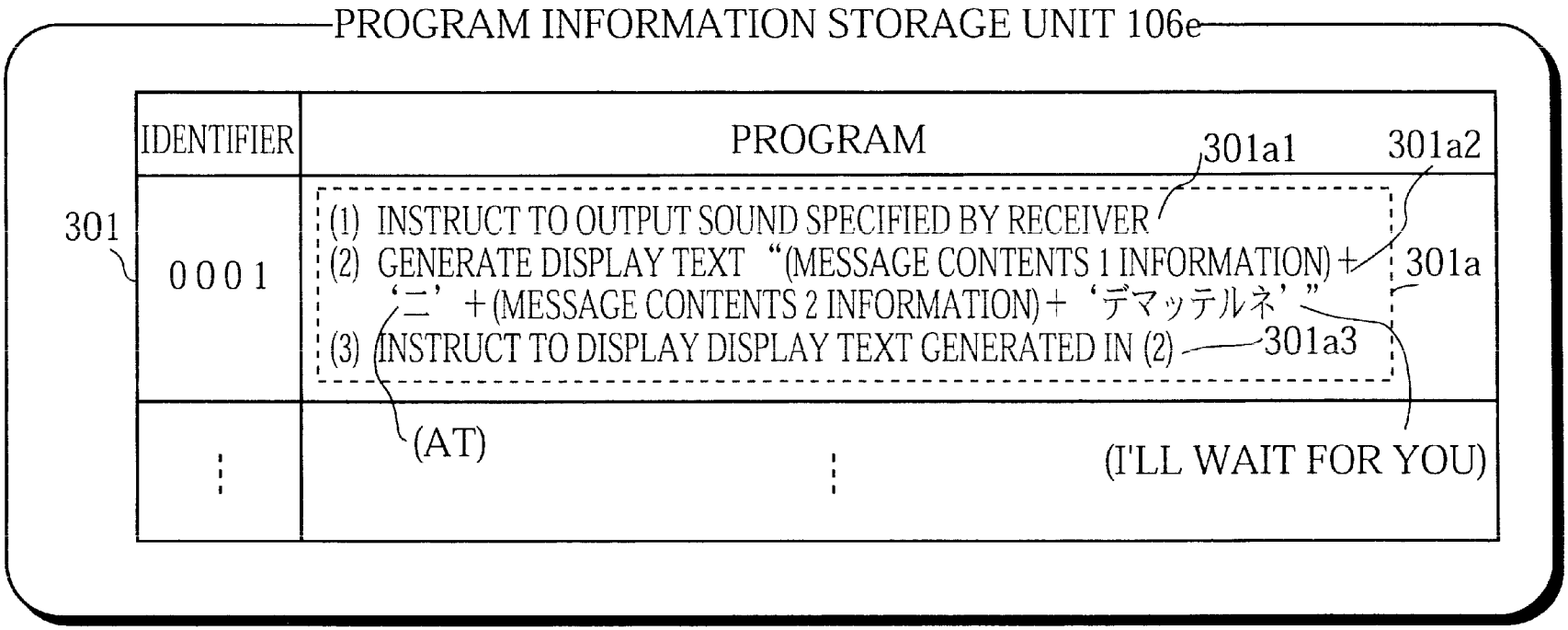
FIG. 42 is a schematic diagram showing information stored in the program information storage unit of the sixth embodiment.

The program information storage unit 1802 stores each combination of an identifier and a program in a conceptual form shown in FIG. 42.

In the figure, a combination 301 shows that program 301*a* has an identifier 0001. Program 301*a* is composed of sub programs 301*a*1, 301*a*2, and 301*a*3. Program 301*a* and sub programs 301*a*1–301*a*3 are as described above.

Figure 43:
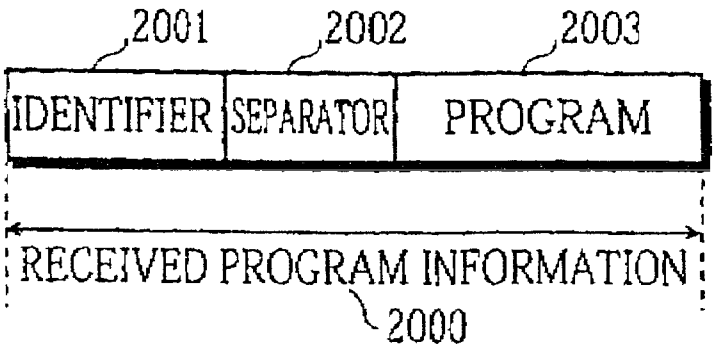
FIG. 43 shows the construction of the program information received by the second reception unit of the sixth embodiment.

The second reception unit 1803 receives program information shown in FIG. 43 from the personal computer 1805.

In FIG. 43, program information 2000 is composed of an identifier 2001, a separator 2002, and a program 2003.

The program storage processing unit 1804 analyzes the program information received by the second reception unit 1803 and stores the analyzed program information into the program information storage unit 1802.

The following is an explanation of the specific operation of the radio pager of the sixth embodiment of the present invention with the above construction. Here, the operation of receiving program information 2100 shown in FIG. 44 which precedes the operation of receiving a radio message is explained.

Figure 44:
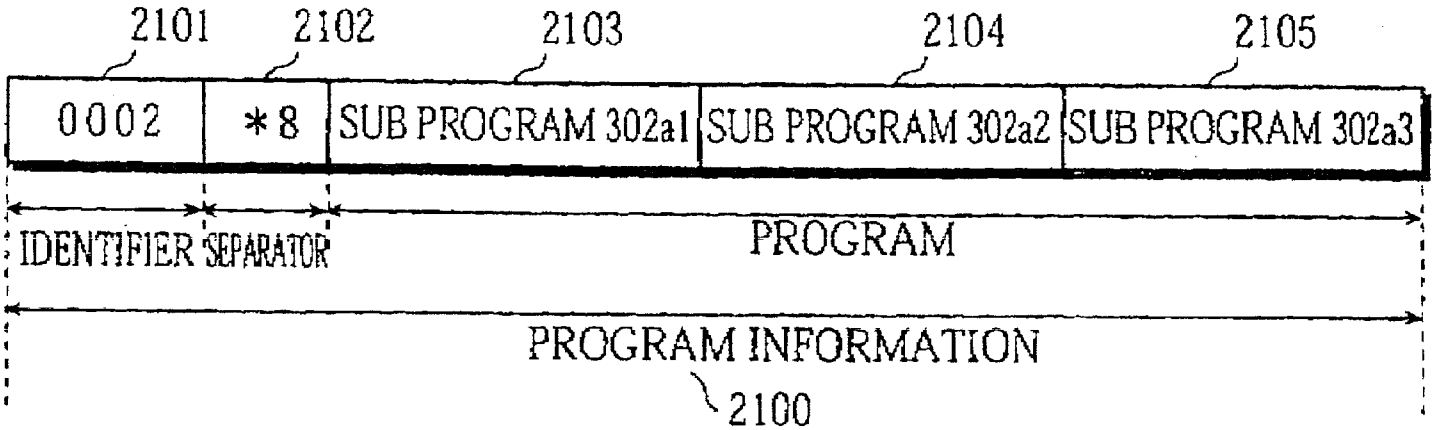
FIG. 44 shows a specific example of the program information in the sixth embodiment.

First, FIG. 44 is briefly explained below. An identifier 2101 has the value "0002". A separator 2102 has the value "*8". A sub program 2103 shows sub program 302*a*1. A sub program 2104 shows sub program 302*a*2. A sub program 2105 shows sub program 302*a*3. The sub programs 2103–2105 compose a program. Sub programs 302*a*1–302*a*3 are as described above.

The following is an explanation of the operation of receiving the program information shown in FIG. 44. The operation proceeds in numerical order. The information shown in FIG. 42 explained above is stored in the program information storage unit 1802 in advance.

(1) The radio pager 106 maintains a reception waiting state.

(2) The second reception unit 1803 receives the program information 2100 from the personal computer 1805 by wire.

(3) The program storage processing unit 1804 analyzes the program information 2100 received by the second reception unit 1803 and extracts the identifier "0002" and the program that is composed of "sub program 302*a*1, sub program 302*a*2, and sub program 302*a*3".

(4) The program storage processing unit 1804 stores the extraction result into the program information storage unit 1802.

(5) The operation returns to (1).

FIG. 26 shows the result of storing the program information 2100 in the program information storage unit 1802. FIG. 26 is as described above and thus is not explained here.

With the present embodiment, the receiver receives and downloads program information, so that the transmitter can make messages in greater flexibility. In download processing, a new program can be added by using a new program identifier, while an existing program can be changed to the new program by using an existing program identifier. Also, the existing program can be deleted by storing an invalid program using the existing program identifier.

While each program has a four-digit identifier of a fixed length in the present embodiment, the identifier may be of a variable length. Also, the identifier may be expressed as a string or a code.

While "*8" is used as a separator in the message information in the present embodiment, any other separators may be used or, if possible, the separator may be omitted.

While the identifier is placed at the head of the program information in the present embodiment, the identifier may instead be placed at the end of the program information.

While the program is written in the conceptual form in the present embodiment, the program may be written in any programming languages such as the assembler, C, C++, Tcl, PostScript, and Java. Alternatively, a model template of output messages may be used as the program.

While the second reception unit and another personal computer are connected by wire in the present embodiment, they may be connected by radio.

Seventh Embodiment

Figure 45:
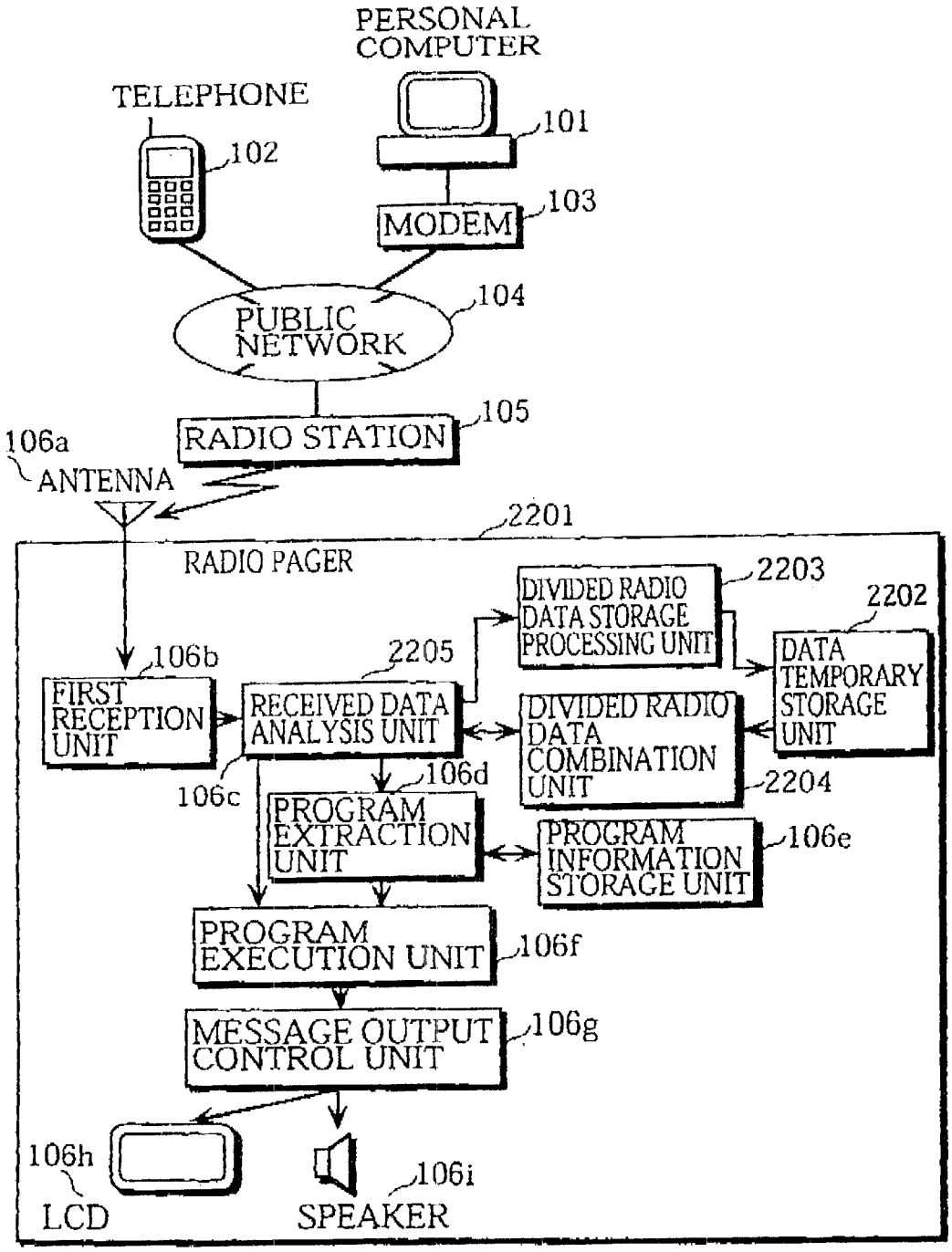
FIG. 45 is a block diagram showing an example of the general construction of the system that uses the radio pager of the seventh embodiment of the present invention.

FIG. 45 is a block diagram showing an example of the general construction of the system that uses the radio pager of the seventh embodiment of the present invention.

In the figure, a message inputted using the personal computer 101 is transmitted to a radio pager 2201 as a radio message via the modem 103, the public network 104, and the radio station 105. A message inputted using the telephone 102 is transmitted to the radio pager 2201 as a radio message via the public network 104 and the radio station 105. The personal computer 101, the telephone 102, the modem 103, the public network 104, and the radio station 105 are as described above and thus are not explained here.

The radio pager 2201 includes the antenna 106*a*, the first reception unit 106*b*, a data temporary storage unit 2202, a divided radio data storage processing unit 2203, a divided radio data combination unit 2204, a received data analysis unit 2205, the program execution unit 106*f*, the program information storage unit 106*e*, the program execution unit 106*f*, the message output control unit 106*g*, the LCD 106*h*, and the speaker 106*i*. The antenna 106*a*, the first reception unit 106*b*, the program extraction unit 106*d*, the program information storage unit 106*e*, the program execution unit 106*f*, the message output control unit 106*g*, the LCD 106*h*, and the speaker 106*i* are as described above and thus are not explained here.

The data temporary storage unit 2202 temporarily stores message information of a received radio message.

The divided radio data storage processing unit 2203 performs processing of temporarily storing the message information into the data temporary storage unit 2202.

The divided radio data combination unit 2204 obtains the message information stored in the data temporary storage unit 2202 and combines the divided message information into a set of message information.

The received data analysis unit 2205 extracts message information from a received radio message and refers to division information in the message information to judge whether the message information is divided message information and, if so, whether it is the last divided message information. If the message information is divided message information but not the last divided message information, the received data analysis unit 2205 instructs the divided radio data storage processing unit 2203 to store the message information. If, on the other hand, the message information is the last divided message information, the received data analysis unit 2205 sends the message information to the divided radio data combination unit 2204 and instructs the divided radio data combination unit 2204 to combine divided message information.

Figure 25:
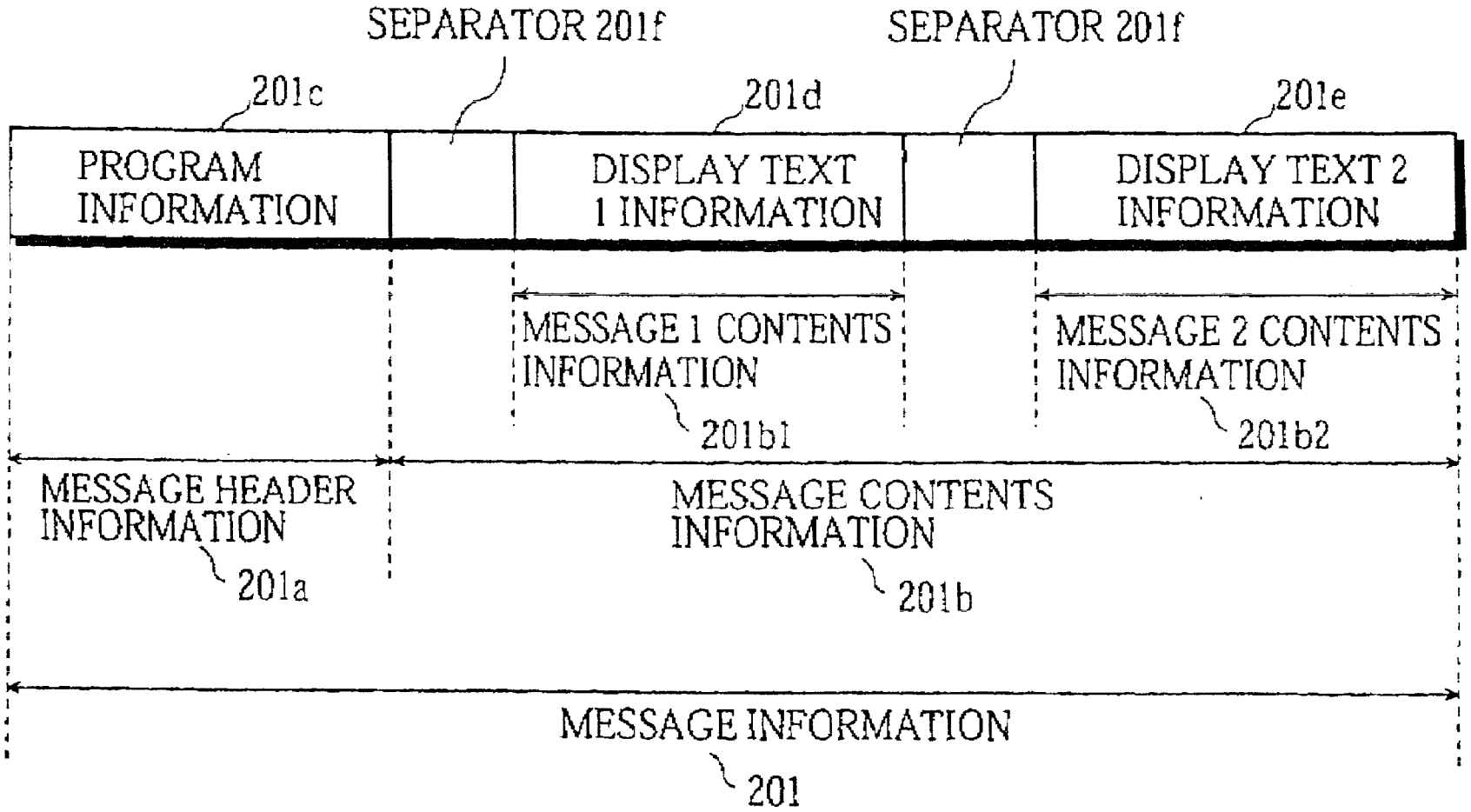
FIG. 25 shows the construction of the message information included in a received radio message in the third embodiment.
Figure 46A:
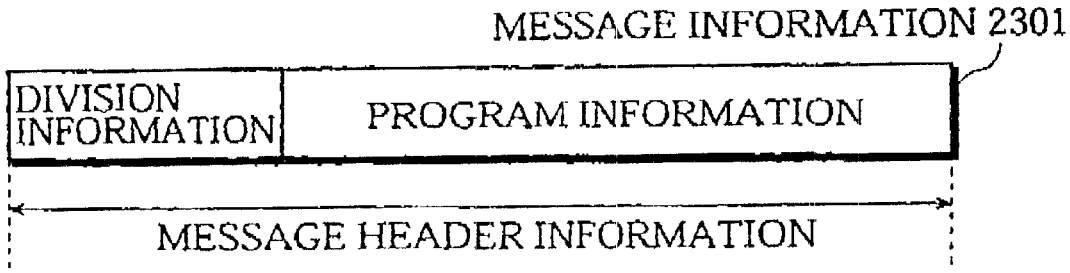
FIGS. 46A–46C each show the construction of the divided message information in the seventh embodiment.
Figure 46B:
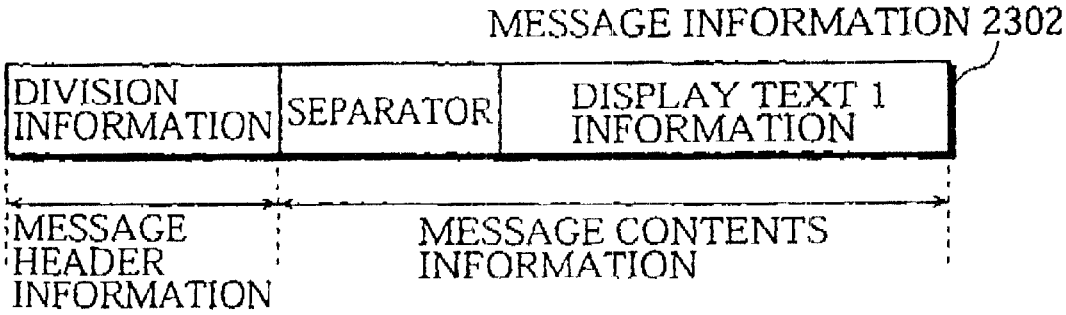
Figure 46C:
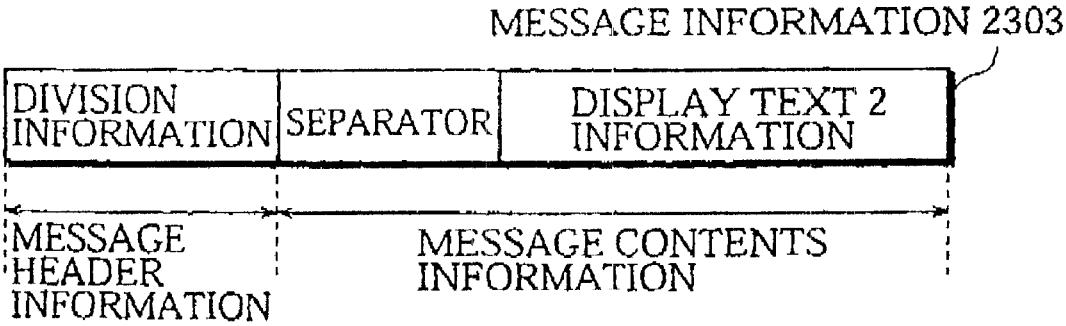

FIG. 46 shows a specific example of divided message information when dividing the message information shown in FIG. 25. The message information 201 shown in FIG. 25 is divided into message information 2301, message information 2302, and message information 2303 in FIG. 46. Division information is included at each head of the message information 2301–2303 as message header information.

The following is an explanation of the specific operation of the radio pager of the seventh embodiment of the present invention with the above construction. Here, the operation of the received data analysis unit 2205 is explained when successively receiving three radio messages which respectively store message information 2401, message information 2402, and message information 2403 shown in FIG. 47.

Figure 47:
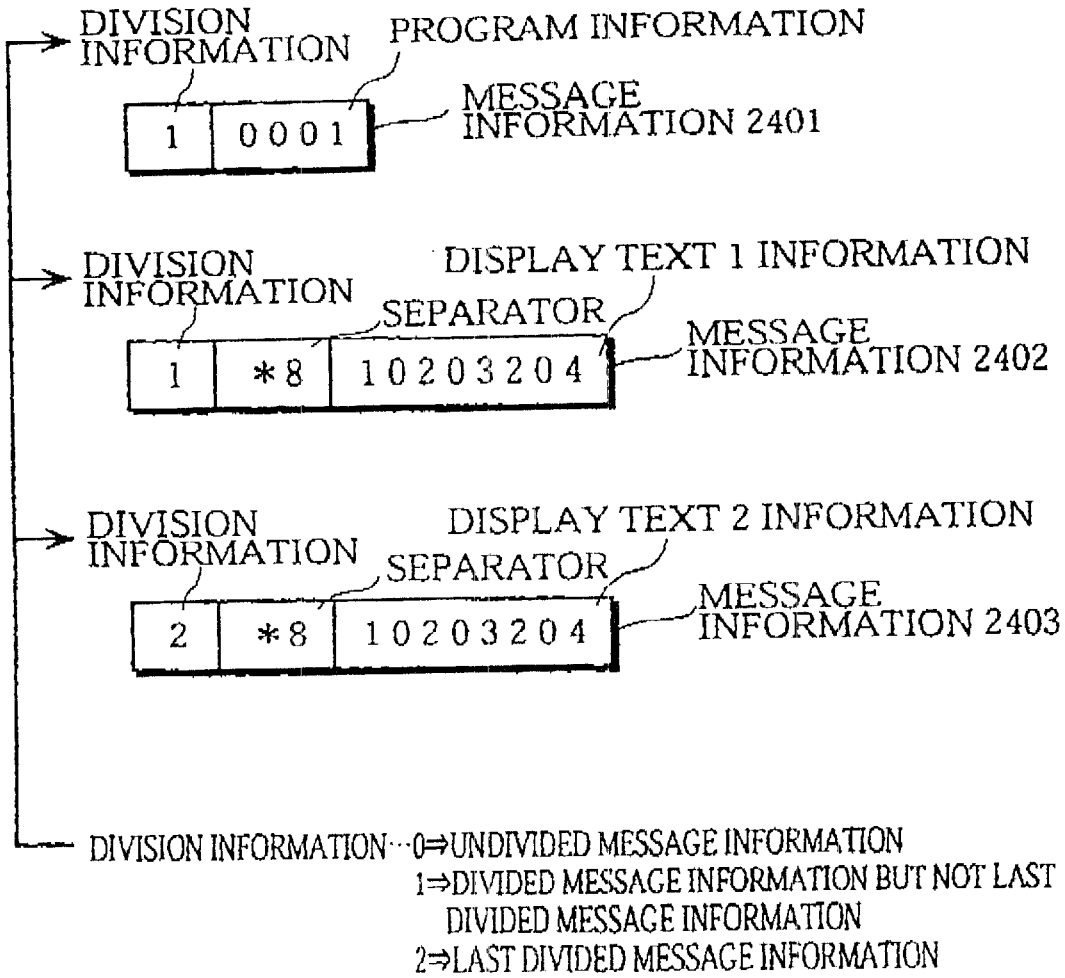
FIG. 47 shows a specific example of the divided message information in the seventh embodiment.

First, FIG. 47 is briefly explained. The message information 2401 stores division information "1" and program information "0001". The message information 2402 stores division information "1", a separator "*8", and display text 1 information "10203204 (12ジ" in the free word form. The message information 2403 stores division information "2", a separator "*8", and display text 2 information "13744104 (ウメダ)" in the free word form. Division information "0" shows that the message information is not divided message information, divided information "1" shows that the message information is divided message information but not the last divided message information, division information "2" shows that the message information is the last divided message information.

The following is an explanation of the operation of the received data analysis unit 2205 when receiving the message information 2401, the message information 2402, and the message information 2403 shown in FIG. 47. The operation proceeds in numerical order. The information shown in FIG. 26 is stored in the program information storage unit 106*e* in advance. FIG. 26 is as described above.

(1) The radio pager 2201 maintains a reception waiting state.

(2) The first reception unit 106*b* receives a radio message via the antenna 106*a*.

(3) The first reception unit 106*b* judges whether the radio message received in (2) is for the radio pager 2201. If the message is not for the radio pager 2201, the operation returns to (1). Otherwise, the operation proceeds to (4).

(4) The received data analysis unit 2205 analyzes the radio message, extracts the message information 2401 from the radio message, and extracts division information from the message information 2401. Since the division information is "1", the received data analysis unit 2205 sends the message information 2401 to the divided radio data storage processing unit 2203.

(5) The divided radio data storage processing unit 2203 stores the message information 2401 received in (4) into the data temporary storage unit 2202.

(6) The radio pager 2201 maintains a reception waiting state.

(7) The first reception unit 106*b* receives a radio message via the antenna 106*a*.

(8) The first reception unit 106*b* judges whether the radio message received in (7) is for the radio pager 2201. If the message is not for the radio pager 2201, the operation returns to (6). Otherwise, the operation proceeds to (9).

(9) The received data analysis unit 2205 analyzes the radio message, extracts the message information 2402 from the radio message, and extracts division information from the message information 2402. Since the division information is "1", the received data analysis unit 2205 sends the message information 2402 to the divided radio data storage processing unit 2203.

(10) The divided radio data storage processing unit 2203 stores the message information 2402 received in (9) into the data temporary storage unit 2202.

(11) The radio pager 2201 maintains a reception waiting state.

(12) The first reception unit 106*b* receives a radio message via the antenna 106*a*.

(13) The first reception unit 106*b* judges whether the radio message received in (12) is for the radio pager 2201. If the message is not for the radio pager 2201, the operation returns to (11). Otherwise, the operation proceeds to (14).

(14) The received data analysis unit 2205 analyzes the radio message, extracts the message information 2403 from the radio message, and extracts division information from the message information 2403. Since the division information is "2", the received data analysis unit 2205 sends the message information 2403 to the divided radio data combination unit 2204 and instructs the divided radio data combination unit 2204 to combine the divided message information.

Figure 48:
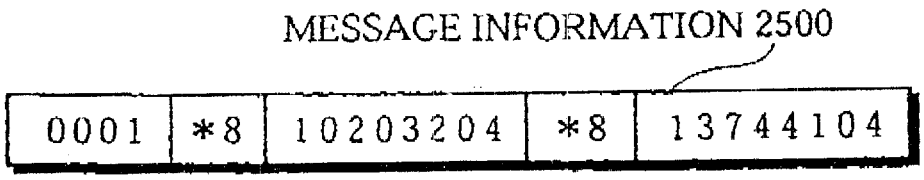
FIG. 48 shows the message information obtained by combining the divided message information in the seventh embodiment.

(15) The divided radio data combination unit 2204 extracts the message information 2401 and the message information 2402 stored in the data temporary storage unit 2202 and combines the message information 2401, the message information 2402, and the message information 2403. As a result, message information 2500 shown in FIG. 48 is generated and sent to the received data analysis unit 2205.

(16) The received data analysis unit 2205 extracts message header information and message contents information from the message information 2500 received in (15). The received data to analysis unit 2505 then extracts program information from the message header information and extracts message contents 1 information and message contents 2 information from the message contents information. As a result, the program information "0001", the message contents 1 information "10203204 (12)ジ", and the message contents 2 information "13744104 (ウメダ)" are extracted.

(17) The program extraction unit 106*d* extracts a program stored in the program information storage unit 106*e* in accordance with the program information "0001" extracted in (16). As a result, sub program 301*a* is extracted.

(18) The program execution unit 106*f* obtains the message contents 1 information and the message contents 2 information extracted in (16) and starts the execution of the program extracted in (17).

(19) The program execution unit 106*f* executes sub program 301*a* and instructs the message output control unit 106*g* to output the sound specified by the receiver.

(20) The message output control unit 106*g* has the speaker 106*i* output the sound specified by the receiver.

(21) The program execution unit 106*f* executes sub program 301*a* and generates a display text "12デマッテルネ" using the message contents 1 information "10203204 (12ジ)" and the message contents 2 information "13744104 (ウメダ)". The program execution unit 106*f* then instructs the message output control unit 106*g* to display the display text.

(22) The message output control unit 106*g* has the LCD 106*h* display the display text generated in (21).

(23) The operation returns to (1).

With the present embodiment, it is possible to send a message of a large size by dividing the contents of the message and sending each divided part, so that messages of various sizes can be sent. Thus, the transmitter can make a wide variety of messages in greater flexibility.

While the program has a four-digit identifier of a fixed length in the present embodiment, the identifier may be of a variable length. Also, the identifier may be expressed as a string or a code.

While "*8" is used as a separator in the message information in the present embodiment, any other separators may be used or, if possible, the separator may be omitted.

While the division information is placed at the head of the message information in the present embodiment, the division information may instead be placed at the end of the program information. While the division information is expressed as a one-digit value of a fixed length in the present embodiment, the division information may be of a variable length or may be expressed as a string or a code.

While the division information shows whether the message information is the last divided message information in the present embodiment, the division information may instead specify the number "n", wherein the message information is the "n"th divided message information.

While the program is written in the conceptual form in the present embodiment, the program may be written in any programming languages such as the assembler, C, C++, Tcl, PostScript, and Java. Alternatively, a model template of output messages may be used as the program.

While the free word form is used to express the display text 1 information and the display text 2 information included in the message contents information in the present embodiment, any other data forms for expressing text information may be used.

While the message header information is composed of the division information in the present embodiment, the message header information may also include transmitter information and transmission device type information.

While the radio pager is described as an independent device in the present embodiment, the radio pager may be installed in a mobile device, such as a PHS (Personal Handyphone System), a portable phone, or a PDA (Personal Digital Assistant). If the radio pager is installed in the PHS, for instance, radio messages can be transmitted and received in a one-to-one basis between each radio pager using a transceiver mode of the PHS.

The eighth embodiment is explained next where the control information stored in the storage means relates to event information.

Eighth Embodiment

Figure 49:
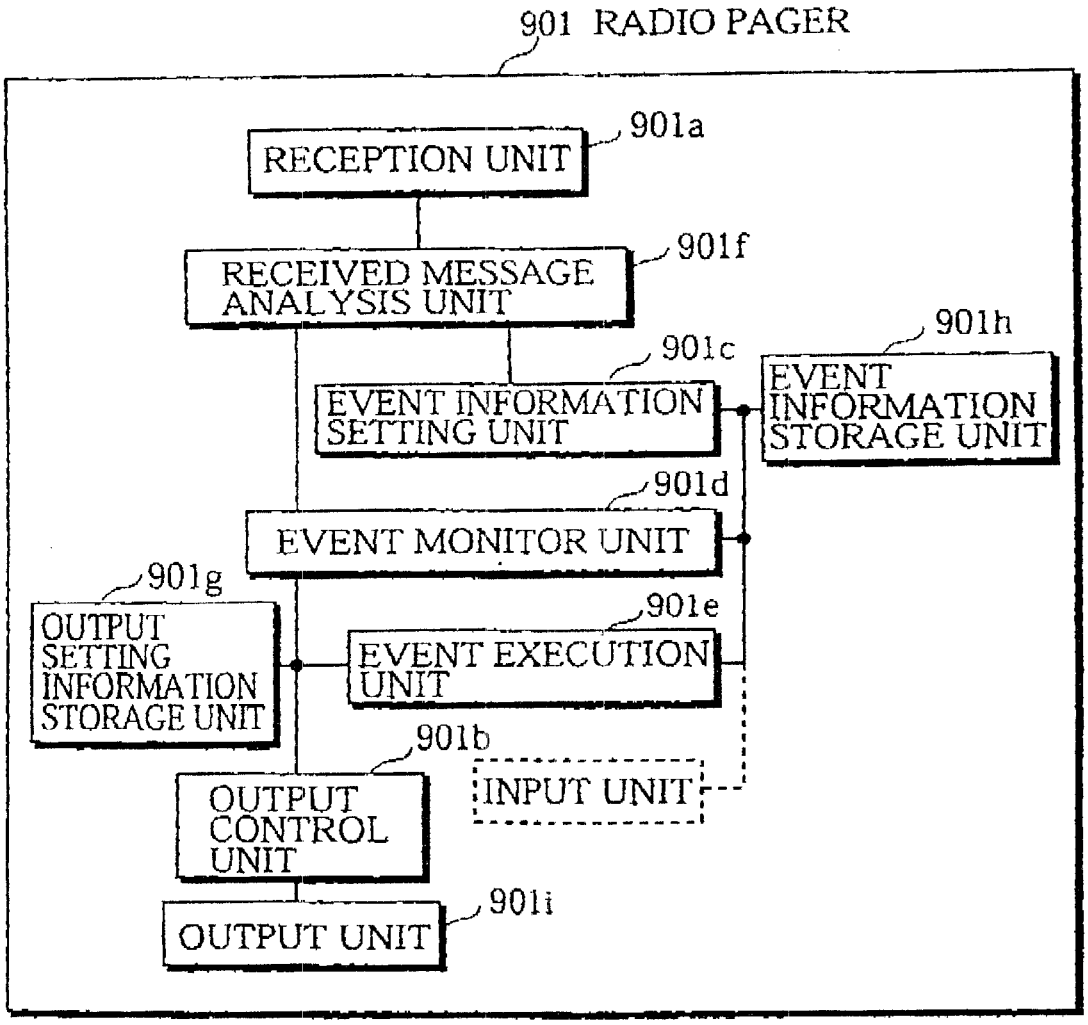
FIG. 49 is a block diagram showing the radio pager of the eighth embodiment of the present invention.

FIG. 49 is a block diagram showing the radio pager of the eighth embodiment of the present invention.

A reception unit 901*a* receives a message via an antenna (not illustrated).

An event information storage unit 901*b* stores event instruction information that is composed of event condition information showing an event that leads to execute control and event execution contents information showing the contents of the control to be executed when the event shown by the event condition information occurs.

An event information setting unit 901*c* executes registration and deletion of the event instruction information in the event information storage unit 901*b*.

An event monitor unit 901*d* monitors received messages and a timer to detect the occurrence of the event shown by the event condition information stored in the event information storage unit 901*b*. Note that the event monitor unit 901*e* does not need to constantly monitor but monitors whether the event occurs only when a message is received or when a timer is set.

When the event occurs, an event execution unit 901*e* executes the control shown by the event execution contents information that corresponds to the event.

A received message analysis unit 901*f* shifts the operation to the event information setting unit 901*c* if a received message is not an output message but a message for executing internal processing. Otherwise, the received message analysis unit 901*f* shifts the operation to the event monitor unit 901*d*.

An output setting information storage unit 901*g* stores output setting information for output control to be executed when receiving a message and renews the output setting information according to instructions from the event execution unit 901*e*. Also, the output setting information storage unit 901*g* has a buffer (not illustrated) for temporarily storing radio messages which are in an event occurrence waiting state.

The output control unit 901*h* performs the output control including sound output control, vibration control, LED (light-emitting diode) control, and display control. This output control is performed according to the output setting information stored in the output setting information storage unit 901*g* when a message is received and when the event execution unit 901*e* instructs the output control unit 901*h* to perform the output control.

The output unit 901*i* is composed of a speaker, a vibrator, an LED, and a display that are controlled by the output control unit 901*h*.

Figure 50:
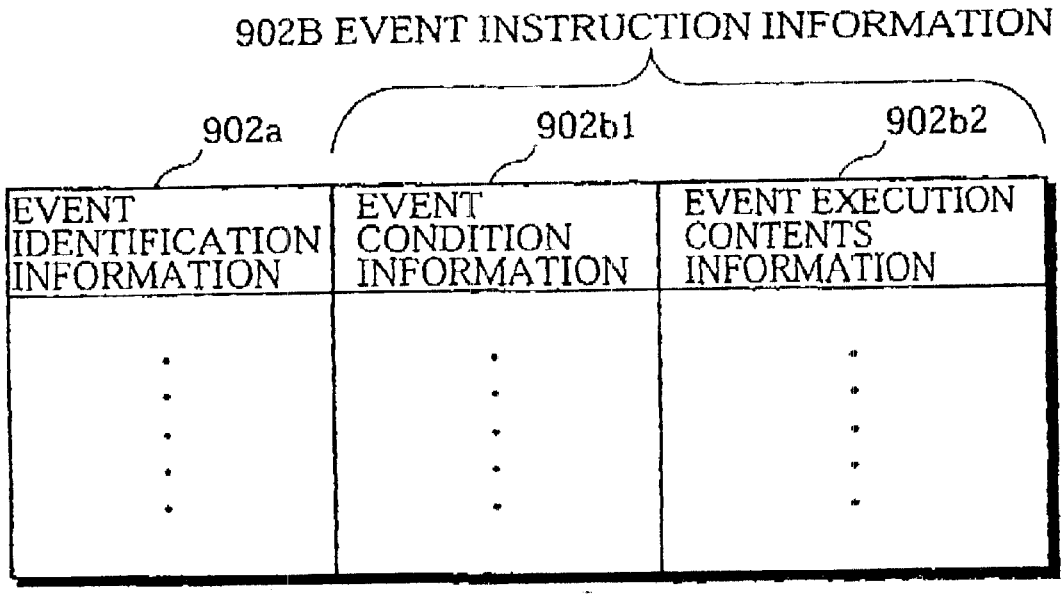
FIG. 50 shows the structure of the event information stored in the event information storage unit of the eighth embodiment.

FIG. 50 shows the construction of the event information stored in the event information storage unit 901*b* shown in FIG. 49. The event information is composed of a combination of event instruction information 902*b* and event identification information 902*a* which identifies the event instruction information 902*b*, the event instruction information 902*b* being composed of event condition information 902*b*1 for showing an event which leads to execute the control and event execution contents information 902*b*2 for showing the contents of the control to be executed when the event shown by the event condition information 902*b*1 occurs.

Figure 51:
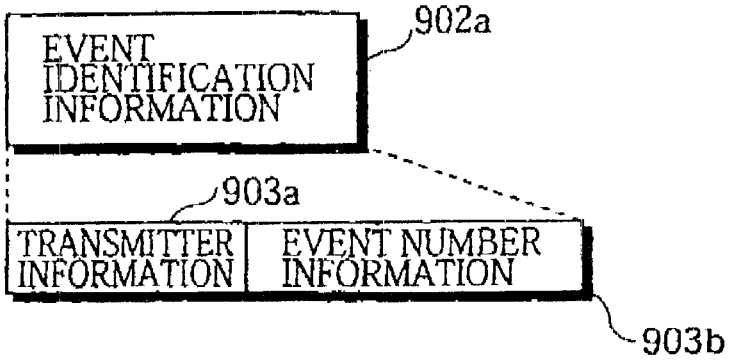
FIG. 51 shows the structure of the event identification information in the eighth embodiment.

FIG. 51 shows the construction of the event identification information 902*a* shown in FIG. 50.

The event identification information 902*a* includes transmitter information 903*a* for showing a registrant of the event instruction information 902*b* and event number information 903*b* which is set individually via a transmitter's terminal.

Note that when the radio pager 901 itself registers the event instruction information 902*b* via a connected terminal, the transmitter information 903*a* shows the radio pager 901 as the registrant. Which is to say, the transmitter information 903*a* of the radio pager 901 itself is given in the event identification information 903*a*. Here, the transmitter information 903*a* is an ID for identifying the transmitter.

Figure 52A:
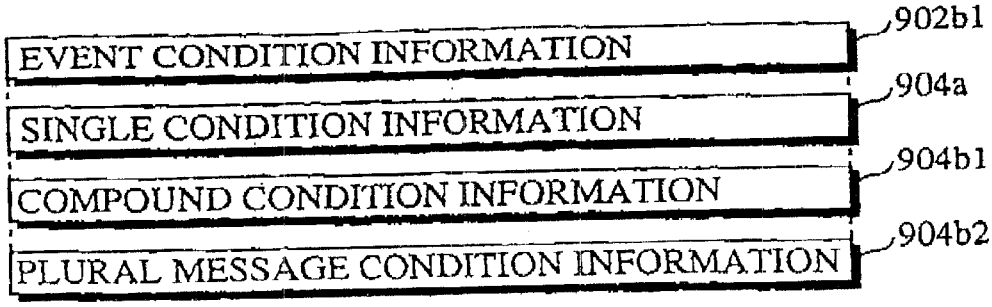
FIGS. 52A–52C show the structure of the event condition information in the eighth embodiment.
Figure 52B:
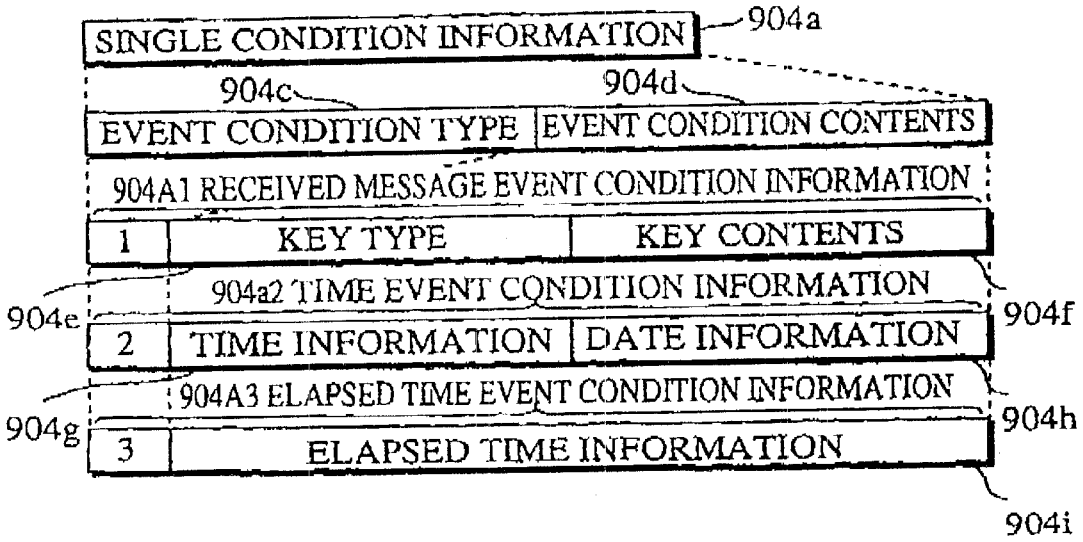
Figure 52C:
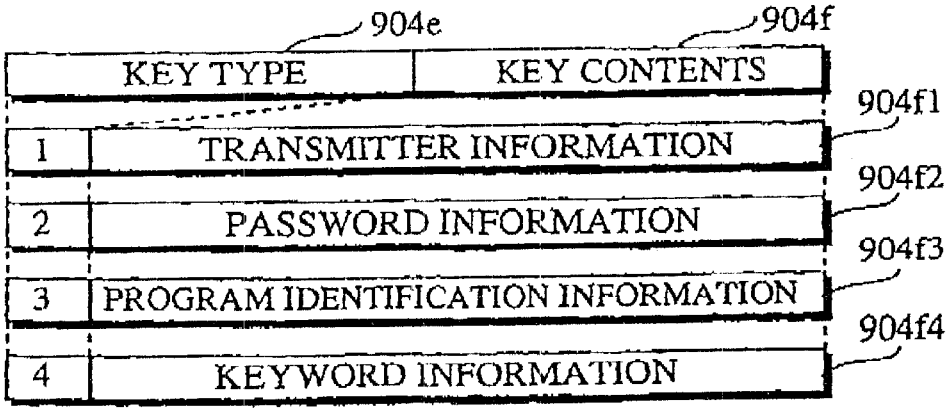

FIG. 52 shows the construction of the event condition information 902*b*1 shown in FIG. 50.

The event condition information 902*b*1 shows an event which leads to execution of the control. There are three types of event condition information that are single condition information 904*a*, compound condition information 904*b*1, and plural message condition information 904*b*2.

The single condition information 904*a* includes an event condition type 904*c* and event condition contents 904*d*. Conditions of the event occurrence specified by the single condition information 904*a* are generally classified into a message reception, a coming of a time, and a lapse of time.

When the event condition type 904*c* is "1", it indicates received message event condition information 904*a*1 showing that an event occurs according to key information in a received message. The event condition contents 904*d* corresponding to the event condition type 904*c* "1" includes a key type 904*e* and key contents 904*f*. When the key type 904*e* is "1", the key contents 904*f* show transmitter information 904*f*1. When the key type 904*e* is "2", the key contents 904*f* show password information 904*f*2. When the key type 904*e* is "3", the key contents 904*f* show program identification information 904*f*3. When the key type 904*e* is "4", the key contents 904*f* show keyword information 904*f*4. The program identification information 904*f*3 is a program ID for identifying a program stored in the event information storage unit 901*b*. The keyword information 904*f*4 specifies a given code string. When the keyword information 904*f*4 specifies "オオサカ" (OSAKA), for example, an event condition is satisfied if the received message includes codes showing "オオサカ".

When the event condition type 904*c* is "2", it indicates time event condition information 904*a*2 showing that an event occurs at a certain time. The event condition contents 904*d* corresponding to the event condition type 904*c* "2" includes time information 904*g* and date information 904*h*. For example, when the time information 904*g* is "1230" and the date information 904*h* is "0710", the time shown by the event condition contents 904*d* is 12:30 on July 10th.

When the event condition type 904*c* is "3", it indicates elapsed time event condition information 904*a*3 showing that an event occurs after a specified period of time elapses since receiving a message. The event condition contents 904*d* corresponding to the event condition type 904*c* "3" include elapsed time information 904*i* that specifies a period of time from the message reception to the event occurrence. For example, when the elapsed time information 904*i* is "0130", the specified period of time is 1.5 hours after the message reception.

The compound condition information 904*b*1 is expressed as a formula in which the single condition information 904*a* is used as a term along with operators such as AND "*", OR "+", NOT "!", and delimiters "(" and ")". For instance, when the compound condition information is a logical OR of two sets of event condition information "event condition 1" and "event condition 2", the compound condition information is expressed as "(event condition 1)+(event condition 2)".

The plural message condition information 904*b*2 is expressed using the single condition information 904*a* or the compound condition information 904*b*1 as a term along with an operator "&". Each term shows a condition in one received message. The plural message condition information 904*b*2 expressed with the operator "&" shows that an event condition is satisfied when conditions shown by all terms are successively met in respective received messages.

In addition to the above logical signals, a binary operator "–" with the left and right terms showing the time event condition information 904*a*2 is used to show period information. For instance, when the left term shows 2:00 and the right term shows 4:00 in the time event condition information 904*a*2, the period information indicates a period from 2:00 to 4:00.

Figure 53:
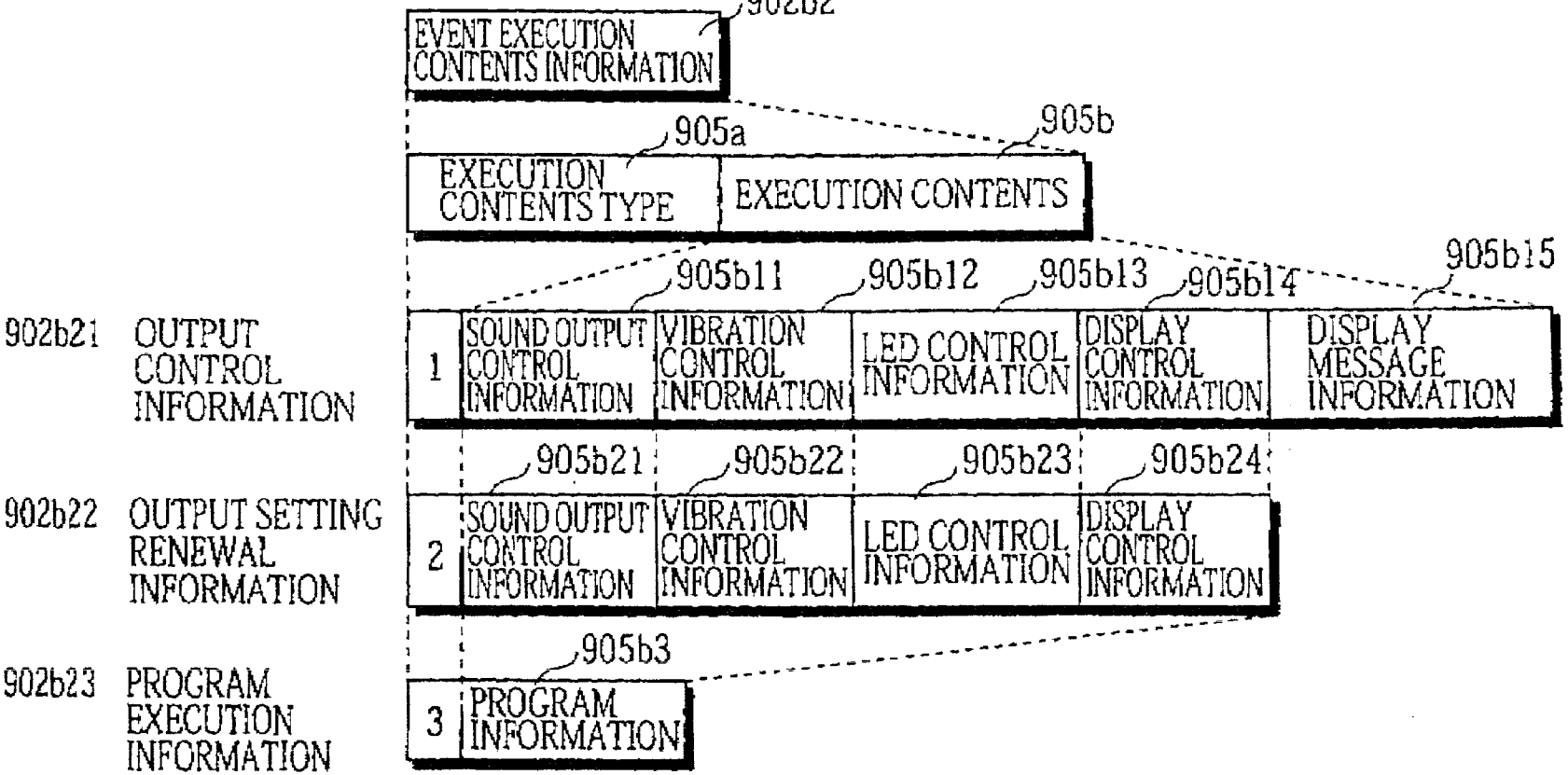
FIG. 53 shows the structure of the event execution contents information in the eighth embodiment.

FIG. 53 shows the construction of the event execution contents information 902*b*2 shown in FIG. 50. The event execution contents information 902*b*2 includes an execution contents type 905*a* and execution contents 905*b*.

When the execution contents type 905*a* is "1", it indicates output control information 902*b*21 for executing the control of notification and displays.

The execution contents 905*b* corresponding to the execution contents type 905*a* "1" includes sound output control information 905*b*11, vibration control information 905*b*12, LED control information 905*b*13, display control information 905*b*14, and display message information 905*b*15 which is displayed when executing the display control. The execution contents 905*b* show how to notify of the occurrence of the event and display the message, such as by producing vibrations without outputting melodies.

When the execution contents type 905*a* is "2", it indicates output setting renewal information 902*b*22 for executing the renewal of the output setting information stored in the output setting information storage unit 901*g*. The execution contents 905*b* corresponding to the execution contents type 905*a* "2" include sound output control information 905*b*21, vibration control information 905b22, LED control information 905b23, and display control information 905b24. When the execution contents type 905a is "3", it indicates program execution information 902b23 for executing a program. The execution contents 905b corresponding to the execution contents type 905a "3" include program information 905b3.

FIG. 54 shows types of the output setting information stored in the output setting information storage unit 901g and meanings of the codes included in each type of the output setting information. Note that the meanings of the codes in the output setting information storage unit 901g shown in FIG. 54 also apply to the sound output control information 905b11 and other information included in the output control information 902b21 and to the sound output control information 905b21 and other information included in the output setting renewal information 902b22 shown in FIG. 53.

Sound output control information 906a has the codes "0" to "9". When the sound output control information 906a is "0", the output is OFF, that is, no melody is outputted. When the sound output control information 906a is "1"–"9", melody patterns 1–9 are respectively outputted. Vibration control information 906b has the codes "0" and "1". When the vibration control information 906b is "0", the vibration control is not executed. When the vibration control information 906b is "1", the vibration control is executed. LED control information 906c has the codes "0" and "1". When "0", the LED control is not executed, that is, the LED does not flash. When "1", the LED control is executed. Display control information 906d has the codes "0" and "1". When "0", the display control is not executed, that is, no display is made. When "1", the display control is executed.

FIG. 55 shows a specific example of the melody patterns corresponding to the codes "1"14 "9" of the sound output control information 906a shown in FIG. 54.

Figure 56A:
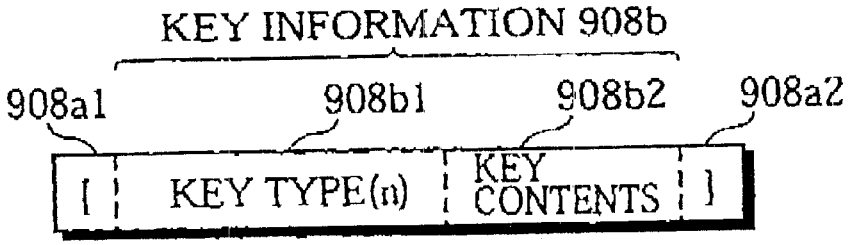
FIGS. 56A and 56B show examples of giving meanings to the key information and the internal processing information included in the message in the eighth embodiment.
Figure 56B:
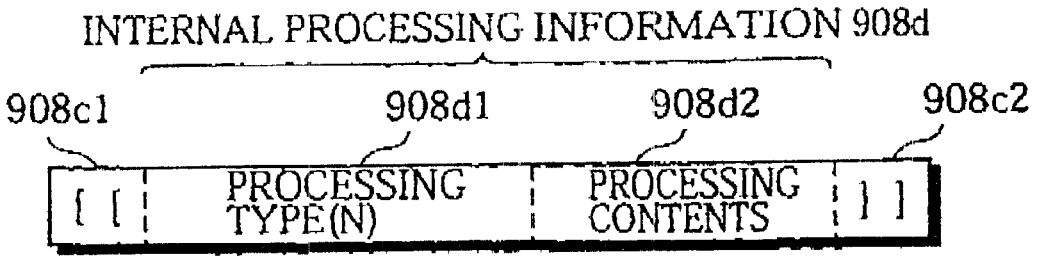

FIG. 56 shows key information and internal processing information that are included in a received message.

Data sandwiched between a separator 908a1 "[" and a separator 908a2 "]" in the received message is key information 908b. The key information 908b is composed of a key type 908b1 and key contents 908b2. When the key type 908b1 is "1", the key contents 908b2 show transmitter information 904f1. When the key type 908b1 is "2", the key contents 908b2 show password information 904f2. When the key type 908b1 is "3", the key contents 908b2 show program identification information. The key contents 908b2 are as described in FIG. 52.

Data sandwiched between a separator 908c1 "[[" and a separator 908c2 "]]" in the received message is internal processing information 908d, which is composed of a processing type 908d1 and processing contents 908d2.

When the processing type 908d1 is "1", the processing contents 908d2 show command information. When the processing type 908d1 is "2", the processing contents 908d2 show the event number information 903b. When the processing type 908d1 is "3", the processing contents 908d2 show the event condition information 902b1. When the processing type 908d1 is "4", the processing contents 908d2 show the event execution contents information 902b2. The event number information 903b, the event condition information 902b1, and the event execution contents information 902b2 are as described in FIGS. 51–53, respectively. The command information is explained below with reference to FIG. 57.

Figure 57:
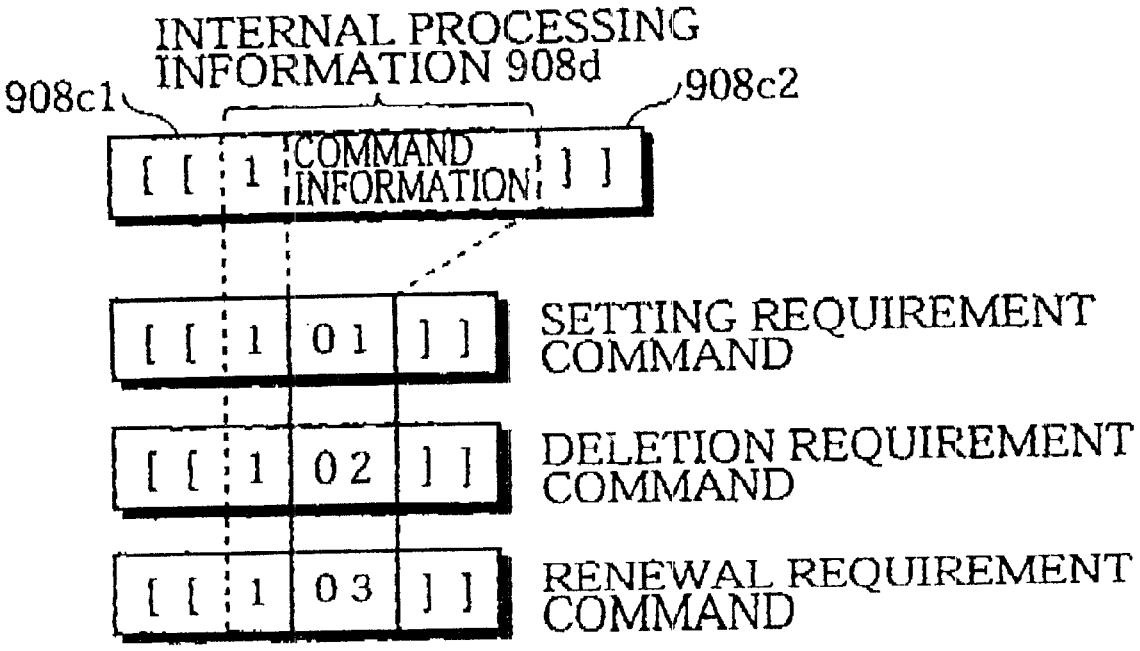
FIG. 57 illustrates the command information in the eighth embodiment.

FIG. 57 shows a case when the processing type in the internal processing information included in the received message is "1" that shows the command information.

The command information "01" shows a setting requirement command that requires to register the event instruction information 902b into the event information storage unit 901b. The command information "02" shows a deletion requirement command that requires to delete the event instruction information 902b in the event information storage unit 901b. The command information "03" shows a renewal requirement command that requires to partially change the event instruction information 902b in the event information storage unit 901b.

The following is an explanation of the specific operation of the radio pager of the eighth embodiment of the present invention with the above construction, using the operation examples that are: (1) when the event condition is a transmitter; (2) when the event condition is a time; (3) when the event condition is a password; (4) when the event condition is an elapsed time; (5) when registering event information and using program information; and (6) when using the program information.

FIRST EXAMPLE

Figure 58:
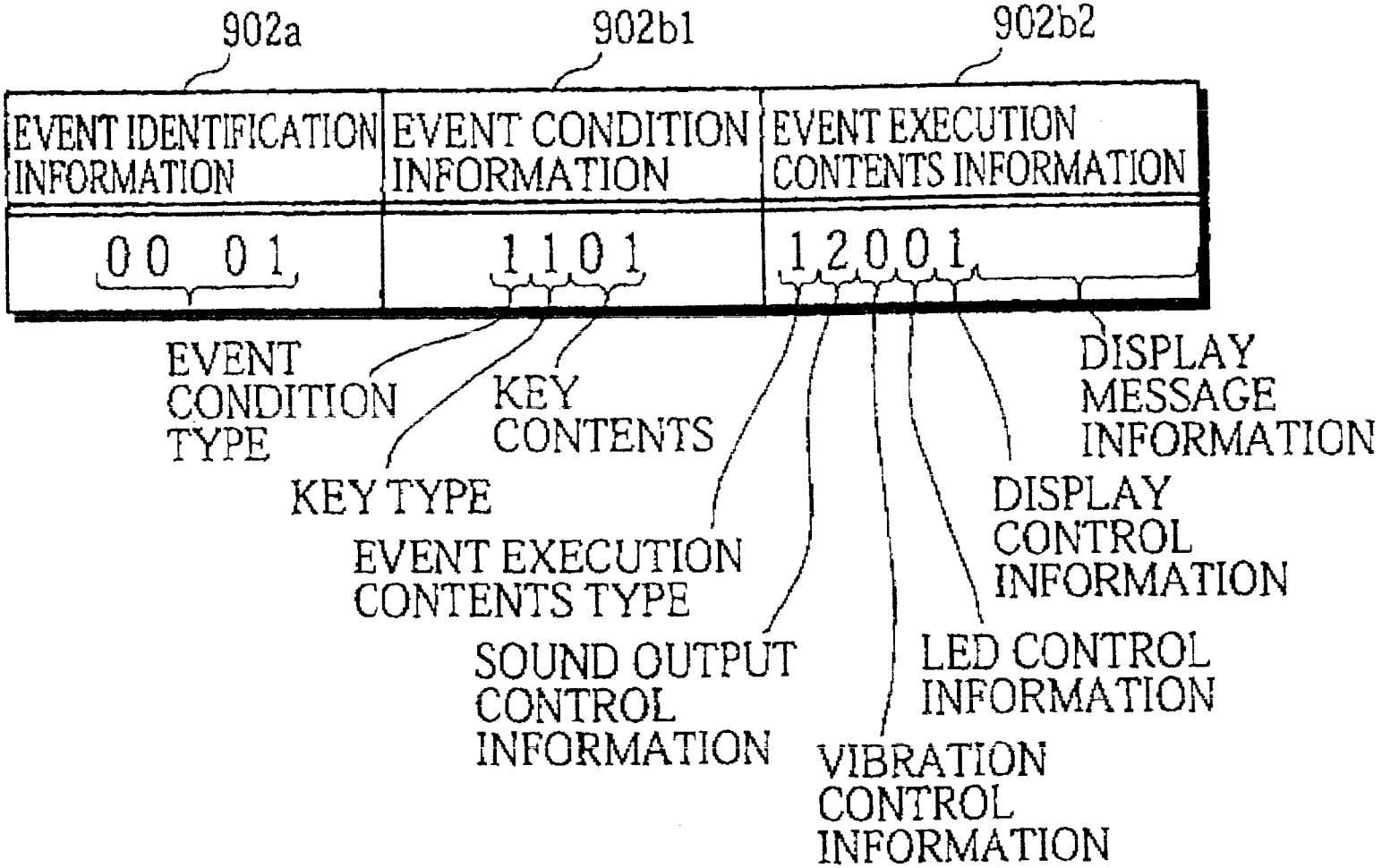
FIG. 58 shows a specific example of the event information stored in the event information storage unit in the first operation example of the eighth embodiment.

FIG. 58 shows an example of the event instruction information 902b stored in the event information storage unit 901b. Here, the event condition information 902b1 "1101" is made up of the event condition type "1", the key type "1", and the key contents "01" as shown in FIG. 52. The event condition type "1" shows that an event occurs by a message reception. The key type "1" shows that the key contents are the transmitter information. The key contents "01" show a transmitter whose transmitter ID is "01". Thus, the event condition information "1101" shows that an event condition is met when receiving a message from the transmitter whose transmitter ID is "01". The transmitter whose transmitter ID is "01" is hereinafter referred to as the transmitter "01".

The event execution contents information 902b2 includes an execution contents type "1" and execution contents "2011" as shown in FIG. 53. The execution contents type "1" shows that the execution contents "2011" relate to the output control. In the execution contents "2011", sound output control information "2" shows that notification is to be made by the sound output control of the melody pattern "2", vibration control information "0" and LED control information "0" show that neither the vibration nor the LED flashing is to be used, and display control information "1" shows that the received message is to be displayed. Display message information shows information which is to be displayed with the received message. In the present example, the display message information is not registered.

Figure 59A:
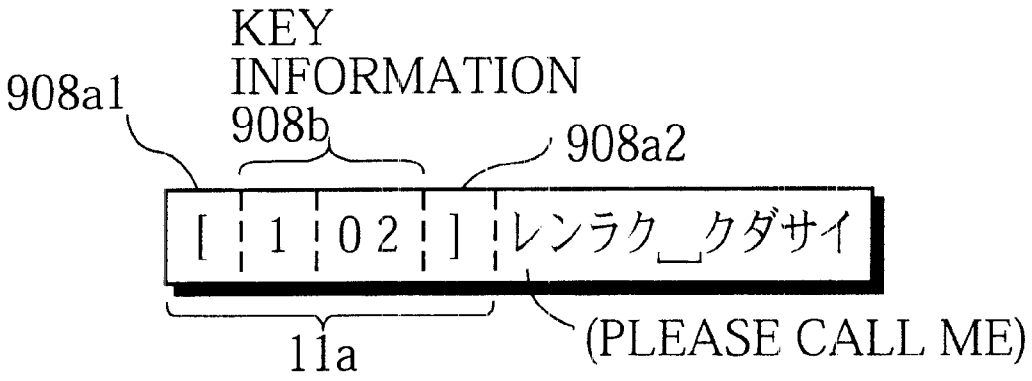
FIGS. 59A and 59B each show a specific example of a received message in the first operation example.
Figure 59B:
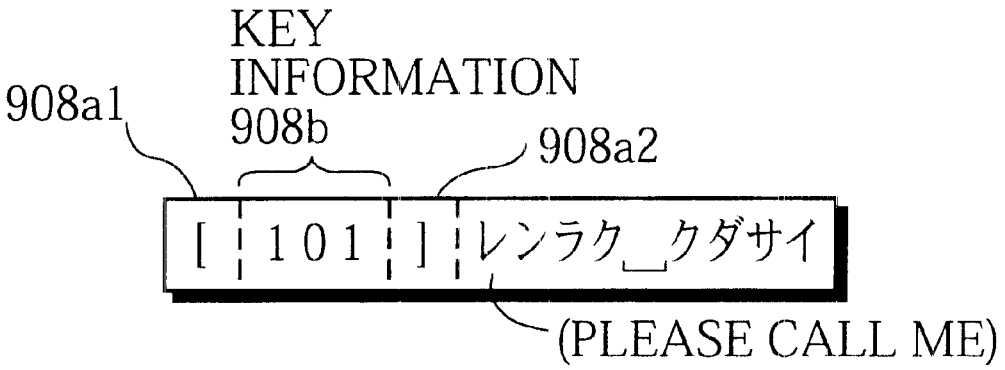

FIG. 59 shows examples of received messages. As shown in FIG. 56, information sandwiched between the separator 908a1 "[" and the separator 908a2 "]" is the key information 908b. The key information 908b "102" is composed of a key type "1" and key contents "02" in FIG. 59A. The key type "1" shows that the key contents are transmitter information, wherein the key contents "02" show a transmitter "02". Accordingly, the received message in FIG. 59A is a message "レンラククダサイ" (PLEASE CALL ME) sent from the transmitter "02". Similarly, the received message shown in FIG. 59B is a message "レンラククダサイ" from the transmitter "01".

Figure 60:
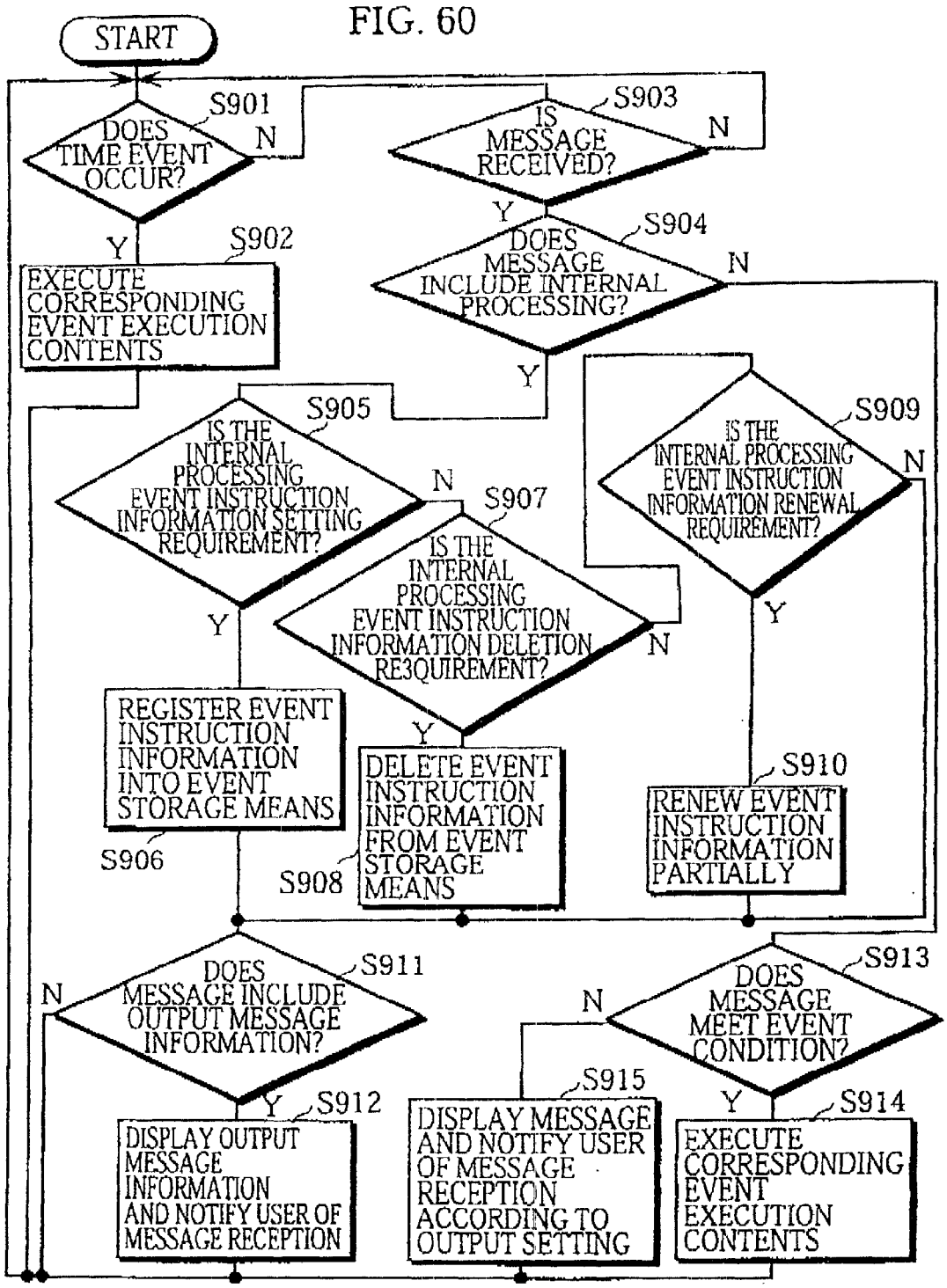
FIG. 60 is a flowchart showing the operation of the radio pager in the first operation example.

FIG. 60 is a flowchart showing the operation of the radio pager 901. Each step in the operation is described below.

Step S901: Proceed to Step S902 if an event occurs as a result of the coming of a time or the lapse of time shown by the event condition information 902b1 stored in the event information storage unit 901b. Otherwise, proceed to Step S903.

Step S902: Execute the event execution contents information 902*b*2 corresponding to the event occurred in Step S901, and return to Step S901.

Step S903: Proceed to Step S904 if a message is received. Otherwise, return to Step S901.

Step S904: Proceed to Step S905 if the received message includes information relating to internal processing. Otherwise, proceed to Step S913.

Step S905: Proceed to Step S906 if the internal processing relates to the setting of the event instruction information 902*b* in the event information storage unit 901*b*. Otherwise, proceed to Step S907.

Step S906: Register the event instruction information 902*b* into the event information storage unit 901*b* and proceed to Step S911.

Step S907: Proceed to Step S908 if the internal processing relates to the deletion of the event instruction information 902*b* from the event information storage unit 901*b*. Otherwise, proceed to Step S909.

Step S908: Delete the event instruction information 902*b* from the event information storage unit 901*b* and proceed to Step S911.

Step S909: Proceed to Step S910 if the internal processing relates to the partial change of the event instruction information 902*b* in the event information storage unit 901*b*. Otherwise, proceed to Step S911.

Step S910: Partially renew the event instruction information 902*b* in the event information storage unit 901*b* and proceed to Step S911.

Step S911: Proceed to Step S912 if the received message includes output message information in addition to the internal processing information. Otherwise, return to Step S901.

Step S912: Execute the display and notification of the output message information.

Step S913: Proceed to Step S914 if the received message meets an event condition of the event condition information 902*b*1. Otherwise, proceed to Step S915.

Step S914: Execute the event execution contents information 902*b*2 corresponding to the event condition information 902*b*1 and return to Step S901.

Step S915: Execute the display of the received message according to output setting information stored in the output setting information storage unit 901*g* and return to Step S901.

The following is an explanation of the difference of the operation when the radio pager which stores the event instruction information shown in FIG. 58 receives two different messages shown in FIG. 59, with reference to FIG. 60.

First, the operation when receiving the message from the transmitter "02" shown in FIG. 59A is explained.

Figures 61, 62:
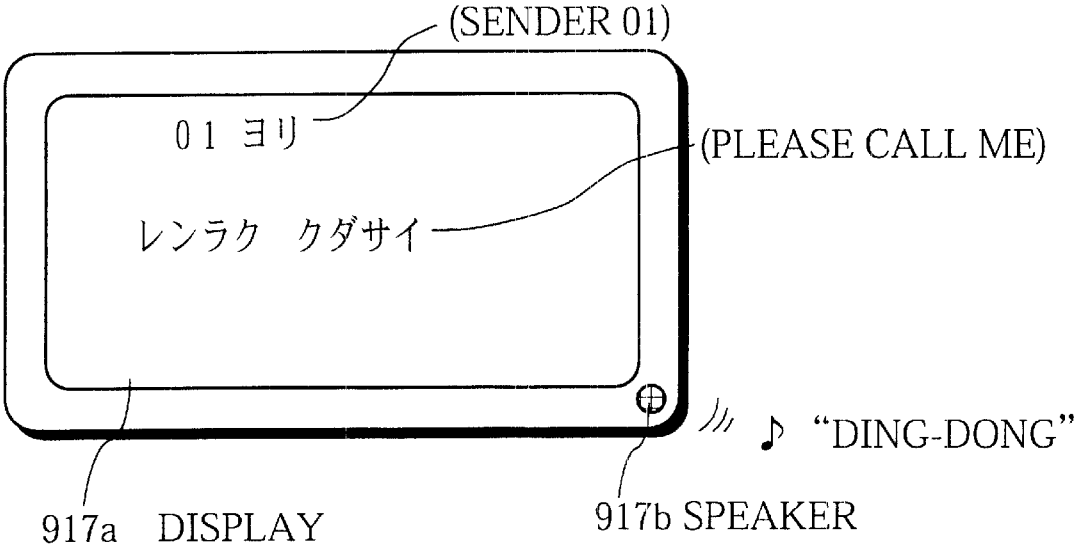
FIG. 61 shows a specific example of the output setting information stored in the output setting information storage unit in the first operation example.
FIG. 62 shows a specific example of the output, such as the display, in the first operation example.
Figure 65:
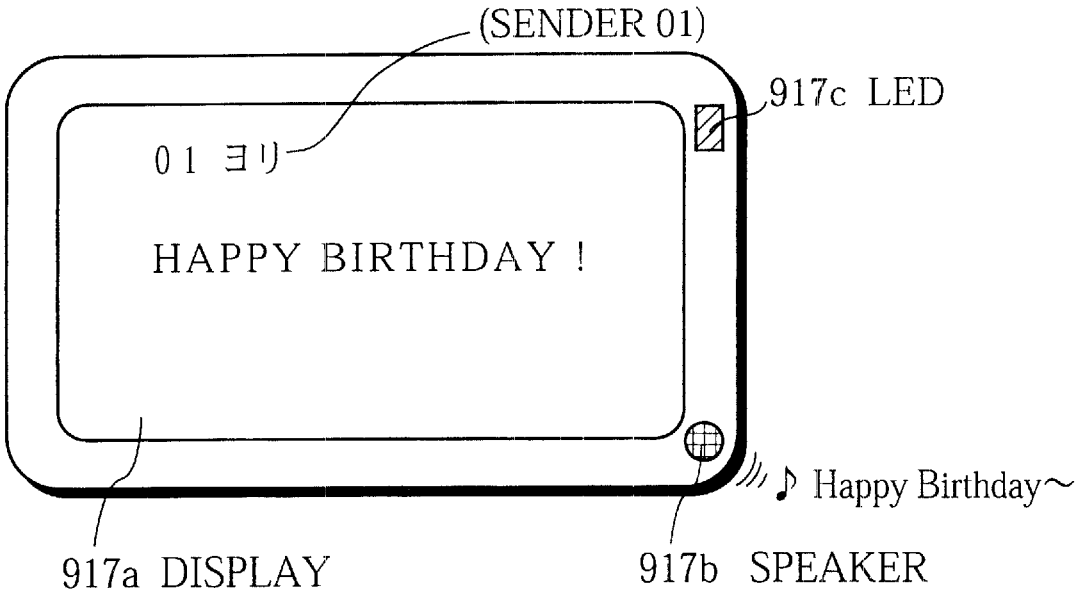
FIG. 65 shows a specific example of the output, such as the display, in the second operation example.

Since event condition information relating to a time or an elapsed time is not stored in the event information storage unit 901*b*, an event does not occur by the coming of the time or the elapsed time (Step S901). Accordingly, the operation proceeds to Step S903. The reception unit 901*a* receives the message and the operation proceeds to Step S904. In Step S904, the received message analysis unit 901*f* judges that the received message does not relate to internal processing, since the received message does not include the separator 908*c*1 "[[", and the operation proceeds to Step S913. In Step S913, the event monitor unit 901*d* checks the event condition information in the event information storage unit 901*b*. Since the received message does not meet an event condition that the transmitter is the transmitter "01" specified by the event condition information, the event monitor unit 901*d* shifts the operation to the output control unit 901*h*. In Step S915, the output control unit 901*h* performs the output control according to the output setting information stored in the output setting information storage unit 901*g*. Here, the output setting information in the output setting information storage unit 901*g* shows that all types of the output setting information are "0", that is, no output control is to be executed, as shown in FIG. 61. Accordingly, the user is not notified of the message reception.

Next, the operation when receiving the message from the transmitter "01" is explained. The operation proceeds to Step S913 in the same way as receiving the message from the transmitter "02". In Step S913, the event monitor unit 901*d* checks the event condition information in the event information storage unit 901*b* and judges that the received message meets the event condition that the transmitter is the transmitter "01" specified by the event condition information. Accordingly, the event monitor unit 901*d* notifies the event execution unit 901*e* of the occurrence of the event and shifts the operation to the event execution unit 901*e*. In Step S914, the event execution unit 901*e* performs the control according to the event execution contents information stored in the event information storage unit 901*b*. The event execution contents information corresponding to the above event condition information is that the sound output control of the melody pattern "2" and the display control of the received message are to be performed. Accordingly, the event execution unit 901*e* instructs the output control unit 901*h* to perform the control specified by the event execution contents information. FIG. 62 shows an output example. The output control unit 901*h* has the display 917*a* in the output unit 901*i* display the message information "レンラククダサイ" and the transmitter ID "01". The output control unit 901*h* also has the speaker 917*b* in the output unit 901*i* output the melody "ding-dong" of the melody pattern "2" to notify the user of the message reception.

As described above, with the present embodiment it is possible to perform the different operations for messages from different transmitters.

Note that any types of information, such as a transmitter name, a common name, and a transmission number, may be used as the transmitter information 903*a*, as long as they can identify the transmitter. Transmission terminal information, such as a transmission terminal ID, may instead be used as the transmitter information 903*a*.

While the transmitter information is used as the event condition information 902*b*1 stored in the event information storage unit 901*b* in the present example, the event condition information 902*b*1 may instead be keyword information. In such a case, when a received message includes a keyword specified by the keyword information, the output operation can be performed in a different way, such as by outputting a special melody, from messages which do not include the keyword.

Note that a plurality of event conditions can be combined to execute different output operations by setting the compound condition information 904*b*1 as the event condition information 902*b*1. For instance, it can be set such that the output operation changes when receiving a message that is sent from a specified transmitter and that also includes a specified keyword, such as "ジウメダ" (URGENT).

Also, by setting the plural message condition information 904*b*2 as the event condition information 902*b*1, the user is notified of the message reception only after receiving all specified messages. As a result, the user does not need to be notified of the received messages one by one but can be notified of them all at once.

While the display 917*a* displays a text in the present example, the display 917*a* may also display animation, static images, and moving images in combination with the melody outputted from the speaker 917*b*. In such a case, images can be easily displayed by flashing each dot of the display 917*a* on and off or by combining sideways scrolling and up-and-down scrolling in units of dots.

SECOND EXAMPLE

The following is an explanation of the specific operation of the radio pager 901 when receiving a message with which the transmitter has specified an operation to be performed at a desired time, with reference to FIGS. 60 and 63–65.

FIG. 63A shows a message for setting event information in the event information storage unit 901*b*. The message includes transmitter information 915*a*, command information 915*b*, event number information 915*c*, event condition information 915*d*, and event execution contents information 915*e*.

The transmitter information 915*a* shows that the message is sent from the transmitter "01". The command information 915*b* shows a setting requirement command. The event number information 915*c* has the value "02", which is combined with the transmitter information 915*a* "01" to form the event identification information 902*a* "0102". The event identification information 902*a* is used to identify the event instruction information 902*b* stored in the radio pager 901. The event condition information 915*d* shows that an event occurs at 12:00 on April 2nd, as explained in FIG. 52. The event execution contents information 915*e* shows that the output of the melody pattern "5", the LED flashing, and the display of display message information "HAPPY BIRTHDAY!" are to be performed, as explained in FIG. 53.

FIG. 64A shows event information registered in the event information storage unit 901*b* as a result of receiving the message shown in FIG. 63A.

The operation when receiving the message shown in FIG. 63A is explained below with reference to FIG. 60.

In Step S901, since the event information storage unit 901*b* does not store event condition information 902*b*1 which specifies a time or an elapsed time as an event condition, a time event does not occur. Accordingly, the operation proceeds to Step S903.

In Step S903, the reception unit 901*a* receives the message. In Step S904, the received message analysis unit 901*f* judges that the received message includes information relating to internal processing, since the received message includes data sandwiched between the separator 908*c*1 "[[" and the separator 908*c*2 "]]". In Step S905, the event information setting unit 901*c* refers to the command information 915*b* "01" in the received message to judge that the received message is a setting requirement message.

In Step S906, the event information setting unit 901*c* registers the event instruction information 902*b* and the event identification information 902*a* "0102" for identifying the event instruction information 902*b* into the event information storage unit 901*b*, the event instruction information 902*b* being composed of the event condition information 915*d* and the event execution contents information 915*e*. On completing the registration in the event information storage unit 901*b*, the event information setting unit 901*c* notifies the event monitor unit 901*d* of the registration. The event monitor unit 901*d* starts monitoring an occurrence of an event specified by the newly registered time event condition information 904*a*2 "21200".

In Step S911, when the received message does not include information other than the information relating to the internal processing and the key information 908*b* sandwiched between the separator 908*a*1 "[" and the separator 908*a*2 "]", the received message is judged as not including output message information. Since the received message does not include the output message information in the present example, the operation returns to Step S901.

FIG. 64A shows the event information registered in the event information storage unit 901*b* in Step S906. The event identification information, the event condition information, and the event execution contents information included in the received message are registered as shown in the figure.

The operation of executing the registered event execution contents information is explained next. When the time event condition information 904*a*2 is registered, the event monitor unit 901*d* starts monitoring a timer and notifies the event execution unit 901*e* of the occurrence of the event at the registered time "12:00 on April 2nd". Then the operation proceeds from Step S901 to Step S902.

In Step S902, the event execution unit 901*e* instructs the output control unit 901*h* to perform the output control according to the registered event execution contents information. As shown in an output example in FIG. 65, the output control unit 901*h* has the display 917*a* display the transmitter ID "01" and "HAPPY BIRTHDAY!". The output control unit 901*h* also has the speaker 917*b* output the sound "Happy Birthday" of the melody pattern "5" and has the LED 917*c* flash to notify the user of the message reception. Since the registered event condition information 902*b*1 is the time event condition information 904*a*2, the event execution unit 901*e* deletes the event information shown in FIG. 64A which has already been executed from the event information storage unit 901*b*. Then the operation returns to Step S901.

The operation of renewing the event instruction information registered in the above operation is explained next.

Suppose the event instruction information is still registered, since the time specified by the event condition has not come yet.

The following is an explanation of the operation of changing the time from "12:00" to "17:00" using a message shown in FIG. 63B.

FIG. 63B shows a renewal requirement message for the event instruction information 902*b*. The message includes transmitter information 915*f*, command information 915*g*, event number information 915*h*, and event condition information 915*i*.

The event instruction information that is subjected to the change is identified by the event identification information "0102" which is composed of the transmitter information 915*f* "01" and the event number information 915*h* "02". The command information 915*g* "03" shows a renewal requirement command for requiring the partial change of the event instruction information. The event condition information 915*i* "217000402" is the time event condition information 904*a*2 showing that the event occurs at "17:00 on April 2nd", as explained in FIG. 52.

The operation when receiving this renewal requirement message is explained below with reference to FIG. 60.

The operation proceeds to Step S905 in the same way as the operation when receiving the message shown in FIG. 63A.

The operation proceeds from Step S905 to Steps 907, S909, and then S910, since the received message is the renewal requirement message as indicated by the command information 915*g* "03".

In Step S910, the event information setting unit 901*c* renews the event instruction information stored in the event information storage unit 901*b* according to the received message. FIG. 64B shows the renewed event instruction information. The event occurrence time is renewed as shown in the event condition information "217000402", while the event execution contents information which is not included in the received message is not changed. The event information setting unit 901*c* notifies the event monitor unit 901*d* of the renewal of the event information in the event information storage unit 901*b*. On receiving the notification, the event monitor unit 901*d* changes the event occurrence time from "12:00" to "17:00". The operation of cancelling the registered event instruction information is explained next.

The following is an explanation of the operation of deleting the registered event instruction information in accordance with a message shown in FIG. 63C, with reference to FIG. 60. FIG. 63C shows a deletion requirement message that includes transmitter information 915*j*, command information 915*k*, and event number information 915*l*. The operation when receiving this deletion requirement message proceeds to Step S905 in the same way as the operation when receiving the above setting requirement message.

The operation proceeds from Step S905 to Steps S907 and then S908, since the received message is the deletion requirement message as indicated by the command information 915*k* "02".

In Step S908, the event information setting unit 901*c* deletes the event identification information "0102", which is composed of the transmitter information 915*j* "01" and the event number information 915*l* "02", and the event instruction information specified by the event identification information "0102" from the event information storage unit 901*b*. The event information setting unit 901*c* then notifies the event monitor unit 901*d* of the deletion. The event monitor unit 901*d* accordingly completes the monitoring of the occurrence of the event specified by the deleted time event condition information 904*a*2.

As described above, with the present embodiment the transmitter can specify how and when the operation is performed in the radio pager of the receiver.

The transmitter can also modify or cancel the operation which has been specified, by sending an appropriate message.

The message which includes the event identification information (composed of the transmitter information 915*a* and the event number information 915*c*), the command information 915*b*, the event condition information 915*d*, and the event execution contents information 915*e* is used to register the event information into the event information storage unit 901*b* in the present example. However, a message which includes the event condition information 915*d* and the event execution contents information 915*e* is sufficient if just registering the event information in the event information storage unit 901*b*.

Note that the registration in the event information storage unit 901*b* may be performed using a local-mode input device such as a personal computer.

Note that any data which can specify a time and a date may be used instead of the date information 904*h* and the time information 904*g*.

Also, the date information 904*h* does not have to be used.

While the event information for the time event condition is deleted from the event information storage unit 901*b* once the event occurs and the event execution contents information is executed in the present example, the event information does not need to be deleted but may continue to be stored, so that the same event will repeatedly occur.

THIRD EXAMPLE

The following is an explanation of an example of changing a notification method according to password information included in a received message.

Here, output setting information of no notification control is stored in the output setting information storage unit 901*g* as shown in FIG. 61.

FIG. 66 shows the event instruction information 902*b* stored in the event information storage unit 901*b*. The event condition information 902*b*1 is composed of the event condition type 904*c* and the event condition contents 904*d*. The event condition type "1" shows that an event occurs by a message reception and that the event condition contents are made up of a key type and key contents. The key type "2" shows that the key contents are password information, wherein the key contents specify the password information "7777". Thus, the event condition information shows that the event occurs when receiving a message whose password information is "7777". The event information storage unit 901*b* also stores two other sets of event instruction information which show that an event occurs when receiving a message with password information "0123" and "5555", respectively.

The event execution contents information 902*b*2 is composed of the execution contents type 905*a* and the execution contents 905*b*. The execution contents type "1" shows that the execution contents are the output control information 902*b*21. The execution contents "2001 クラブメンバ" (CLUB MEMBER) show that a received message and "クラブメンバ" are to be displayed, along with the execution of the sound output control of the melody pattern "2", as explained in FIG. 53.

In FIG. 67, information sandwiched between the separator 908*a*1 "[" and the separator 908*a*2 "]" is the key information 908*b* shown in FIG. 56. The key information 908*b* is composed of the key type 908*b*1 and the key contents 908*b*2. The key type "2" shows that the key contents are the password information which is "7777".

The following is an explanation of the different operations when receiving the message with no password information shown in FIG. 67A and when receiving the message with the password information shown in FIG. 67B, with reference to FIG. 60.

First, the operation when receiving the message shown in FIG. 67A is explained. The operation proceeds from Step S901 to Step S903, since event information which sets a time or an elapsed time as an event condition is not stored in the event information storage unit 901*b* as shown in FIG. 66. On receiving the message shown in FIG. 67A, the operation proceeds to Step S904 where the received message analysis unit 901*f* judges that the received message does not include information relating to internal processing. In Step S913, the event monitor unit 901*d* checks event instruction information in the event information storage unit 901*b* and judges that the received message does not meet any conditions specified by the three sets of event condition information shown in FIG. 66, the conditions being the inclusion of the password information "0123", "5555", and "7777", respectively. In Step S915, the output control unit 901*h* refers to the output setting information of no notification and display control of the message in the output setting information storage unit 901*g* as shown in FIG. 61. Accordingly, neither display nor notification of the received message is performed. The operation then returns to Step S901.

Next, the operation when receiving the message with the password information shown in FIG. 67B is explained. The operation proceeds from Step S901 to Step S903, since event information which sets a time or an elapsed time as an event condition is not stored in the event information storage unit 901*b* as shown in FIG. 66. On receiving the message shown in FIG. 67A, the operation proceeds to Step S904 where the received message analysis unit 901*f* judges that the received message does not include information relating to internal processing. In Step S913, the event monitor unit 901*d* checks the event instruction information in the event information storage unit 901*b* and judges that the password information "7777" in the received message meets the condition specified by the event condition information, that is, the inclusion of the password information "7777". Accordingly, the event monitor unit 901*d* notifies the event execution unit 901*e* of the occurrence of the event, and the operation proceeds to Step S914.

The event execution unit 901*e* instructs the output control unit 901*h* to perform the output control in accordance with the event execution contents information stored in the event information storage unit 901*b*. FIG. 68 shows an output example. The output control unit 901*h* has the display 917*a* in the output unit 901*i* display the received message "TEL 111-1111" and the display message information "クラブメンバ". The output control unit 901*h* also has the speaker 917*b* in the output unit 901*i* output the melody "ding-dong" of the melody pattern "2" to notify the user of the message reception.

As described above, with the present embodiment it is possible to execute different operations when receiving a message which meets a registered condition on password information and when receiving a message which does not meet the condition. Also, it is possible to register a plurality of sets of password information and associate each set of password information with a different operation to be performed after message reception.

FOURTH EXAMPLE

Figure 69:
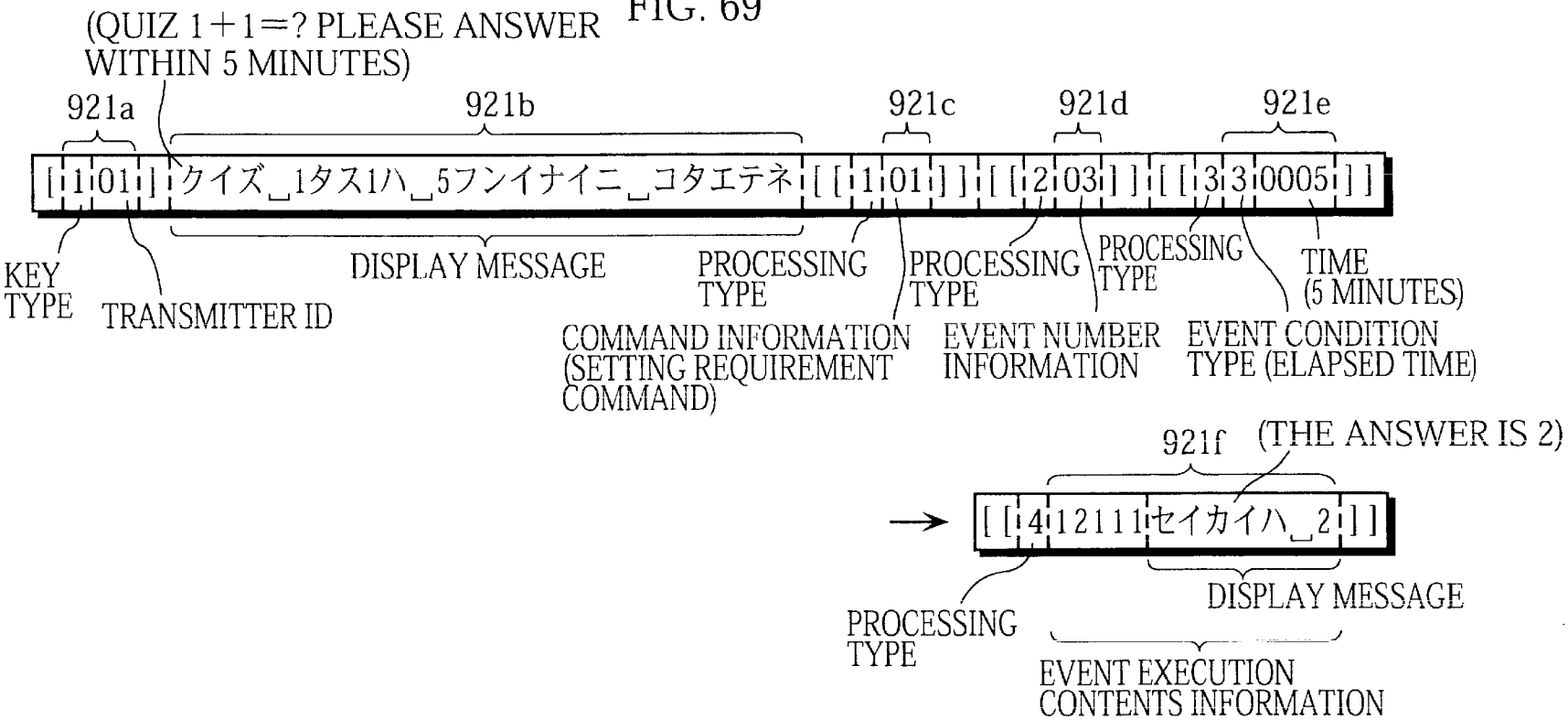
FIG. 69 shows a specific example of a received message in the third operation example.

The following is an explanation of the operation when receiving a message that relates to an elapsed time event condition, with reference to FIGS. 60 and 69–72. FIG. 69 shows a specific example of a received message. Key information 921*a* sandwiched between the separator 908*a*1 "[" and the separator 908*a*2 "]" shows that the message is sent from the transmitter "01" Command information 921*c* shows the setting requirement command of the event instruction information 902*b*. Event number information 921*d* is combined with the transmitter information 921*a* to form the event identification information 902*a* "0103". Event condition information 921*e* includes the event condition type "3" indicating that the event condition contents 904*d* are the elapsed time information 904*i*. The elapsed time information 904*i* "0005" shows that an event occurs "00" hours and "05" minutes (5 minutes) after the message reception. Event execution contents information 921*f* shows that display message information 921*f*1 is to be displayed along with the execution of the sound output control of the melody pattern "2", the vibration control, and the LED flashing control, as explained in FIG. 53.

Here, the output setting information storage unit 901*g* stores output setting information specifying the sound output control of the melody pattern "1" and the display control of the received message to be performed, as shown in FIG. 71.

The operation when receiving the message shown in FIG. 69 is explained below with reference to FIG. 60.

The operation proceeds from Step S901 to Step S903, since event information which sets a time or an elapsed time as an event condition is not stored in the event information storage unit 901*b*. On receiving the message shown in FIG. 69, the operation proceeds to Step S904.

In Step S904, the received message analysis unit 901*f* judges that the received message include internal processing information, since data sandwiched between the separator 908*c*1 "[[" and the separator 908*c*2 "]]" is included in the message. Accordingly, the received message analysis unit 901*f* shifts the operation to the event information setting unit 901*c*. In Step S905, the event information setting unit 901*c* checks the command information 921*c* "01" that specifies the setting requirement command of the event instruction information 902*b*, and the operation proceeds to Step S906.

The event information setting unit 901*c* registers the event condition information 921*e*, the event execution contents information 921*f*, and the event identification information 902*a* which is composed of the transmitter information 921*a* and the event number information 921*d* into the event information storage unit 901*b*. FIG. 70 shows the registered event identification information, event condition information, and event execution contents information. The transmitter information 921*a* "01" and the event number information 921*d* "03" in the received message are registered as the event identification information "0103". The event condition information 921*e* "30005" in the received message is registered as the event condition information "30005" showing that an event occurs "00" hours and "05" minutes (5 minutes) after the registration. The event execution contents information 921*f* in the received message is registered as the event execution contents information. On completing the registration in the event information storage unit 901*b*, the event information setting unit 901*c* notifies the event monitor unit 901*d* of the registration. The event monitor unit 901*d* starts counting the timer, since the newly registered event condition information is the elapsed time event condition information 904*a*3 showing that the event occurs 5 minutes later.

Figure 72A:
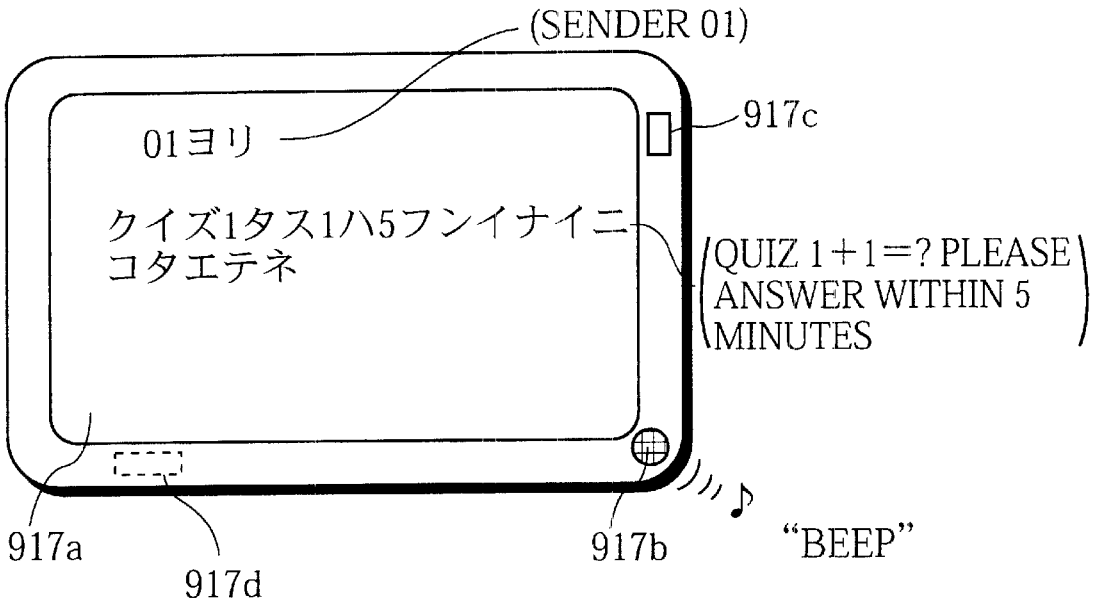
FIGS. 72A and 72B each show a specific example of the output, such as the display, in the fourth operation example.

In Step S911, since the received message includes output message information 921*b*, the event information setting unit 901*c* instructs the event execution unit 901*e* to display the output message information 921*b* and the transmitter information 921*a* "01". In Step S912, the event execution unit 901*e* instructs the output control unit 901*h* to display the output message information 921*b* and the transmitter information 921*a*. The output control unit 901*h* accordingly performs the output control according to the output setting information in the output setting information storage unit 901*g*. FIG. 71 shows the output setting information in the output setting information storage unit 901*g* which specifies the sound output control of the melody pattern "1" to notify the user of the message reception. FIG. 72A shows an output example. The transmitter ID "01" and the output message information 921*b* "クイズ 1タス1ハ 5フンイナイニ コタエテネ" (QUIZ 1+1=? PLEASE ANSWER WITHIN 5 MINUTES) are displayed with the sound output control of the melody pattern "1" for notifying the user of the message reception. Then the operation returns to Step S901.

In Step S901, when 5 minutes which are the elapsed time specified by the event condition information have passed since the event condition information was registered, the event monitor unit 901*d* notifies the event execution unit 901*e* of the event occurrence. In Step S902, the event execution unit 901*e* instructs the output control unit 901*h* to perform the output control shown by the event execution contents information corresponding to the event. The output control unit 901*h* accordingly performs the output control. Once the event execution contents information is executed, the event execution unit 901*e* deletes the event information relating to the elapsed time shown in FIG. 70 from the event information storage unit 901*b*.

Figure 72B:
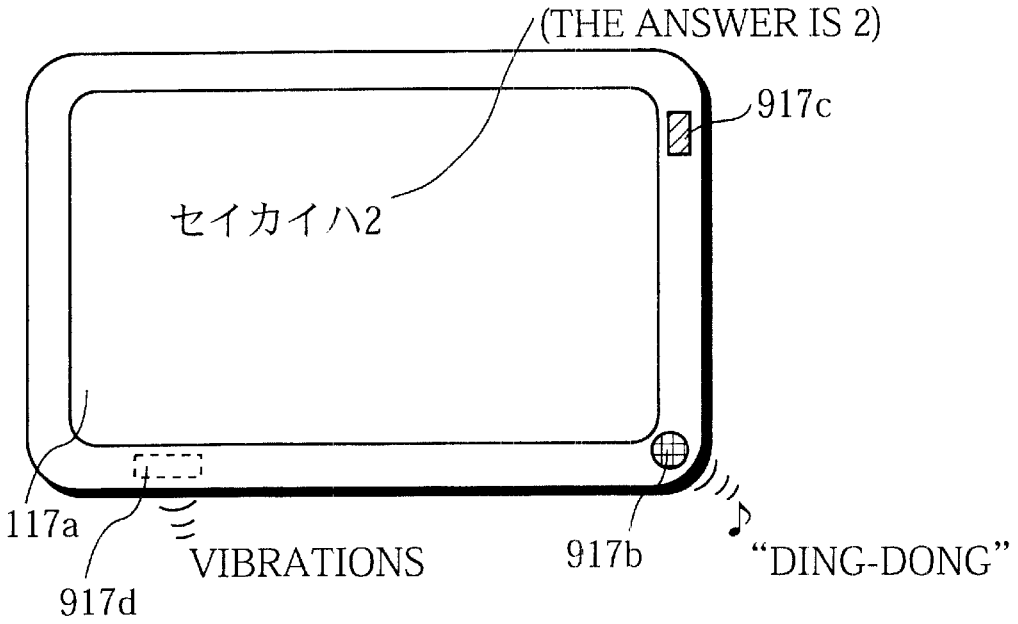

FIG. 72B shows an output example. According to the instruction from the event execution unit 901*e*, the output control unit 901*h* has the display 917*a* in the output unit 901*i* display the display message information "セイカイハ 2" (THE ANSWER IS 2), has the speaker 917*b* output the melody "ding-dong" of the melody pattern "2", has the vibrator 917*d* vibrate, and has the LED 917*c* flash.

With the present embodiment, the transmitter can specify that the desired operation be performed in the radio pager of the receiver after a lapse of specified time.

Also, a single message can be used to specify both the operation to be performed when receiving the message and the operation to be performed after the lapse of the specified time.

While the elapsed time is used in the present example, it is also possible to specify both operations with a single message when the event condition is a coming of a time.

The event condition information 902*b*1 to be registered may instead be the received message event condition information 904*a*1.

Also, the execution contents when an event occurs are not limited to the simple operation of the sound output, the vibration, the flashing, and the display but may be performed in a multimedia data form. For example, the display 917*a* may display animation, static images, and moving images in combination with the melody outputted from the speaker 917*b*.

FIFTH EXAMPLE

The following is an explanation of the operation of registering the program information 905*b*3 into the event information storage unit 901*b* and the operation of receiving messages using the registered program information, with reference to FIGS. 60 and 73–79.

First, the operation of registering the program information 905*b*3 into the event information storage unit 901*b* is explained with reference to FIGS. 60, 73, and 74.

Figure 73:
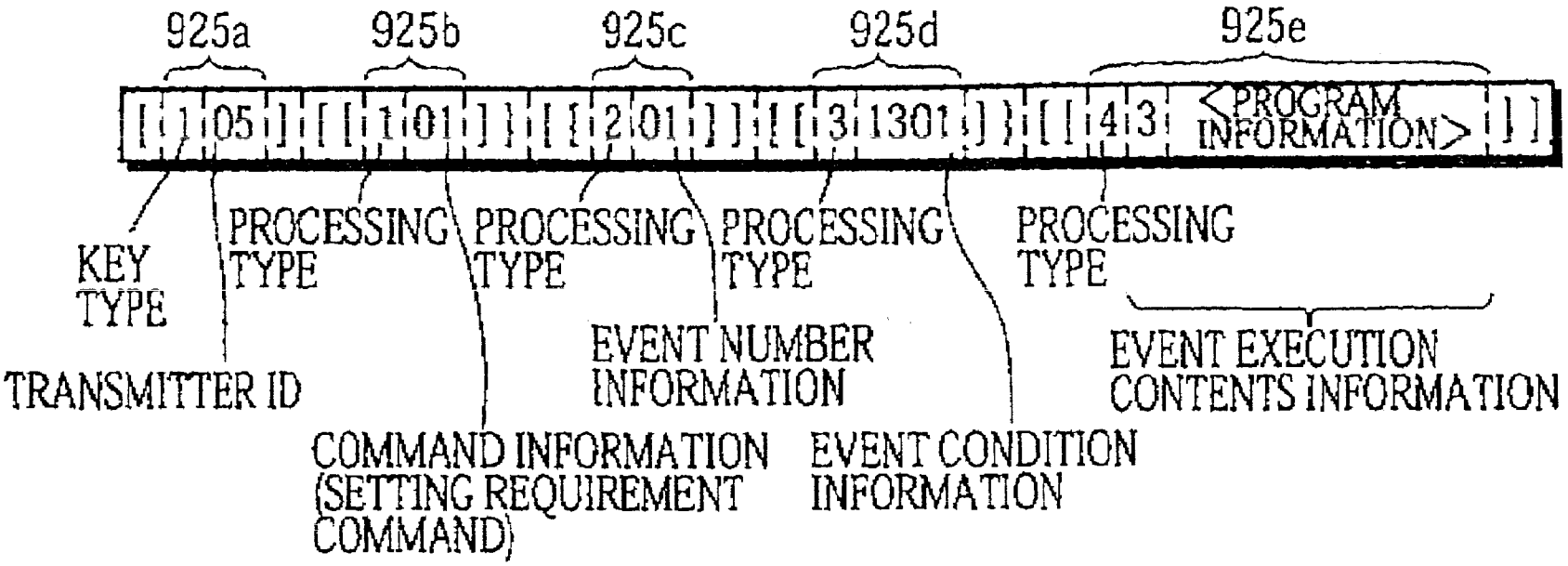
FIG. 73 shows a specific example of a message for program information registration in the fifth operation example.
Figure 74:
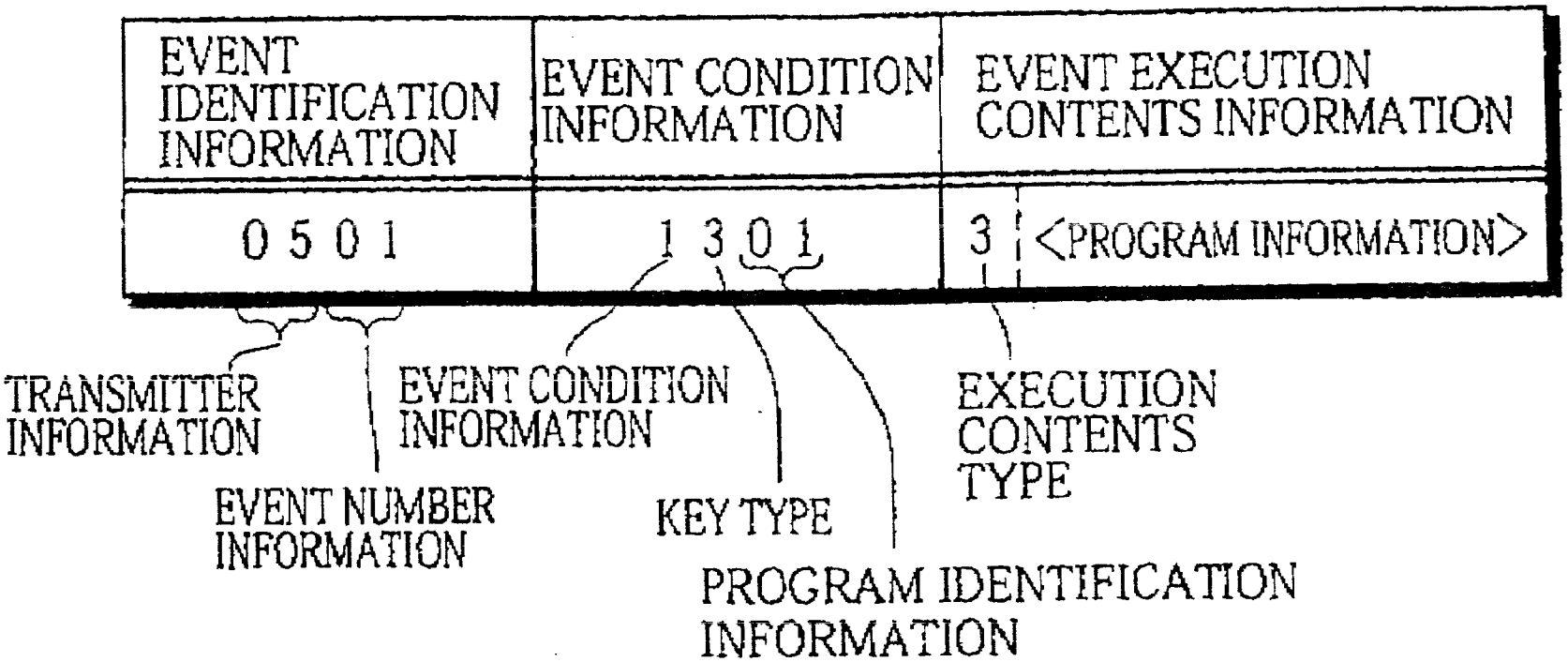
FIG. 74 shows a specific example of the program information stored in the event information storage unit in the fifth operation example.

FIG. 73 shows a message used for registering the program information. The message includes transmitter information 925*a*, command information 925*b*, event number information 925*c*, event condition information 925*d*, and event execution contents information 925*e*. The transmitter information 925*a* shows that the message is sent from a transmitter "05". The command information 925*b* "01" shows a setting requirement command as explained in FIG. 57. The event number information 925*c* "01" is combined with the transmitter information 925*a* to form the event identification information 902*a* "0501". The event condition information 925*d* shows that an event occurs when receiving a message whose program identification information 904*f*3 is "01". The event execution contents information 925*e* includes an execution contents type "3" and execution contents "<program information>". The execution contents type "3" shows that the execution contents are program information that includes a program to be analyzed and executed by the event execution unit 901*e*.

The operation when receiving the message shown in FIG. 73 is explained below with reference to FIG. 60.

The operation proceeds from Step S901 to Step S903, since the event information storage unit 901*b* does not store the event instruction information 902*b* and thus a time event by a coming of a time or an elapsed time does not occur.

The reception unit 901*a* receives the message in Step S903.

In Step S904, the received message analysis unit 901*f* judges that the received message include internal processing information, since data sandwiched between the separator 908*c*1 "[[" and the separator 908*c*2 "]]" is included in the received message. The received message analysis unit 901*f* accordingly shifts the operation to the event information setting unit 901*c*.

In Step S905, the event information setting unit 901*c* checks the command information 925*b* "01" in the received message that specifies the setting requirement of the event instruction information 902*b*.

In Step S906, the event information setting unit 901*c* registers the event information into the event information storage unit 901*b*. FIG. 74 shows the registered event information. The transmitter information 925*a* "05" and the event number information 925*c* "01" in the received message are registered as the event identification information "0501". The event condition information 925*d* "1301" in the received message is registered as the event condition information. The event execution contents information 925*e* "3<program information>" in the received message is registered as the event execution contents information. The operation proceeds to Step S911.

Since the received message only includes the information sandwiched between the separator 908*a*1 "[" and the separator 908*a*2 "]" and the information sandwiched between the separator 908*c*1 "[[" and the separator 908*c*2 "]]" and does not include output message information, the operation returns to Step S901.

Next, the operation of processing a received message using the program information is explained below with reference to FIGS. 75–79.

Figures 75, 76:
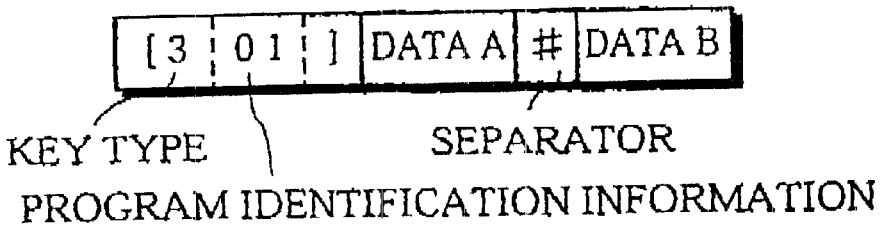
FIG. 75 shows the structure of a received message that is processed by the program in the fifth operation example.
FIG. 76 shows a description example of the program in the fifth operation example.

FIG. 75 shows the predetermined construction of a received message to be processed using the program information. The received message includes program identification information, along with data A and data B with a separator "#" between them. Data A is used to judge a filter condition for displaying only predetermined messages in the present example, while data B is used as display data.

The operation when receiving the message with the above construction is explained below with reference to FIG. 60.

The operation proceeds from Step S901 to Step S903, since the event information storage unit 901*b* does not store the event instruction information 902*b*1 which specifies a time or an elapsed time as an event condition and thus a time event does not occur.

On receiving the message shown in FIG. 75, the operation proceeds to Step S904.

Since the received message does not include internal processing information, the operation proceeds to Step S913.

The event monitor unit 901*d* checks the event instruction information in the event information storage unit 901*b*. The program identification information "01" in the received message meets the event condition that the program identification information 904f3 be "01", the event condition being specified by the event condition information in the event information storage unit 901*b*. Accordingly, the event monitor unit 901*d* notifies the event execution unit 901*e* of the event occurrence.

In Step S914, the event execution unit 901*e* processes the received message according to the event execution contents information that shows the execution of the program information. That is to say, the event execution unit 901*e* processes the received message according to the program information. The operation then returns to Step S901.

The following is an explanation of the registered program information.

FIG. 76 shows a specific example of the program information. This program information realizes a filter function for displaying only radio messages that include predetermined data. The program information is composed of three main blocks 1–3.

Block 1 includes a variable f1 that can be set by the key input and other means and column variables %1 and %2 for storing data in the message to be processed. The message to be processed has the predetermined construction as shown in FIG. 75, and data A and data B are assigned respectively to the column variables %1 and %2.

Block 2 describes a method of processing the message.

In this method, first the variable f1 is checked. If the variable f1 matches the column variable %1, the column variable %1 being data A, or if the variable f1 has an initial value, the message is formatted and displayed (Step S933) and the melody pattern "1" is outputted (Step S934). Otherwise, the message is deleted (Step S935).

Block 3 describes the setting of the variable f1 by the input operation (Step S937).

Figure 77:
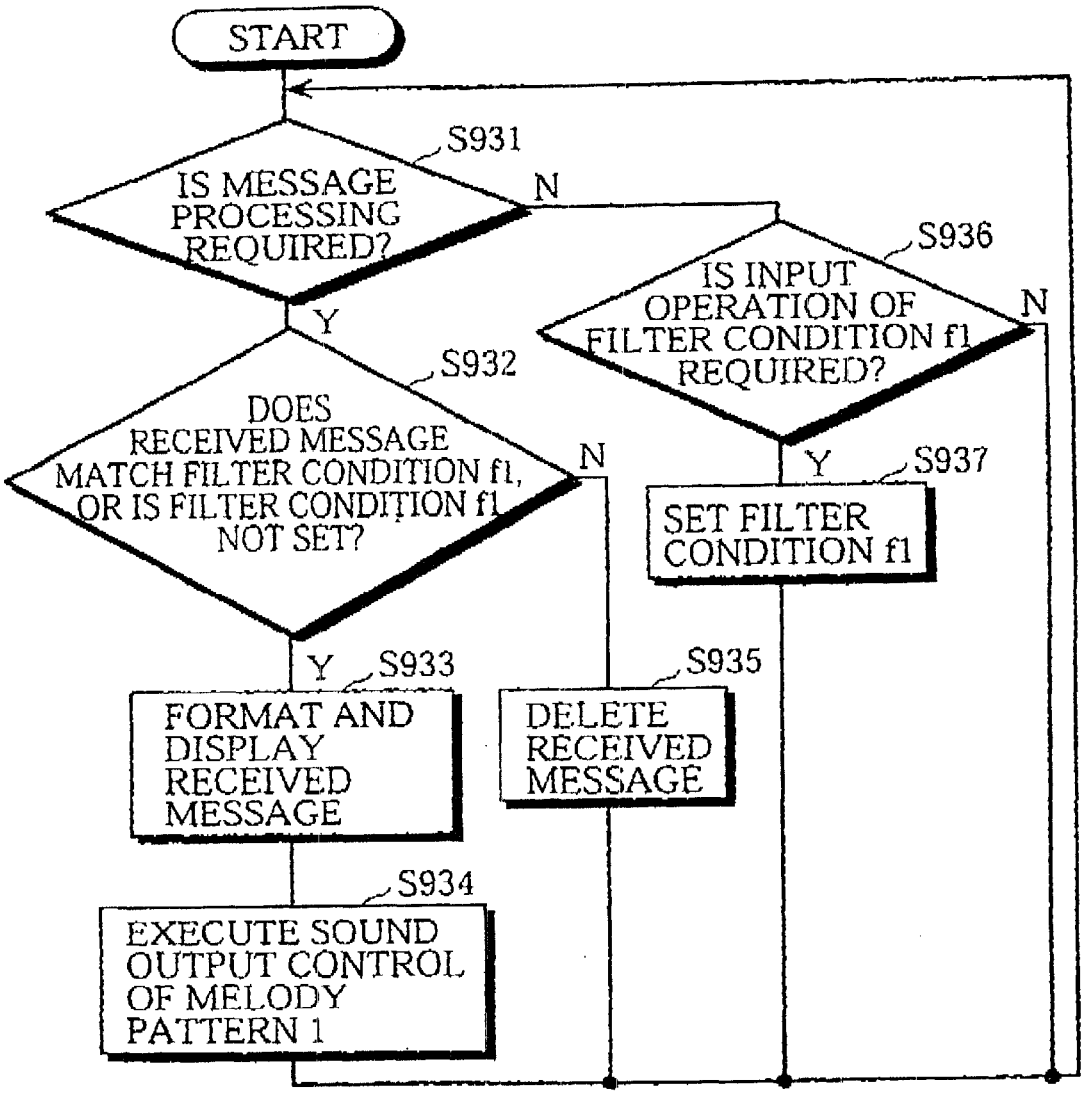
FIG. 77 is a flowchart showing the operation of the program in the fifth operation example.

FIG. 77 is a flowchart showing the processing of the program information shown in FIG. 76.

Each step of the processing is described below.

Step S931: Proceed to Step S932 if the message processing is required. Otherwise, proceed to Step S936.

Step S932: Refer to the variable f1. Proceed to Step S933 if the variable f1 matches the column variable %1, that is, data A, or if the variable f1 has the initial value. Otherwise, proceed to Step S935.

Step S933: Format and display the message according to the program information.

Step S934: Output the melody pattern "1".

Step S935: Delete the message.

Step S936: Proceed to Step S937 if the input operation in the variable f1 is required. Otherwise, return to Step S931.

Step S937: Set the variable f1 that is used as the filter condition and return to Step S931.

Figure 78A:
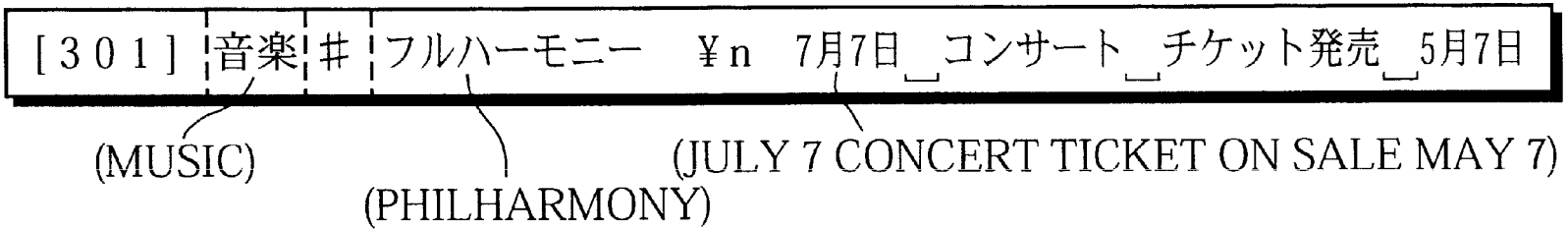
FIGS. 78A and 78B each show a specific example of a received message that is processed by the program in the fifth operation example.

The following is an explanation of the operation of receiving a message shown in FIG. 78A and executing the program information shown in FIG. 76 when the variable f1 is not set but remains at the initial value, with reference to FIG. 77.

The operation proceeds from Step S931 to Step S932, since the received message is to be processed using the program.

Since the variable f1 is not set but remains at the initial value, the operation proceeds to Step S933.

The event execution unit 901*e* formats the received message and instructs the output control unit 901*h* to display the formatted message. The output control unit 901*h* accordingly has the display 917*a* in the output unit 901*i* display the formatted message.

In Step S934, the event execution unit 901*e* instructs the output control unit 901*h* to output the melody pattern "1". The output control unit 901*h* accordingly has the speaker 917*b* in the output unit 901*i* output the melody pattern "1" to notify the user of the message reception.

Figure 79A:
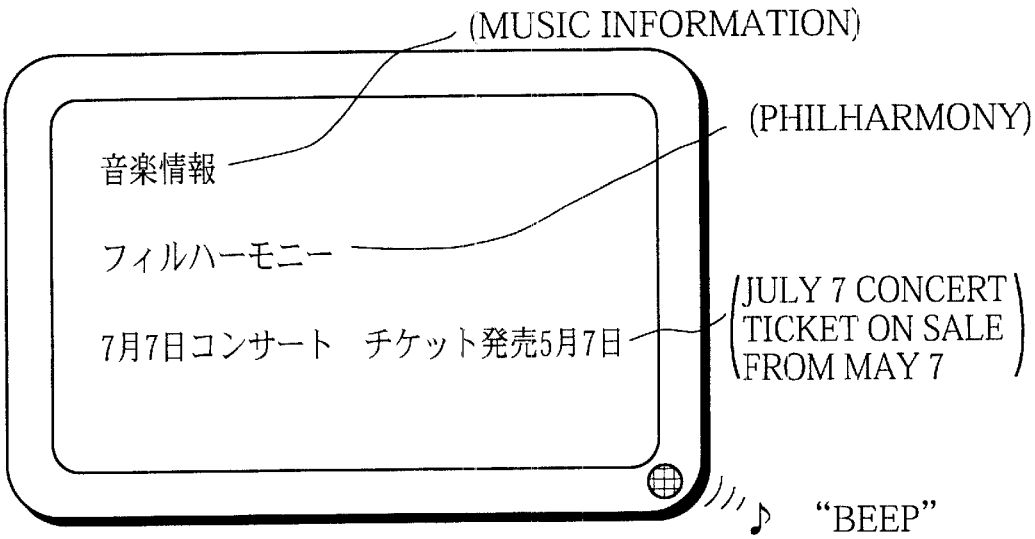
FIGS. 79A and 79B each show a specific example of the output, such as the display, in the fifth operation example.

FIG. 79A shows an output example.

Figure 78B:
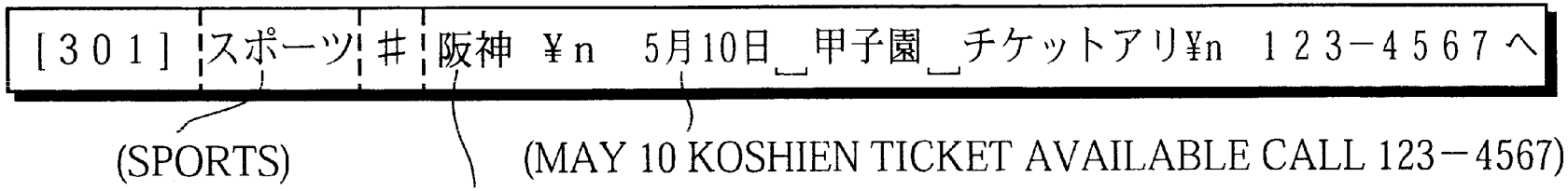
Figure 79B:
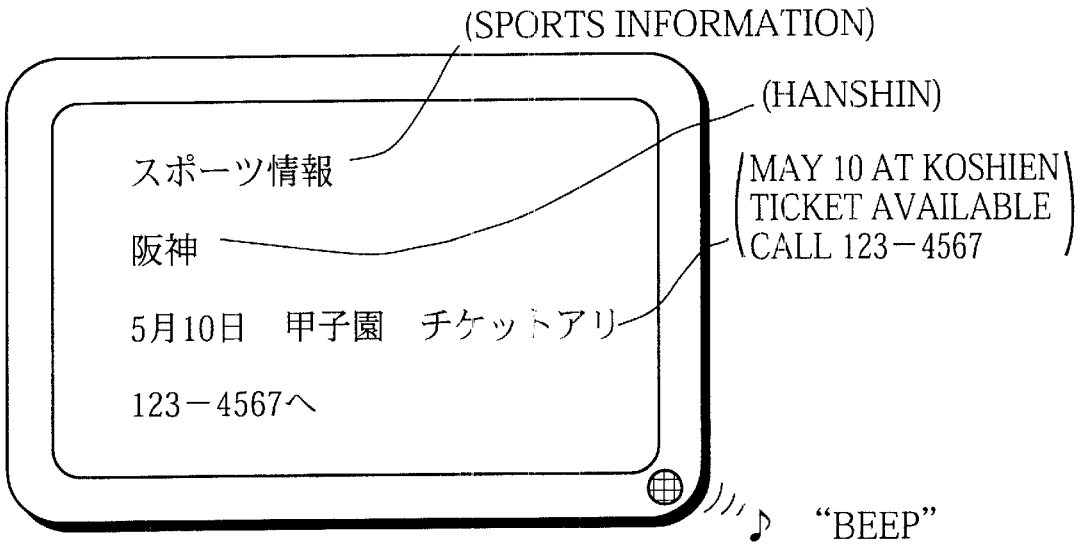

The same notification is performed when receiving a message shown in FIG. 78B as the message shown in FIG. 78A. FIG. 79B shows an output example. The message formatted in the same way as FIG. 79A is displayed with the output of the melody pattern "1" to notify the user of the message reception.

The operation of setting "音楽" (MUSIC) in the variable f1 by the input operation is explained next.

The operation proceeds from Step S931 to Step S936, since the message processing is not required.

The operation proceeds to Step S937, since the variable f1 setting is required.

"音楽" is set in the variable f1 by the input operation.

The following is an explanation of the operation of receiving the message shown in FIG. 78A and executing the program information shown in FIG. 76 when "音楽" is set in the variable f1.

The operation proceeds from Step S931 to Step S932, since the received message is to be processed using the program.

The operation proceeds to Step S933, since the variable f1 and data A in the received message both store "音楽".

The event execution unit 901*e* formats the received message and instructs the output control unit 901*h* to display the formatted message. The output control unit 901*h* accordingly has the display 917*a* in the output unit 901*i* display the formatted message.

In Step S934, the event execution unit 901*e* instructs the output control unit 901*h* to output the melody pattern "1". The output control unit 901*h* accordingly has the speaker 917*b* in the output unit 901*i* output the melody pattern "1" to notify the user of the message reception.

As a result, the message is displayed as shown in FIG. 79A and the user is notified of the message reception.

Next, the operation of receiving the message shown in FIG. 78B and executing the program information shown in FIG. 76 is explained.

The operation proceeds from Step S931 to Step S932, since the received message is to be processed using the program.

The operation proceeds to Step S935, since "音楽" set in the variable f1 does not match "スポーツ" (SPORTS) set in data A in the received message.

The event execution unit 901*e* deletes the message. As a result, the user is not notified of the message reception.

With the present embodiment, it is possible to notify the user of only selected messages among all received messages.

Also, the program information for formatting and processing messages can be registered by sending a message which includes the program information to the radio pager.

While the variable in the example program is used to determine whether notifying the user of a received message in the present embodiment, the program may be written so as to change a notification method according to the variable, so that it is possible to notify the user of received messages differently in accordance with the difference of data included in each message.

It is also possible to set more variables, in addition to the variable f1.

While the program information is registered by the message reception in the present example, it may also be inputted via a local input unit.

The program identification information 904f3 may not necessarily be expressed as a program ID but can be expressed as a program name, as long as it can be distinguished from other programs.

SIXTH EXAMPLE

The following is an explanation of the operation when receiving a message using the program information 905b3 stored in the event information storage unit 901b, with reference to FIGS. 60 and 80–85.

Figure 80:
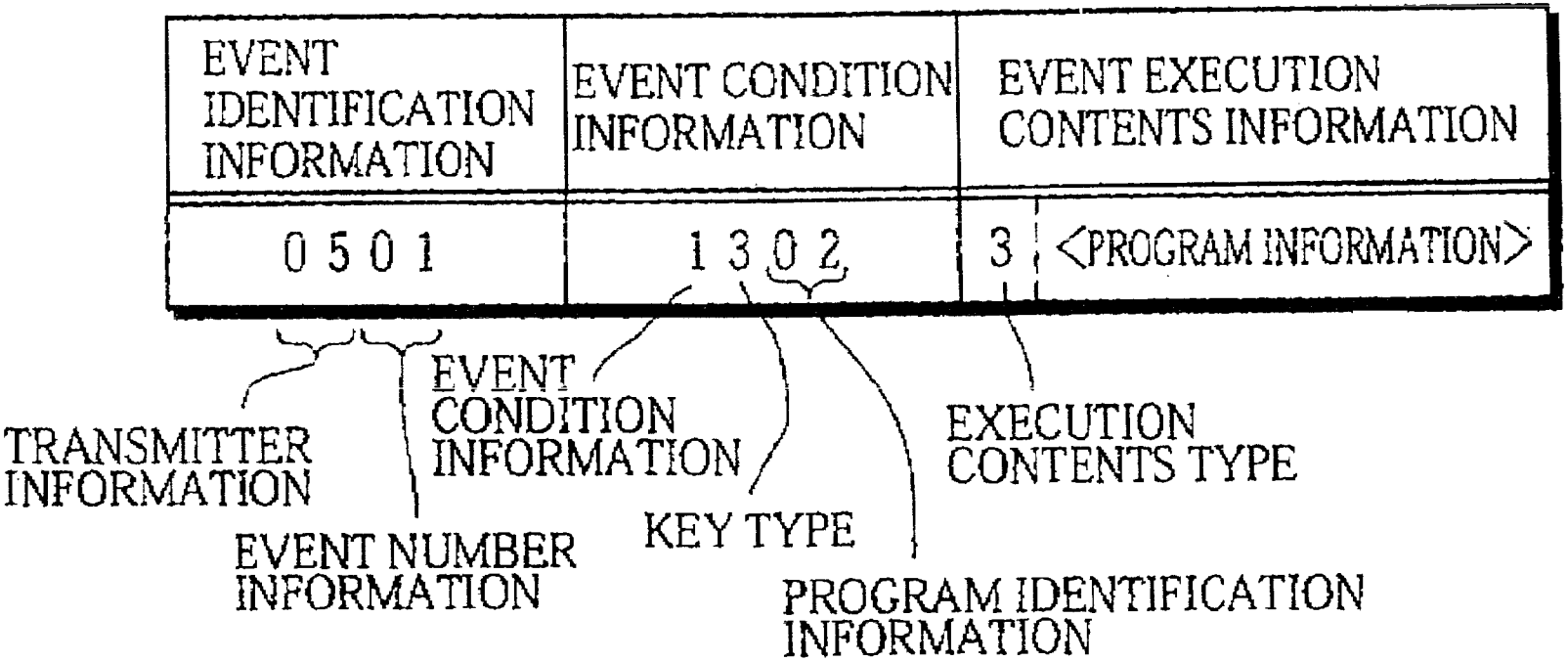
FIG. 80 shows a specific example of the program information stored in the event information storage unit in the sixth operation example.

FIG. 80 shows an example of event information stored in the event information storage unit 901b. In the figure, event identification information is made up of transmitter information "05" and event number information "01". An event condition type "1" in event condition information shows that an event occurs by a message reception, while a key type "3" shows that key contents are program information with program identification information "02". Event execution contents information is made up of an execution contents type "3" showing that execution contents are program information and the program information.

Figures 81, 82:
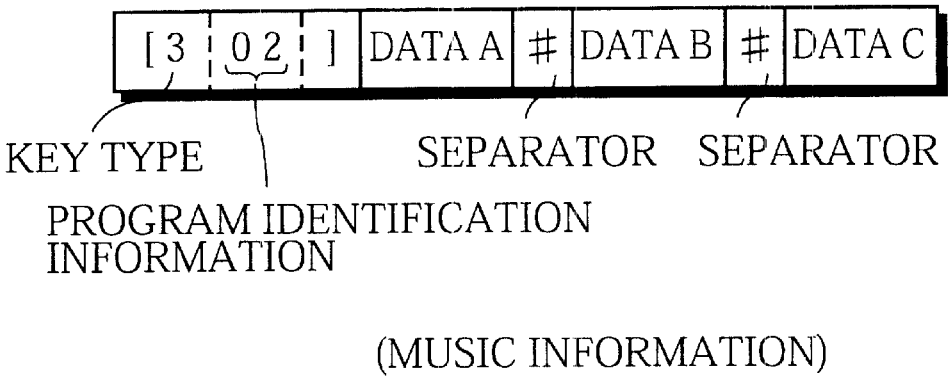
FIG. 81 shows the structure of a received message that is processed by the program in the sixth operation example.
FIG. 82 shows a description example of the program in the sixth operation example.

FIG. 81 shows the predetermined construction of a received message to be processed using the above program information. The received message includes program identification information, along with data A, data B, and data C with the separator "#" placed between each two sets of data.

The operation when receiving this message is explained below with reference to FIG. 60.

The operation proceeds from Step S901 to Step S903, since the event information storage unit 901b does not store the event condition information 902b1 which specifies a time or an elapsed time as an event condition and thus a time event does not occur.

On receiving the message shown in FIG. 81, the operation proceeds to Step S904.

The operation proceeds to Step S913, since the received message does not include internal processing information.

The event monitor unit 901d checks the event instruction information in the event information storage unit 901b. The program identification information "02" in the received message meets the condition that the program identification 904f3 be "02" specified by the event condition information 902b1 in the event information storage unit 901b. Accordingly, the event monitor unit 901d notifies the event execution unit 901e of the event occurrence.

In Step S914, the event execution unit 901e processes the received message according to the event execution contents information 902b2 that specifies the execution of the program information. That is to say, the event execution unit 901e processes the received message according to the program information. The operation then returns to Step S901.

The program information with the program identification information "02" is explained below.

FIG. 82 shows a written example of the program information.

The program information is composed of two main blocks.

Block 1 includes a variable f1 into which filter information is set, along with column variables %1, %2, and %3 for storing data included in a message to be processed. The message to be processed has the predetermined con struction as shown in FIG. 81, and data A, data B, and data C are assigned respectively to the column variables %1, %2, and %3.

Block 2 describes a method of processing the message.

In this method, if the received message has data C (column variable %3), data C (column variable %3) is set in the filter condition variable f1.

Next, the variable f1 is checked. If a condition is set in the variable f1 and the condition matches the column variable %1, that is, data A, the message is formatted and displayed (Step S945). Otherwise, the message is deleted (Step S946).

Figure 83:
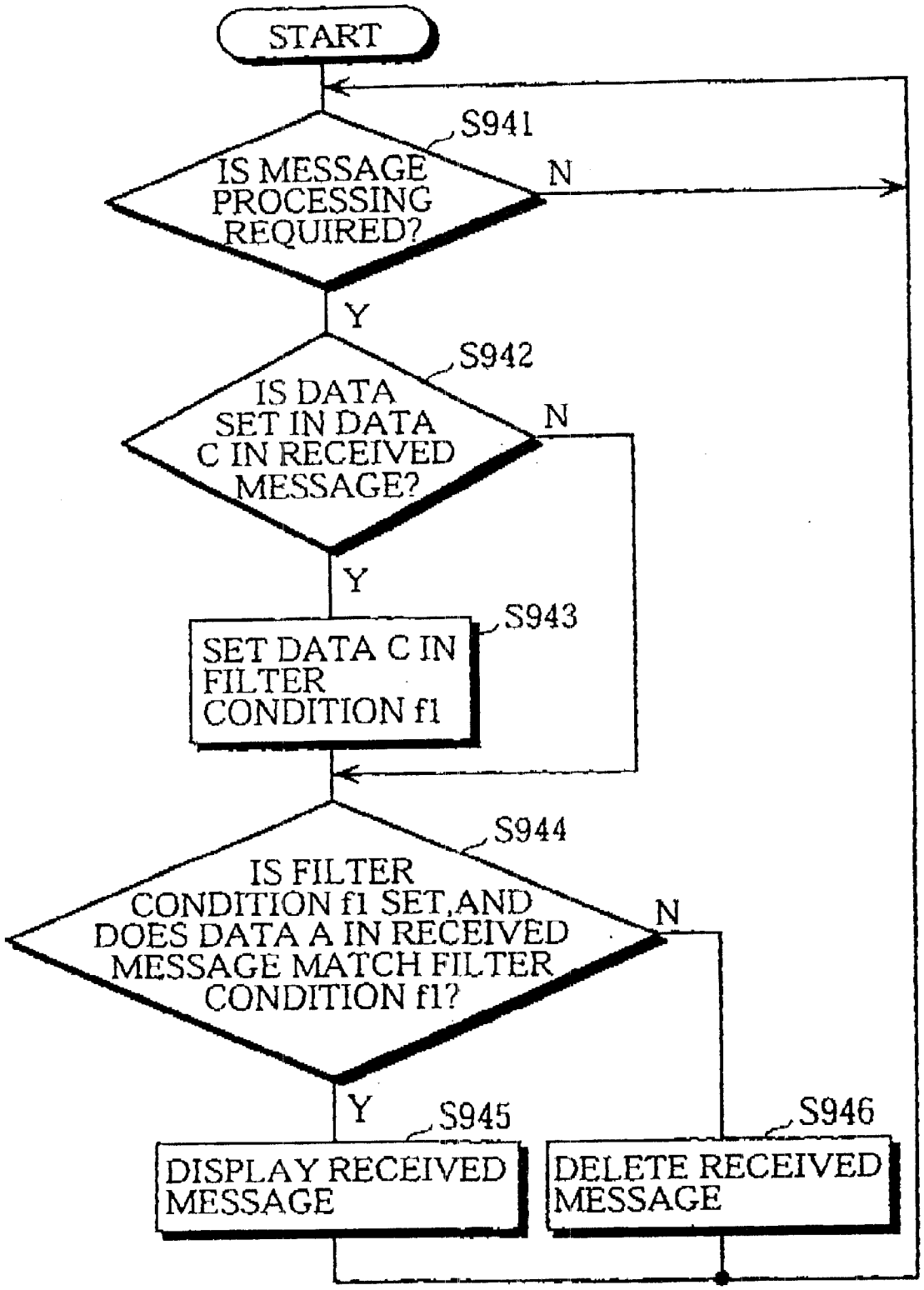
FIG. 83 is a flowchart showing the operation of the program in the sixth operation example.

FIG. 83 is a flowchart showing the processing of the program information shown in FIG. 82.

Each step in the processing is described below.

Step S941: Proceed to Step S942 if the message processing is required.

Step S942: Proceed to Step S943 if the received message has data C (filter setting condition). Otherwise, proceed to Step S944.

Step S943: Set data C (filter setting condition) into the filter condition variable f1.

Step S944: Refer to the filter condition variable f1. Proceed to Step S945 if the variable f1 is set and if the variable f1 matches data A (column variable %1). Otherwise, proceed to Step S946.

Step S945: Format and display the message according to the program information.

Step S946: Delete the message.

Figure 84A:
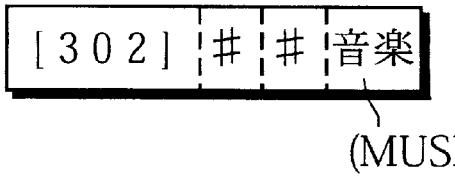
FIGS. 84A–84C each show a specific example of a received message that is processed by the program in the sixth operation example.
Figure 84B:
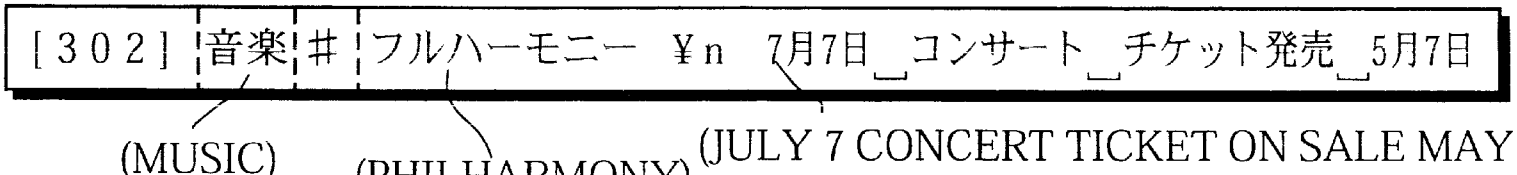

The following is an explanation of the operation of receiving a message shown in FIG. 84B and executing the program information shown in FIG. 82 when the variable f1 is not set but remains at an initial value, with reference to FIG. 83.

The operation proceeds from Step S941 to Step S942, since the received message is to be processed using the program.

The operation proceeds to Step S944, since the received message does not have data C (column variable %3).

The operation proceeds to Step S946, since the filter condition variable f1 is not set.

The received message is deleted.

Figure 84C:
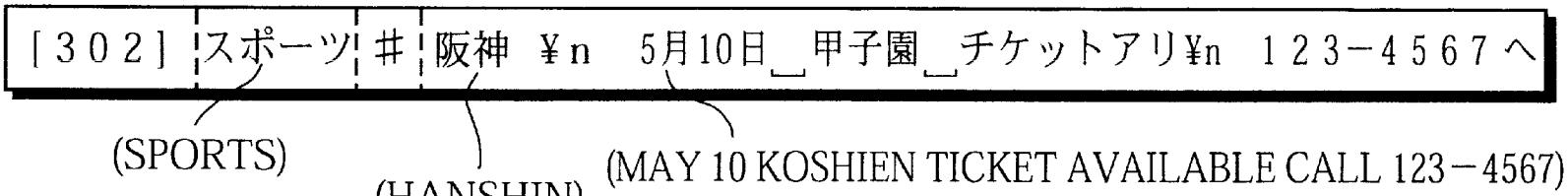

Next, the operation when receiving a message shown in FIG. 84(*a*) and executing the program information shown in FIG. 82 is explained with reference to FIG. 83.

The operation proceeds from Step S941 to Step S942, since the received message is to be processed using the program.

The operation proceeds to Step S943, since the received message has data C (column variable %3).

Data C in the received message is set into the filter condition variable f1.

In Step S944, the filter condition variable f1 does not match data A, since no data is set in data A while "音楽" is set in the filter condition variable f1.

In Step S946, the received message is deleted. However, data C ("音楽") set in the filter condition variable f1 is valid.

The following is an explanation of the operation of receiving the message shown in FIG. 84B when "音楽" is set in the filter condition variable f1.

The operation proceeds from Step S941 to Step S942, since the received message is to be processed using the program.

The operation proceeds to Step S944, since the received message does not have data C (column variable %3).

The set filter condition variable f1 matches data A "音楽" in the received message.

Figure 85:
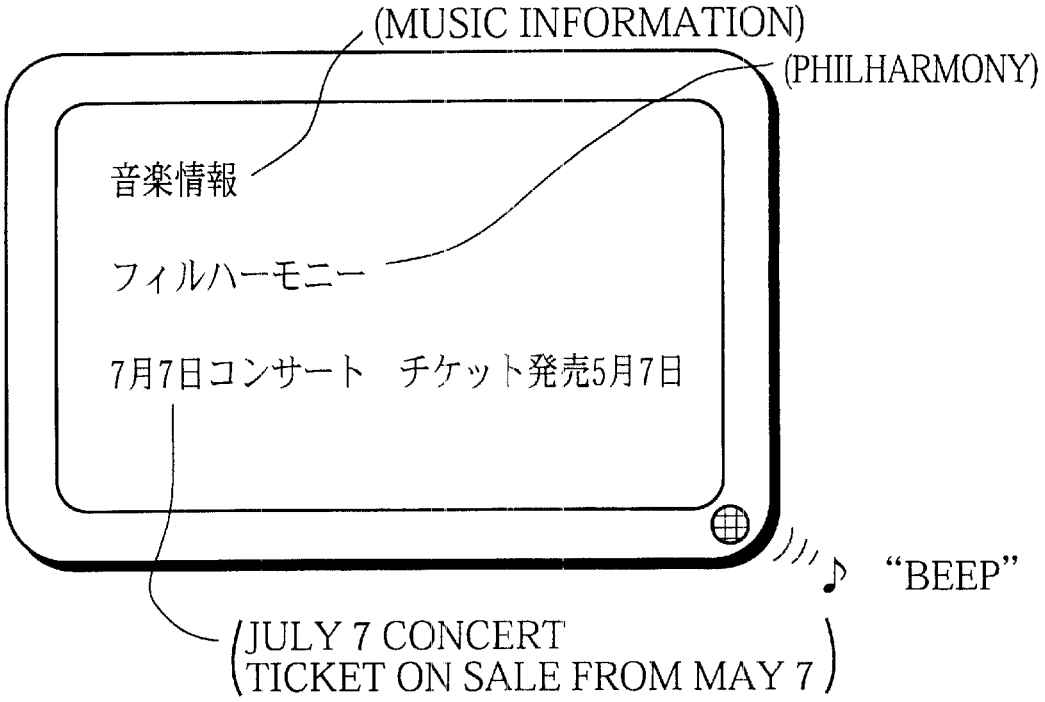
FIG. 85 shows a specific example of the output, such as the display, in the sixth operation example.

In Step S945, the received message is formatted and displayed according to the program information. An example of the display is shown in FIG. 85(*a*).

With the present embodiment, it is possible to determine how to process a received message not only by local input but also by message reception.

Accordingly, the transmitter can determine how the received message is to be processed in the receiver terminal.

As described above, in the radio pager of the present invention, it is possible to perform the control according to a condition, such as a scheduled time, an elapsed time, or key information (such as transmitter information or a keyword) included in the received message, or according to a combination of the above conditions.

Also, the output control is not limited to the fixed operation of outputting a bell sound. It is possible to specify the output control for displays and sounds. For example, it is possible to notify the user only of messages from specified transmitters, to use different notification methods for messages from different transmitters, or to notify the user only of necessary messages. These messages can be displayed at a specified time with the output of a specified sound.

Also, an event condition and event execution contents which have been registered can be changed by receiving appropriate messages. Thus, it is possible to delete or modify the event condition and event execution contents registered when the radio pager received a wrong message.

Thus, the radio pager of the present invention provides various services that includes: notification of messages only from specified transmitters; output of the bell sound only after receiving all specified messages from transmitters A, B, and C; and no sound output during a specified time period.

Note that the output setting information storage unit 901*g* may give the user a warning when the buffer for temporarily storing radio messages waiting for the occurrence of events becomes full.

The user may also be notified of the existence of the radio messages waiting for the event occurrence by certain means, such as by displaying a mark on the display 917*a*. By doing so, the user can have the waiting radio messages displayed before the event occurrence.

While there are three types of command information shown in FIG. 57 that are the setting requirement command, the deletion requirement command, and the renewal requirement command in the present embodiment, other commands may also be included, such as a command for temporarily nullifying event information which has been registered and a command for recovering the temporarily nullified event information.

Note that it is possible to combine two or more of the above embodiments. In such a case, it is not necessary to include all elements of each embodiment in the combination. If these embodiments include elements that have the same function, these elements may be replaced with one common element.

INDUSTRIAL APPLICABILITY

As described above, the radio pager of the present invention can be used to receive radio messages from transmitters and notify the user of the contents of the received messages, and is particularly effective for performing the output control in great variety and f1exibility.

What is claimed is:

1. A radio pager, comprising:

output means for performing an output operation using at least one of a display, a sound output, a vibration, and a light emission;

storage means for storing at least one template that each define a column arrangement, the template being stored as control information for controlling an output mode which includes at least one of the display, the sound output, the vibration, and the light emission;

reception means for receiving a radio message that includes a template identifier and contents of each column as parameters relating to the control information;

generating means for generating output control data, according to the received parameters and the control information; and control means for controlling the output means according to the output control data generated by the generation means, wherein the generation means includes:

analysis means for analyzing the radio message received by the reception means and detecting the template identifier and the contents of each column;

read means for reading a template specified by the detected template identifier from the storage means;

creation means for creating the output control data according to the read template and the contents of each columns;

change specification means for specifying a changed part in a preceding message stored in preceding message storage means according to a user operation;

changed contents input means for inputting changed contents in the changed part specified by the change specification means according to the user operation;

change message creation means for creating a change message which includes relation information showing a relation with the preceding message, changed part information showing the changed part specified by the change specification means, and the changed contents inputted by the changed contents input means; and transmission means for transmitting the change message created by the change message creation means.

2. The radio pager of claim 1, further comprising preceding message storage means for storing contents of each column included in preceding messages which were one of transmitted and received, wherein the reception means receives a change message which includes relation information showing a relation with a preceding message stored in the preceding message storage means, a template identifier, changed part information showing a changed part in the preceding message, and changed contents, wherein the analysis means detects the changed contents in units of columns according to the changed part information, and wherein the creation means creates a display message as the output control data using the detected changed contents and the preceding message.

3. The radio pager of claim 1, further comprising renewal means for renewing contents of the preceding message storage means according to the change message when the display message created by the creation means is displayed.

4. The radio pager of claim 1, further comprising guidance display means for displaying a guidance of each column for the user operation when specifying the changed part and the changed contents.

5. The radio pager of claim 1, further comprising transmission information addition means for adding transmission information to the preceding message stored in the preceding message storage means, the transmission information showing whether the preceding message is present in another radio pager in communication.

6. The radio pager of claim 1 wherein the template defines the column arrangement in which a column showing the template identifier, a secret word column, a person column, a time column, a place column, an event column, and a reply column are arbitrarily combined, and wherein the radio message is composed of the template identifier, the contents of each column, and separator codes.

7. A radio pager, comprising:

output unit for performing an output operation using at least one of a display, a sound output, a vibration, and a light emission;

storage unit for storing at least one template that each define a column arrangement, the template being stored as control information for controlling an output mode which includes at least one of the display, the sound output, the vibration, and the light emission;

reception unit for receiving a radio message that includes a template identifier and contents of each column as parameters relating to the control information;

generating unit for generating output control data according to the received parameters and the control information; and control unit for controlling the output unit according to the output control data generated by the generation unit, wherein the generation unit includes:

analysis unit for analyzing the radio message received by the reception unit and detecting the template identifier and the contents of each column;

read unit for reading a template specified by the detected template identifier from the storage unit; and creation unit for creating the output control data according to the read template and the contents of each column;

wherein the template defines the column arrangement in which a column showing the template identifier, a secret word column, a person column, a time column, a place column, an event column, and a reply column are arbitrarily combined; and wherein the radio message is composed of the template identifier, the contents of each column, and separator codes.

8. The radio pager of claim 7, further comprising preceding message storage unit for storing contents of each column included in preceding messages which were one of transmitted and received, wherein the reception unit receives a change message which includes relation information showing a relation with a preceding message stored in the preceding message storage unit, a template identifier, changed part information showing a changed part in the preceding message, and changed contents, wherein the analysis unit detects the changed contents in units of columns according to the changed part information, and wherein the creation unit creates a display message as the output control data using the detected changed contents and the preceding message.

9. The radio pager of claim 7, further comprising renewal unit for renewing contents of the preceding message storage means according to the change message when the display message created by the creation means is displayed.

10. The radio pager of claim 7, further comprising change specification unit for specifying a changed part in a preceding message stored in preceding message storage unit according to a user operation;

changed contents input unit for inputting changed contents in the changed part specified by the change specification means according to the user operation;

change message creation unit for creating a change message which includes relation information showing a relation with the preceding message, changed part information showing the changed part specified by the change specification unit, and the changed contents inputted by the changed contents input unit; and transmission unit for transmitting the change message created by the change message creation unit.

11. The radio pager of claim 10, further comprising guidance display unit for displaying a guidance of each column for the user operation when specifying the changed part and the changed contents.

12. The radio pager of claim 10, further comprising transmission information addition unit for adding transmission information to the preceding message stored in the preceding message storage unit, the transmission information showing whether the preceding message is present in another radio pager in communication.

13. A radio pager, comprising:

output unit for performing an output operation using at least one of a display, a sound output, a vibration, and a light emission;

storage unit for storing at least one template that each define a column arrangement, the template being stored as control information for controlling an output mode which includes at least one of the display, the sound output, the vibration, and the light emission;

reception unit for receiving a radio message that includes a template identifier and contents of each column as parameters relating to the control information;

generating unit for generating output control data according to the received parameters and the control information; and control unit for controlling the output unit according to the output control data generated by the generation unit, wherein the generation unit includes:

analysis unit for analyzing the radio message received by the reception unit and detecting the template identifier and the contents of each column;

read unit for reading a template specified by the detected template identifier from the storage means;

creation unit for creating the output control data according to the read template and the contents of each column;

change specification unit for specifying a changed part in a preceding message stored in preceding message storage unit according to a user operation;

changed contents input unit for inputting changed contents in the changed part specified by the change specification unit according to the user operation;

change message creation unit for creating a change message which includes relation information showing a relation with the preceding message, changed part information showing the changed part specified by the change specification unit, and the changed contents inputted by the changed contents input unit; and transmission unit for transmitting the change message created by the change message creation unit.

* * * * *